US009364964B2

(12) United States Patent
Watanabe et al.

(10) Patent No.: US 9,364,964 B2
(45) Date of Patent: Jun. 14, 2016

(54) CUTTER AND RECORDER

(75) Inventors: Sumio Watanabe, Shinagawa (JP); Yukihiro Mori, Shinagawa (JP); Masahiro Tsuchiya, Shinagawa (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 439 days.

(21) Appl. No.: 12/860,087

(22) Filed: Aug. 20, 2010

(65) Prior Publication Data

US 2011/0048198 A1 Mar. 3, 2011

(30) Foreign Application Priority Data

Aug. 27, 2009 (JP) ..... 2009-197320

(51) Int. Cl.

| | |
|---|---|
| ***B26D 1/00*** | (2006.01) |
| ***B26D 1/12*** | (2006.01) |
| ***B26D 1/18*** | (2006.01) |
| ***B26D 1/38*** | (2006.01) |
| ***B26D 5/00*** | (2006.01) |
| ***B26D 5/34*** | (2006.01) |
| ***B41J 11/70*** | (2006.01) |
| *B26D 7/00* | (2006.01) |

(52) U.S. Cl.

CPC *B26D 1/385* (2013.01); *B26D 5/00* (2013.01); *B26D 5/34* (2013.01); *B41J 11/706* (2013.01); *B26D 7/00* (2013.01); *Y10T 83/141* (2015.04); *Y10T 83/8812* (2015.04)

(58) Field of Classification Search

CPC ..... B26D 1/385; B26D 1/38; B26D 5/34; B26D 5/00; B26D 7/00; B65H 35/08; B41J 11/70; B41J 11/706; Y10T 83/8812; Y10T 83/141

USPC ..... 83/651–661, 664–666, 676–677, 83/488–508

See application file for complete search history.

(56) References Cited

U.S. PATENT DOCUMENTS

| | | | | |
|---|---|---|---|---|
| 2,836,241 | A | 5/1958 | Fritzinger | |
| 3,898,902 | A * | 8/1975 | Cailloux | 83/378 |
| 3,918,339 | A * | 11/1975 | Cailloux | 83/611 |
| 4,114,491 | A * | 9/1978 | Hashimoto | B26D 1/385 83/341 |
| 4,119,003 | A * | 10/1978 | Corse | B26D 1/626 83/341 |
| 4,244,251 | A * | 1/1981 | Iwao | B26D 1/385 83/349 |

(Continued)

FOREIGN PATENT DOCUMENTS

| | | |
|---|---|---|
| DE | 3522022 | 1/1986 |
| DE | 103 51 877 A1 | 6/2005 |

(Continued)

OTHER PUBLICATIONS

Extended European Search Report dated Apr. 11, 2011.

(Continued)

*Primary Examiner* — Ghassem Alie
*Assistant Examiner* — Bharat C Patel
(74) *Attorney, Agent, or Firm* — IPUSA, PLLC

(57) ABSTRACT

A cutter includes a cutting part including a movable blade and a fixed blade, the movable blade being configured to be moved by a drive mechanism; an operation part configured to cause an edge of the movable blade to move in an arc by causing the drive mechanism to be driven; and a blade pressure generation part configured to cause a blade pressure to be generated between the movable blade and the fixed blade.

15 Claims, 40 Drawing Sheets

(56) References Cited

U.S. PATENT DOCUMENTS

| | | | | |
|---|---|---|---|---|
| 4,663,638 | A | 5/1987 | Hirose | |
| 5,088,370 | A * | 2/1992 | Kondo | B26D 1/385 241/32 |
| 5,186,090 | A * | 2/1993 | Bunch, Jr. | B26D 1/385 83/341 |
| 5,223,940 | A | 6/1993 | Matsumoto | |
| 5,359,915 | A * | 11/1994 | Hitz | B26D 1/385 83/342 |
| 5,613,788 | A * | 3/1997 | Dobring | 400/621 |
| 5,735,185 | A * | 4/1998 | Kondo et al. | 83/611 |
| 6,250,823 | B1 * | 6/2001 | Harris et al. | 400/56 |
| 6,508,600 | B1 * | 1/2003 | Nonaka | 400/621 |
| 6,814,516 | B2 * | 11/2004 | Tsuchiya et al. | 400/621 |
| 7,059,793 | B2 * | 6/2006 | Mori et al. | 400/621 |
| 7,267,500 | B2 * | 9/2007 | Tsuchiya et al. | 400/621 |
| 7,273,325 | B2 * | 9/2007 | Watanabe et al. | 400/621 |
| 7,547,153 | B2 * | 6/2009 | Yoshioka | 400/621 |
| 7,547,154 | B2 * | 6/2009 | Kawaguchi | 400/621 |
| 7,731,437 | B2 * | 6/2010 | Shirotori et al. | 400/621 |
| 8,277,134 | B2 * | 10/2012 | Kawaguchi | 400/621 |
| 2003/0033922 | A1 * | 2/2003 | Scott | 83/582 |
| 2004/0057771 | A1 * | 3/2004 | Yamada et al. | 400/621 |
| 2004/0096256 | A1 * | 5/2004 | Hayashi et al. | 400/621 |
| 2004/0184863 | A1 * | 9/2004 | Mori et al. | 400/621 |
| 2005/0036820 | A1 * | 2/2005 | Watanabe et al. | 400/621 |
| 2005/0207818 | A1 * | 9/2005 | Tsuchiya et al. | 400/621 |
| 2005/0281606 | A1 * | 12/2005 | Koyama et al. | 400/621 |
| 2006/0266179 | A1 * | 11/2006 | Yamashita | 83/130 |
| 2007/0028739 | A1 * | 2/2007 | Kawaguchi | 83/651 |
| 2007/0107575 | A1 * | 5/2007 | Hanaoka et al. | 83/618 |
| 2007/0199422 | A1 * | 8/2007 | Kawaguchi | 83/583 |
| 2007/0296799 | A1 * | 12/2007 | Watanabe et al. | 347/222 |
| 2008/0095563 | A1 * | 4/2008 | Miyashita et al. | 400/74 |
| 2008/0127796 | A1 * | 6/2008 | Nonaka | 83/613 |
| 2008/0260448 | A1 * | 10/2008 | Tsuchiya et al. | 400/621 |
| 2009/0074496 | A1 * | 3/2009 | Mori et al. | 400/120.01 |
| 2009/0245915 | A1 * | 10/2009 | Kawaguchi | 400/621 |
| 2009/0279935 | A1 * | 11/2009 | Kawaguchi | 400/621 |
| 2009/0317163 | A1 * | 12/2009 | Kohira et al. | 400/621 |
| 2010/0278579 | A1 * | 11/2010 | Ohashi | 400/621 |

FOREIGN PATENT DOCUMENTS

| | | | |
|---|---|---|---|
| EP | 1095782 | | 5/2001 |
| JP | 03-227877 | | 10/1991 |
| JP | 10277988 | A * | 10/1998 |
| JP | 10-337693 | | 12/1998 |
| JP | 2000-280574 | | 10/2000 |
| JP | 2001-341369 | | 12/2001 |
| JP | 2003-089247 | | 3/2003 |
| JP | 2004-106483 | | 4/2004 |
| JP | 2004-291219 | | 10/2004 |
| JP | 2005-059503 | | 3/2005 |
| JP | 2005-271204 | | 10/2005 |
| JP | 2009226554 | A * | 10/2009 |
| WO | WO 2004/076139 | | 9/2004 |

OTHER PUBLICATIONS

Partial European Search Report dated Dec. 22, 2010.

* cited by examiner

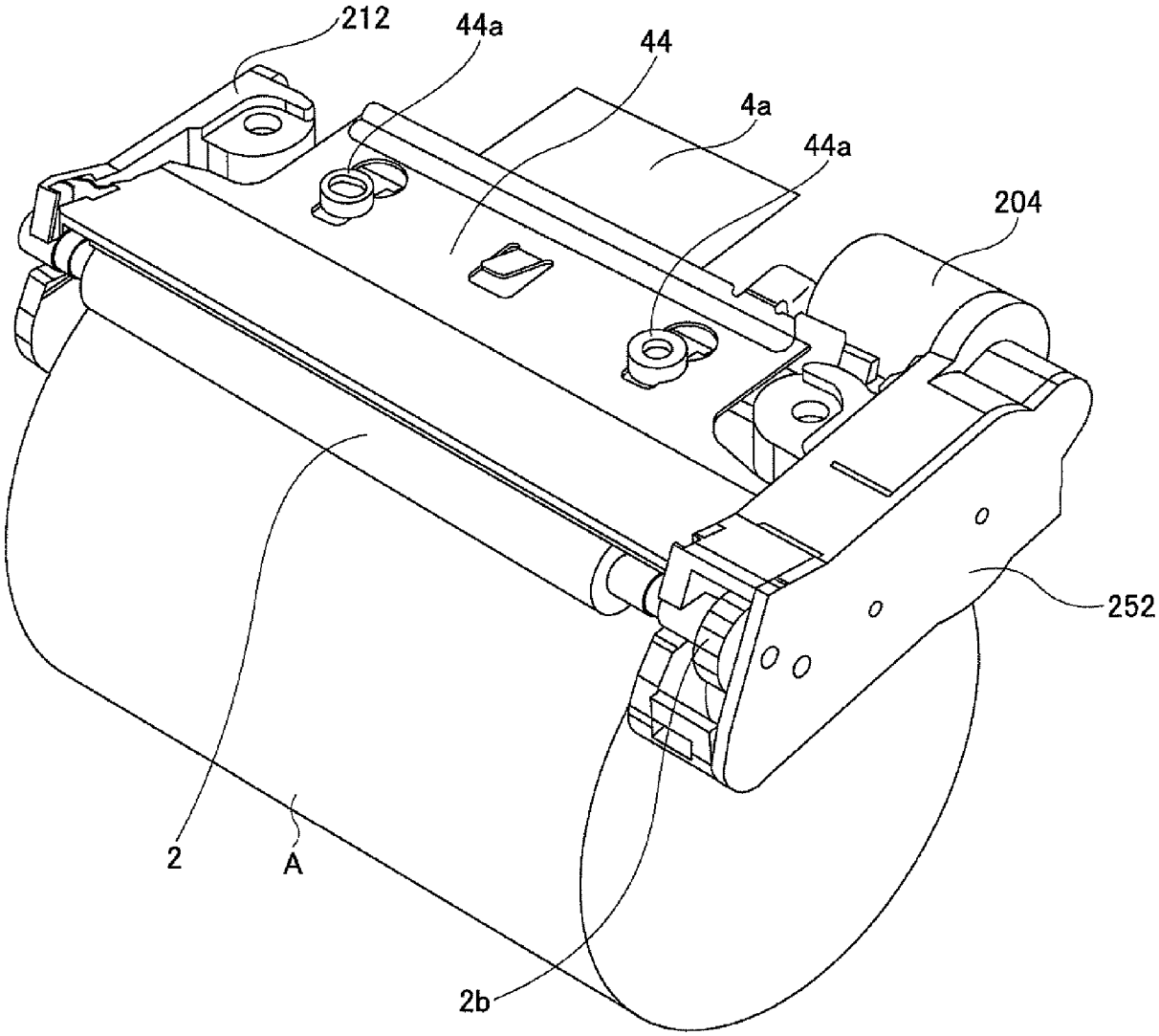
FIG.25
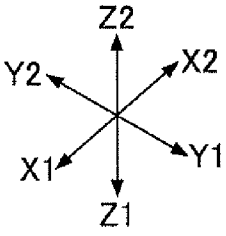

CUTTER AND RECORDER

CROSS-REFERENCE TO RELATED APPLICATION

The present application is based upon and claims the benefit of priority of Japanese Patent Application No. 2009-197320, filed on Aug. 27, 2009, the entire contents of which are incorporated herein by reference.

BACKGROUND OF THE INVENTION

1. Field of the Invention

The present invention relates to a cutter (cutting apparatus) that cuts an object of cutting and to a recorder (recording apparatus) including the cutter.

2. Description of the Related Art

There is a conventional recorder including a cutter that uses a movable blade and a fixed blade. (See, for example, Japanese Laid-Open Patent Application No. 2005-271204.)

FIGS. 1A and 1B are schematic diagrams illustrating part of a conventional cutter.

Referring to FIG. 1A, a platen roller 103 presses a sheet of paper 108 such as heat sensitive paper against a thermal head 104. The platen roller 103 rotates to draw the sheet of paper 108, on which the thermal head 104 performs printing.

Then, a movable blade 8 slides linearly to cut the sheet of paper 108. The sheet of paper 108 is cut by a fixed blade 106 and the sliding movable blade 8.

SUMMARY OF THE INVENTION

According to an aspect of the present invention, a cutter includes a cutting part including a movable blade and a fixed blade, the movable blade being configured to be moved by a drive mechanism; an operation part configured to cause an edge of the movable blade to move in an arc by causing the drive mechanism to be driven; and a blade pressure generation part configured to cause a blade pressure to be generated between the movable blade and the fixed blade.

According to an aspect of the present invention, a recorder includes a cutter including a cutting part including a movable blade and a fixed blade, the movable blade being configured to be moved by a drive mechanism; an operation part configured to cause an edge of the movable blade to move in an arc by causing the drive mechanism to be driven; and a blade pressure generation part configured to cause a blade pressure to be generated between the movable blade and the fixed blade.

The object and advantages of the embodiment will be realized and attained by means of the elements and combinations particularly pointed out in the claims.

It is to be understood that both the foregoing general description and the following detailed description are exemplary and explanatory and not restrictive of the invention as claimed.

BRIEF DESCRIPTION OF THE DRAWINGS

Other objects, features and advantages of the present invention will become more apparent from the following detailed description when read in conjunction with the accompanying drawings, in which:

FIG. 25 is a perspective view of the arrangement of FIG. 24 with paper in a rolled-up state placed below the platen roller according to the embodiment of the present invention;

DETAILED DESCRIPTION OF THE PREFERRED EMBODIMENTS

Figure 1A:
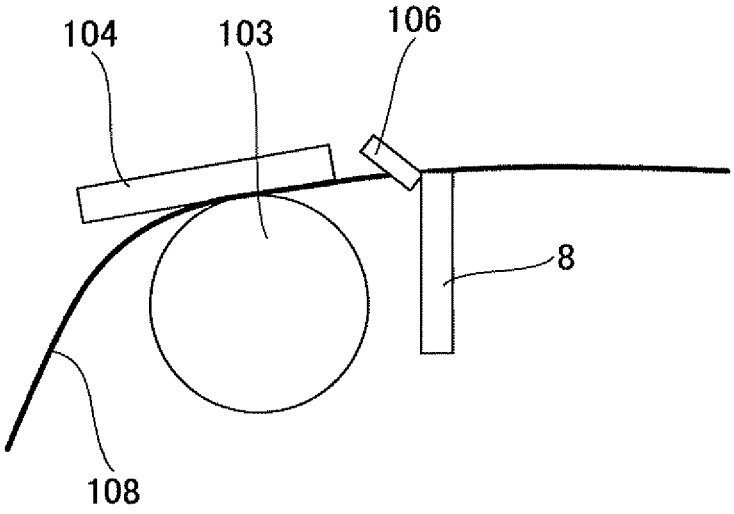
FIG.1A RELATED ART
FIG. 1A is a schematic diagram illustrating a conventional cutter before cutting paper.
Figure 1B:
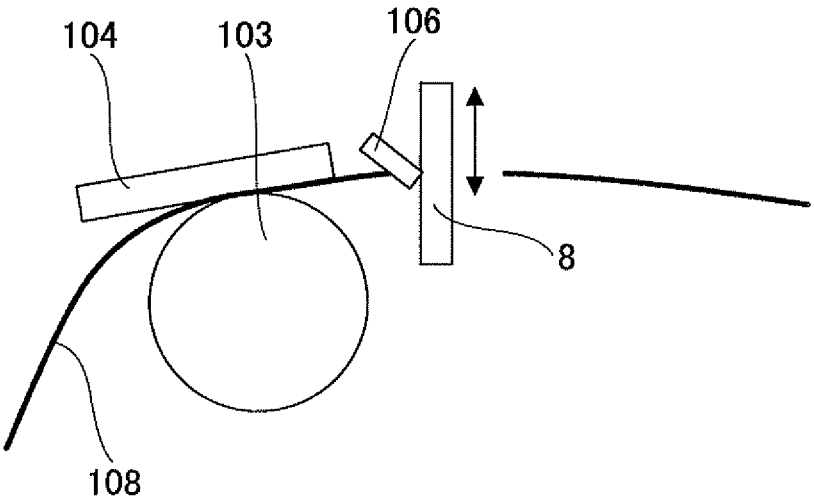
FIG.1B RELATED ART
FIG. 1B is a schematic diagram illustrating the conventional cutter after cutting the paper.

As illustrated in FIG. 1B, the movable blade 8 slides linearly. However, this movement of the movable blade 8 makes it necessary to reserve a sliding distance L for the movable blade 8, which makes it difficult to reduce the size of the cutter.

According to one aspect of the present invention, a cutter is provided that is reduced in size while retaining the sheet cutting capability of the conventional cutter, and a recorder including the cutter is provided.

A description is given below, with reference to the accompanying drawings, of embodiments of the present invention.

Figure 2A:
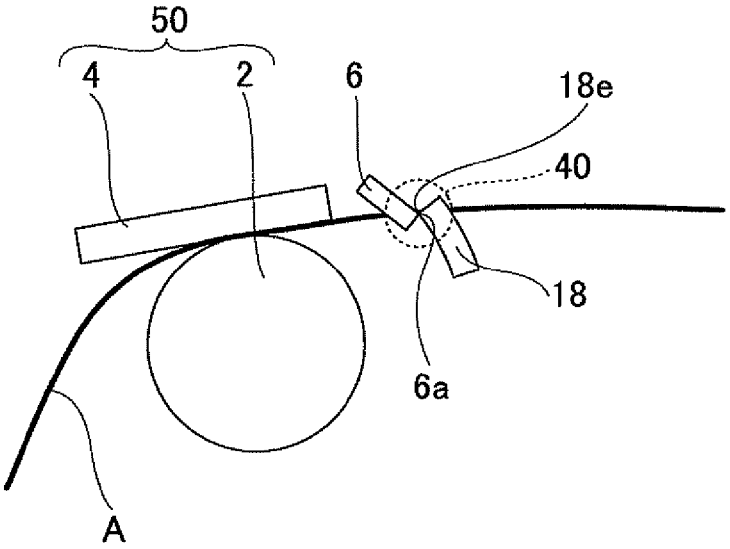
FIG. 2A is a schematic diagram illustrating a cutter before cutting paper according to an embodiment of the present invention.
Figure 2B:
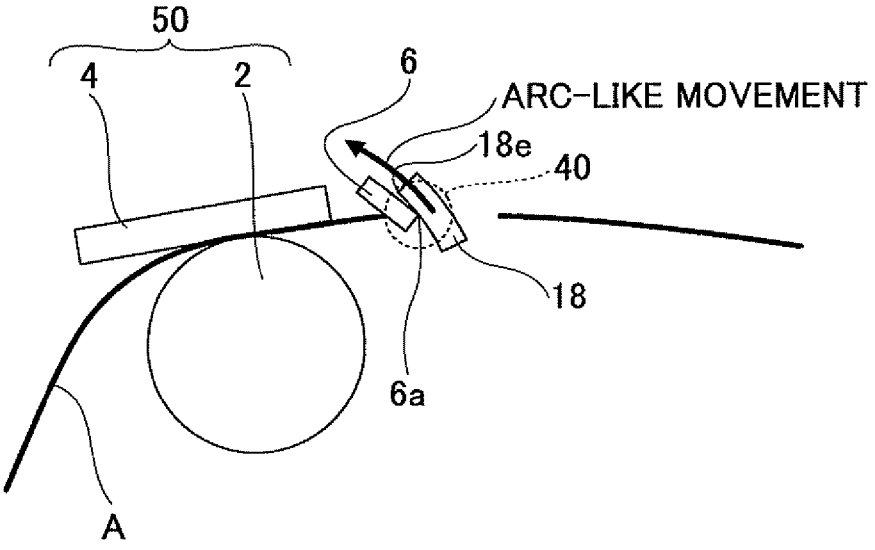
FIG. 2B is a schematic diagram illustrating the cutter after cutting the paper according to the embodiment of the present invention.

FIGS. 2A and 2B are diagrams illustrating an embodiment of the present invention. A cutter according to this embodiment includes a cutting part including a movable blade that is configured to move and a fixed blade. An object of cutting is cut by the cutting part. FIG. 2A illustrates a state before an object of cutting is cut by the cutting part, and FIG. 2B illustrates a state after the object of cutting is cut by the cutting part.

Referring to FIG. 2A, the cutter according to this embodiment includes a movable blade 18 and a fixed blade 6. A blade pressure is generated between the movable blade 18 and the fixed blade 6. The cutter includes a cutting part 40 that cuts an object of cutting A. The cutting part 40 includes an edge 18*e* of the movable blade 18 and an edge 6*a* of the fixed blade 6. The object of cutting A, which is an object cut by the cutting part 40, may be, for example, a sheet or roll of paper such as heat sensitive paper. Hereinafter, the object of cutting A is described as "paper A."

A printing unit 50 includes a platen roller 2 and a thermal head (print head) 4. The platen roller 2 presses the paper A against the thermal head 4. The platen roller 2 rotates to draw a part to be subjected to printing of the paper A into where the platen roller 2 and the thermal head 4 are in press contact, and the thermal head 4 performs printing on (the part of) the drawn paper A.

After printing by the printing unit 50, a control part 500 (FIG. 35) transmits a CUT command to the cutter. In response to receiving the CUT command, the movable blade 18 moves in an arc or a curved path as illustrated in FIG. 2B. The paper A subjected to printing is cut by the cutting part 40, or the movable blade 18 that has moved in an arc and the fixed blade 6. In the following, the cutter is described as being configured to cut a sheet or roll of paper subjected to printing by the printing unit 50 of a thermal head type. However, the cutter may also be configured to cut a sheet or roll of paper subjected to printing by other types of printing units than the thermal-head-type printing unit 50.

In FIG. 2A, the paper A is not cut. Accordingly, the state of the cutting part 40 illustrated in FIG. 2A is hereinafter referred to as "pre-cutting state." In FIG. 2B, the paper A is cut. Accordingly, the state of the cutting part 40 illustrated in FIG. 2B is hereinafter referred to as "post-cutting state."

As described above, the movable blade 18 is moved in an arc. Accordingly, unlike in the conventional cutter, it is not necessary to reserve a space that allows the sliding distance L (FIG. 1B). Therefore, the cutter of this embodiment is reduced in size compared with the conventional cutter.

Figure 3:
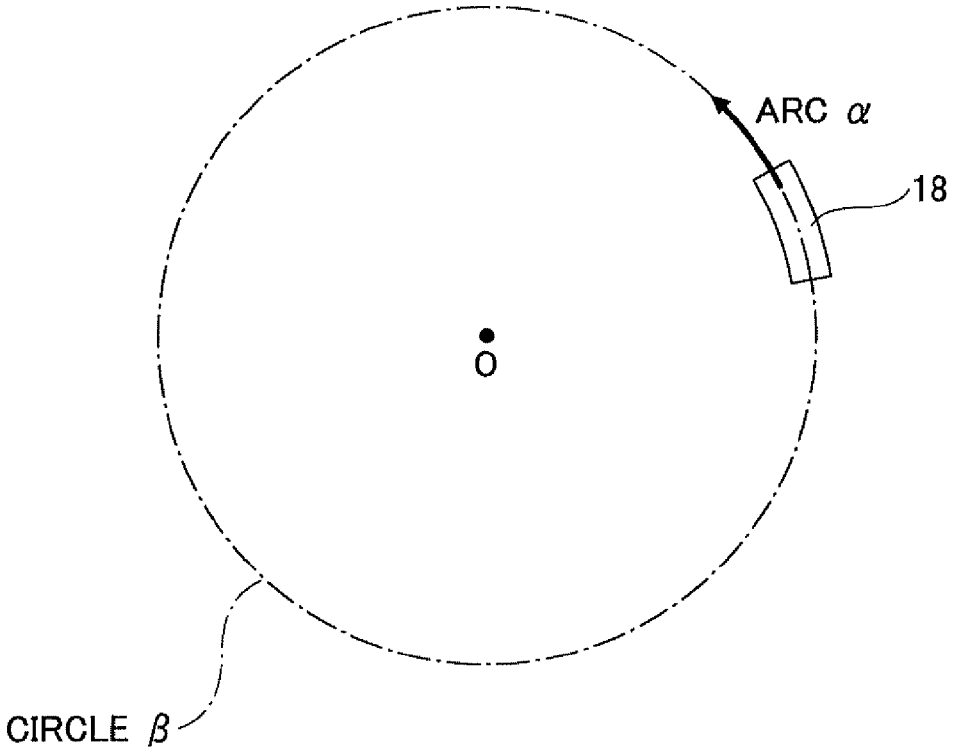
FIG. 3 is a diagram for illustrating an arc according to the embodiment of the present invention.

FIG. 3 is a diagram for illustrating an arc $\alpha$, which is the trail or movement path of the movable blade 18. Here, the arc $\alpha$ passes through the widthwise center of the movable blade 18 to extend in the moving (traveling) direction of the movable blade 18. In the following, the phrase "inside the arc $\alpha$" indicates the area inside a circle $\beta$ formed by extending the arc $\alpha$, and the phrase "outside the arc $\alpha$" indicates the area outside the circle $\beta$, of which a portion is the arc $\alpha$. Further, the center of the circle $\beta$ is denoted by O in FIG. 3.

FIGS. 4A through 4D illustrate arrangements of the movable blade 18, the fixed blade 6, etc.

Figure 4A:
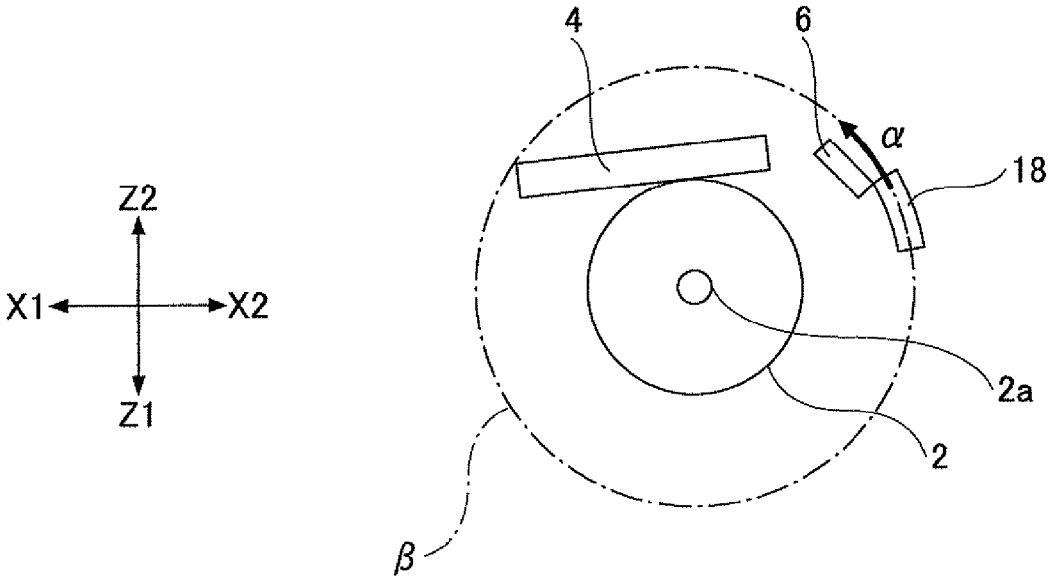
FIG. 4A is a diagram illustrating a case where a fixed blade is positioned inside the arc and a platen roller is placed inside the arc according to the embodiment of the present invention.

FIG. 4A illustrates the case where the fixed blade 6 is positioned inside the arc α (circle β) and the platen roller 2 is placed inside the arc α (circle β).

Figure 4B:
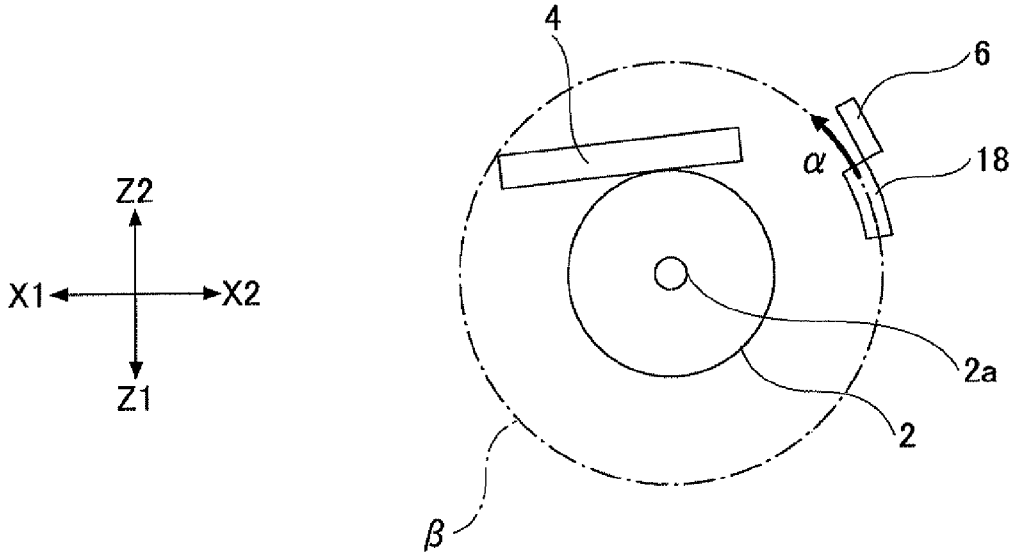
FIG. 4B is a diagram illustrating a case where the fixed blade is positioned outside the arc and the platen roller is placed inside the arc according to the embodiment of the present invention.

FIG. 4B illustrates the case where the fixed blade 6 is positioned outside the arc α and the platen roller 2 is placed inside the arc α.

Figure 4C:
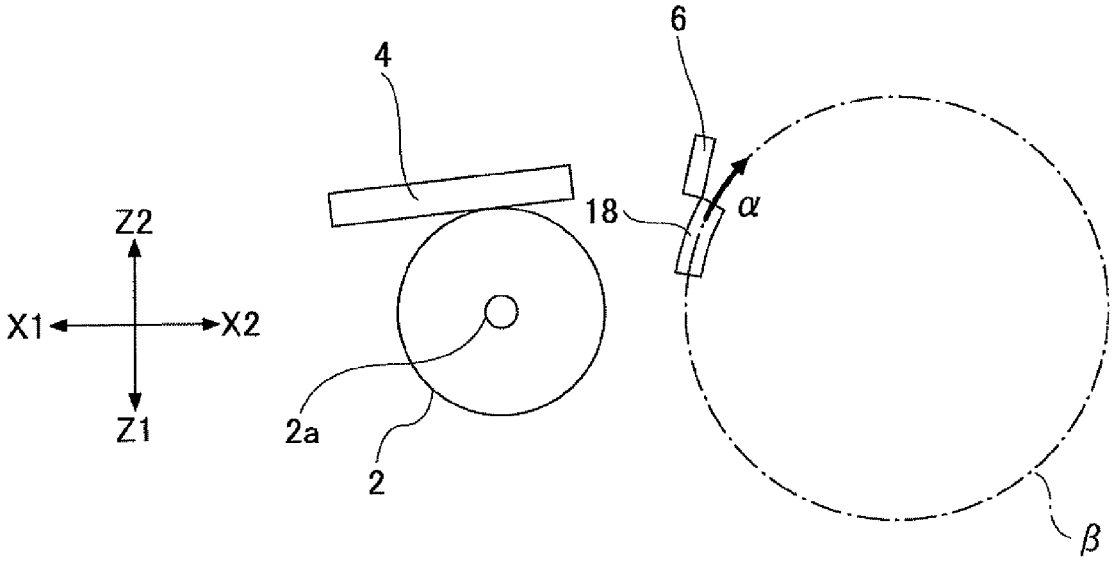
FIG. 4C is a diagram illustrating a case where the fixed blade is positioned outside the arc and the platen roller is placed outside the arc according to the embodiment of the present invention.

FIG. 4C illustrates the case where the fixed blade 6 is positioned outside the arc α and the platen roller 2 is placed outside the arc α.

Figure 4D:
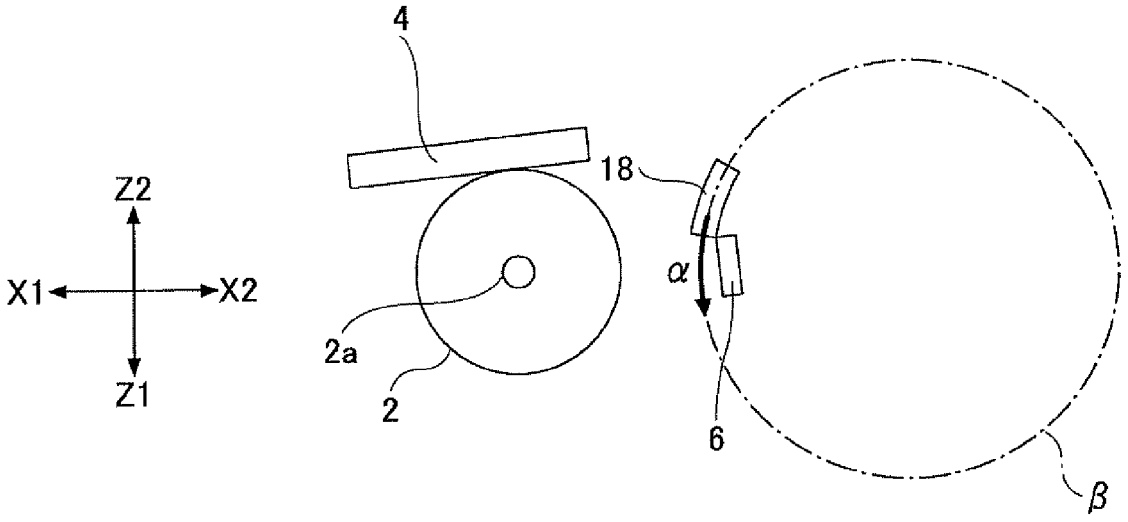
FIG. 4D is a diagram illustrating a case where the fixed blade is positioned inside the arc and the platen roller is placed outside the arc according to the embodiment of the present invention.

FIG. 4D illustrates the case where the fixed blade 6 is positioned inside the arc α and the platen roller 2 is placed outside the arc α.

It is preferable that a platen rotary shaft 2*a* of the platen roller 2 be positioned at or near the center O of the circle β (arc α) (FIG. 3), that is, the platen rotary shaft 2*a* of the platen roller 2 pass through the center O or its vicinity, as illustrated in FIG. 4A, because this makes it possible to further reduce the size of the cutter.

The following description is given based on the assumption that the cutter is configured as illustrated in FIG. 4A unless otherwise specified. However, embodiments of the present invention are applicable to the configurations illustrated in FIGS. 4B through 4D as well.

Next, a description is given, with reference to the accompanying drawings, of a recorder according to the embodiment of the present invention. In the following, configurations having the same function are referred to by the same reference numeral, and a redundant description thereof is omitted. The same applies to processes performing the same operation or processing.

Figure 5:
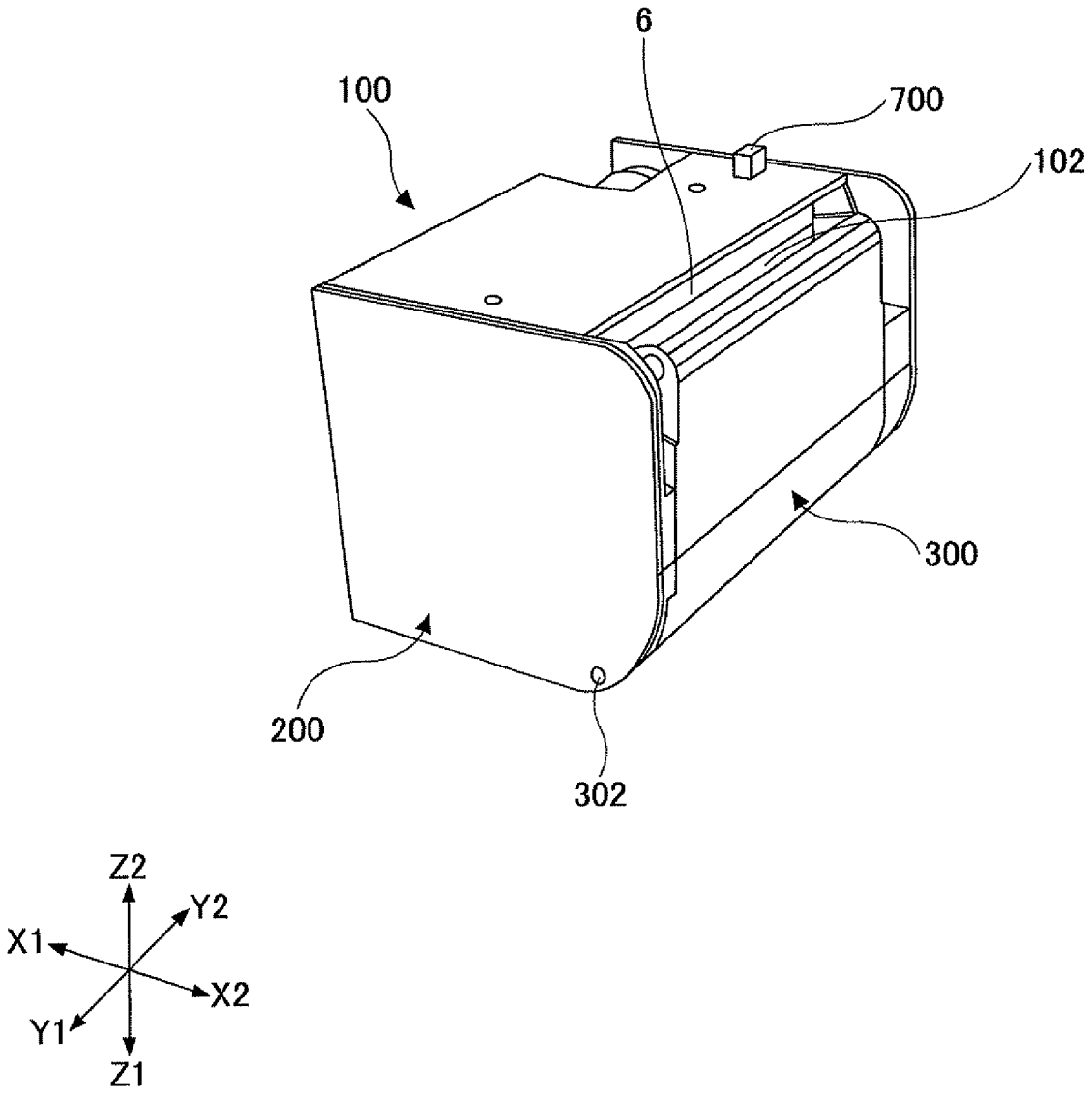
FIG. 5 is a perspective view of a recorder where a first module and a second module are integrated according to the embodiment of the present invention.

FIG. 5 is a perspective view of a recorder 100 including the cutter according to this embodiment. The recorder 100 has the shape of a substantially rectangular parallelepiped. Further, in addition to the cutter of this embodiment, the recorder 100 contains the printing unit 50 and the paper A (FIGS. 2A and 2B).

As described above, the printing unit 50 includes the platen roller 2 and the thermal head 4. The printing unit 50 performs printing on the paper A, and the paper A, which has been subjected to printing, is cut by the cutter and discharged from a discharge opening 102.

In the following description, the widthwise directions of the paper A discharged from the discharge opening 102 are determined as the widthwise directions of the recorder 100, and the direction in which the paper A is discharged and its opposite direction are determined as the lengthwise directions of the recorder 100.

As illustrated in FIG. 5, the lengthwise directions of the recorder 100 are referred to as X1 and X2 directions, the widthwise directions of the recorder 100 are referred to as Y1 and Y2 directions, and the heightwise directions of the recorder 100 are referred to as Z1 and Z2 directions.

Figure 6:
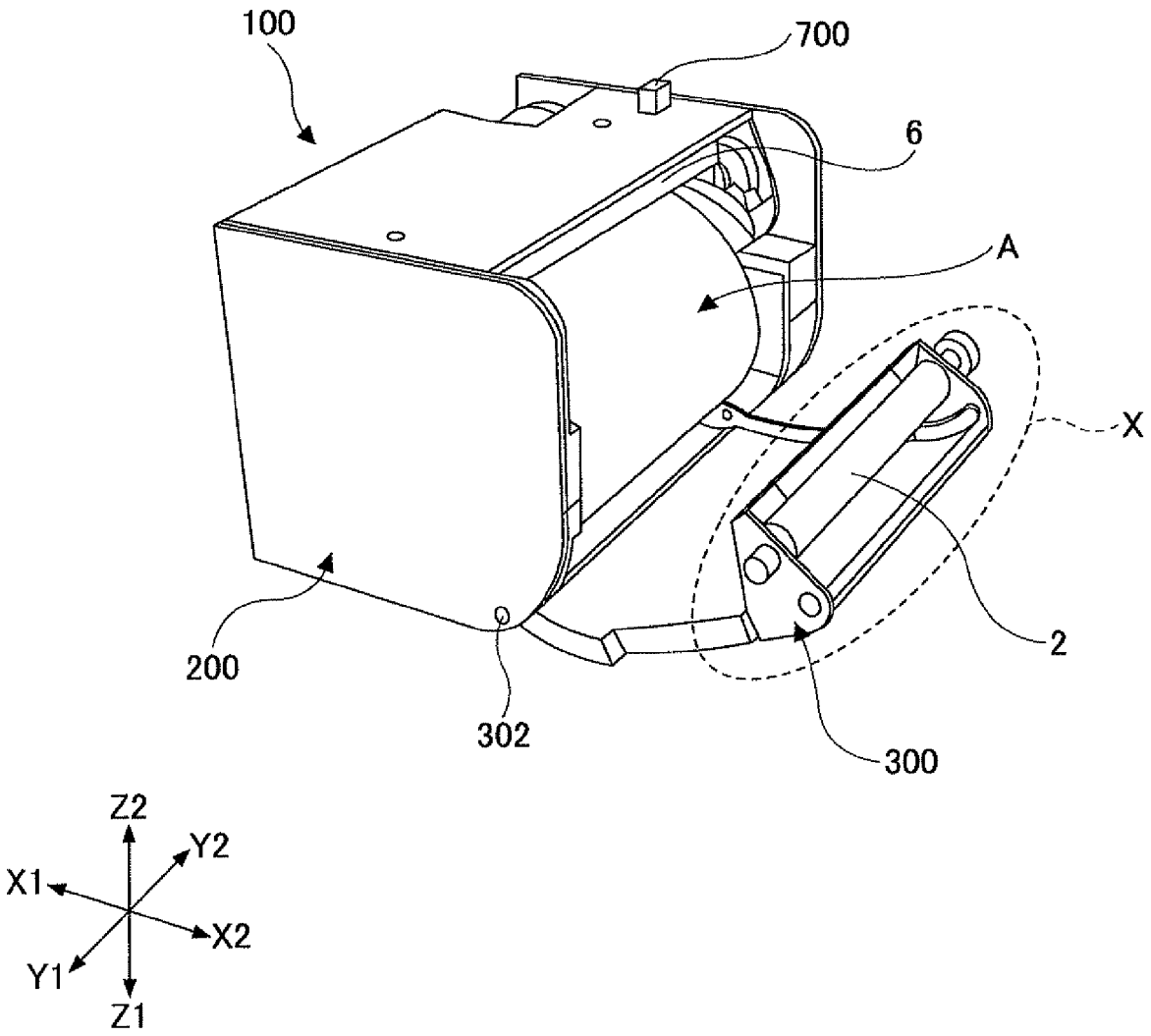
FIG. 6 is a perspective view of the recorder where the first module and the second module are separated according to the embodiment of the present invention.

Referring to FIG. 5 and FIG. 6, the recorder 100 includes a first module 200 and a second module 300.

As illustrated in FIG. 6, the second module 300 may be turned on a first rotation shaft 302 in a direction away from the first module 200 and then in a direction toward the first module 200. When the second module 300 is turned in the direction toward the first module 200 by, for example, a user, the first module 200 and the second module 300 are integrated (connected or combined). The first module 200 and the second module 300 are integrated to form the cutting part 40 (FIGS. 2A and 2B). The state of the cutting part 40 immediately after its formation is the above-described pre-cutting state.

Further, when the second module 300 integrated with the first module 200 is turned on the first rotation shaft 302 in the direction away from the first module 200 by, for example, a user, the first module 200 and the second module 300 are separated. This separation dissolves or disintegrates the cutting part 40 (so that there is no formation of the cutting part 40).

Further, in the case of FIG. 6, the first module 200 houses the rolled-up paper A, the thermal head 4, and the fixed blade 6, and the second module 300 houses the movable blade 18 and the platen roller 2. The movable blade 18 is not graphically illustrated in the second module 300 of FIG. 6 in order to show the platen roller 2.

After rotating the second module 300 in the direction away from the first module 200 (that is, separating the first module 200 and the second module 300), a user loads the first module 200 with the paper A or takes out the paper A that has been used and reduced in amount. That is, the second module 300 also serves as the lid or sheet cover of the first module 200.

In the case of performing printing on the paper A, it is preferable to use the recorder 100, which is divided into the first module 200 and the second module 300, if the paper A is rolled up. The recorder 100 is used as, for example, a receipt issuing device used in automatic teller machines of banks.

Further, if the paper A is not rolled up but is planar, it is preferable to use a recorder that is not divided into multiple modules such as the first module 200 and the second module 300. Such a recorder is hereinafter referred to as an inseparable recorder. The inseparable recorder is used as, for example, a ticket printer. The cutter according to this embodiment may also be applied to the inseparable recorder. In the following, a description is given of a case where the cutter of this embodiment is applied to the recorder 100.

Further, a retreating (retracting) operation part 700 illustrated in FIG. 5 and FIG. 6 is also described below.

Figure 7A:
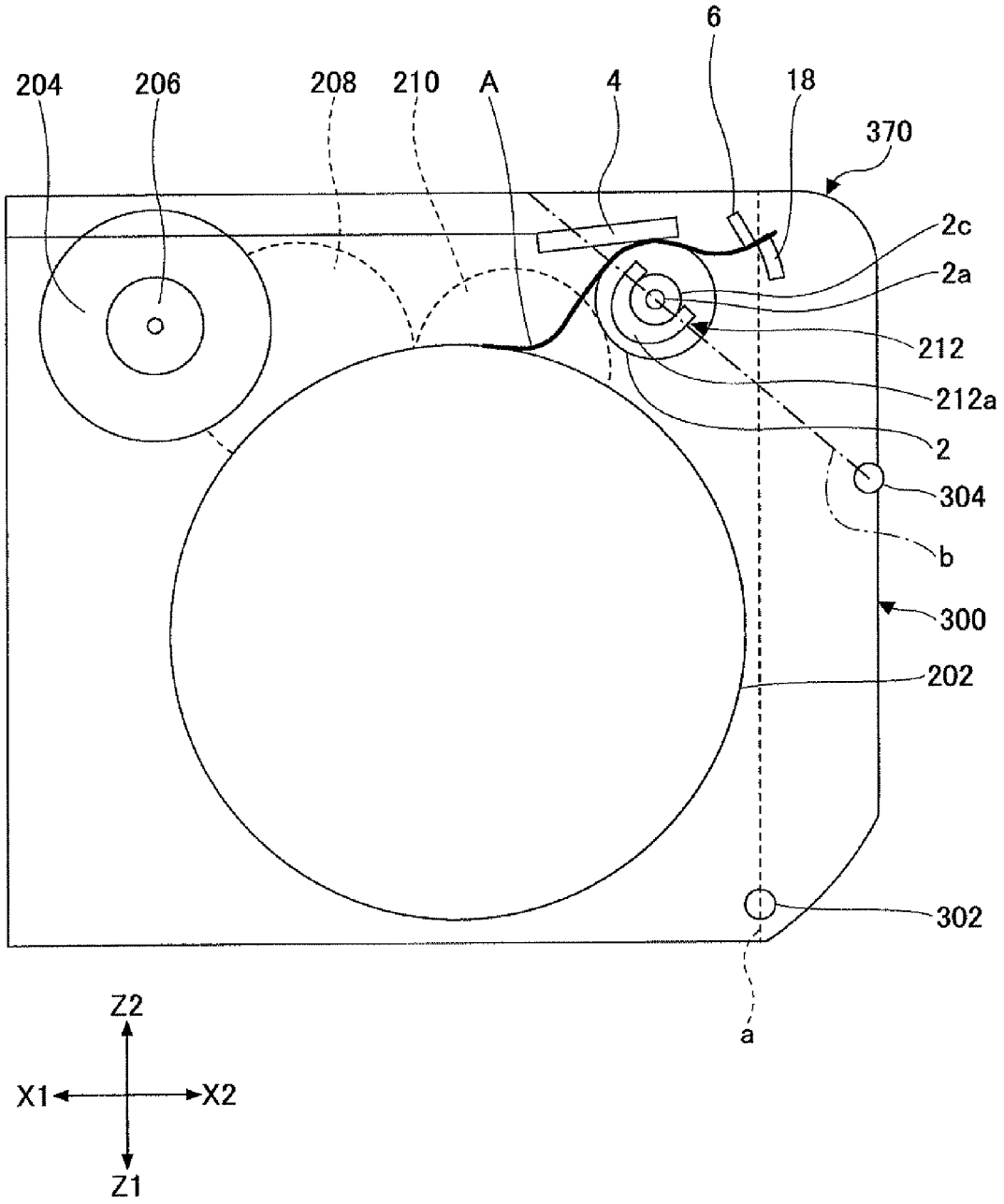
FIG. 7A is a cross-sectional view of the recorder according to the embodiment of the present invention.

FIG. 7A is a cross-sectional view of the recorder 100 where the first module 200 and the second module 300 are integrated.

Referring to FIG. 7A, a roll holding part 202 configured to hold the roll of paper A is formed inside the recorder 100. A platen rotating motor (drive source) 204 (hereinafter simply referred to as "motor") for rotating the platen roller 2 is provided on the upper left of (obliquely upward from) the roll holding part 202. The motor 204 is driven to rotate a rotor (not graphically illustrated) supported by a rotor bearing 206. The rotation (rotational driving) is transmitted to the platen roller 2 through a gear 208 and a gear 210, so that the platen roller 2 is rotated.

Further, the integration of the first module 200 and the second module 300 forms the cutting part 40 and causes the platen rotary shaft 2*a*, which is the rotating shaft of the platen roller 2, to be rotatably supported by a shaft support member 212. The platen rotary shaft 2*a* is rotatably housed inside a bearing member 2*c* (bearing tube) larger in diameter than the platen rotary shaft 2*a*. Accordingly, the bearing member 2*c* is fit to the shaft support member 212, so that the platen rotary shaft 2*a* is rotatably supported by the shaft support member 212. In the drawings, the platen rotary shaft 2*a* and the bearing member 2*c* may be omitted for convenience of graphical representation.

In FIG. 7A, an end part 212*a* of the shaft support member 212 is illustrated. The end part 212*a*, whose cross section has a U-letter shape or an inverted U-letter shape, includes an air gap (space) 212*b* (FIG. 7C). When the first module 200 and the second module 300 are integrated, the platen rotary shaft 2*a* passes through the air gap 212*b* to be supported by the end part 212*a* of the shaft support member 212. In the following, this is described as the platen rotary shaft 2*a* being supported by the shaft support member 212.

Figure 7B:
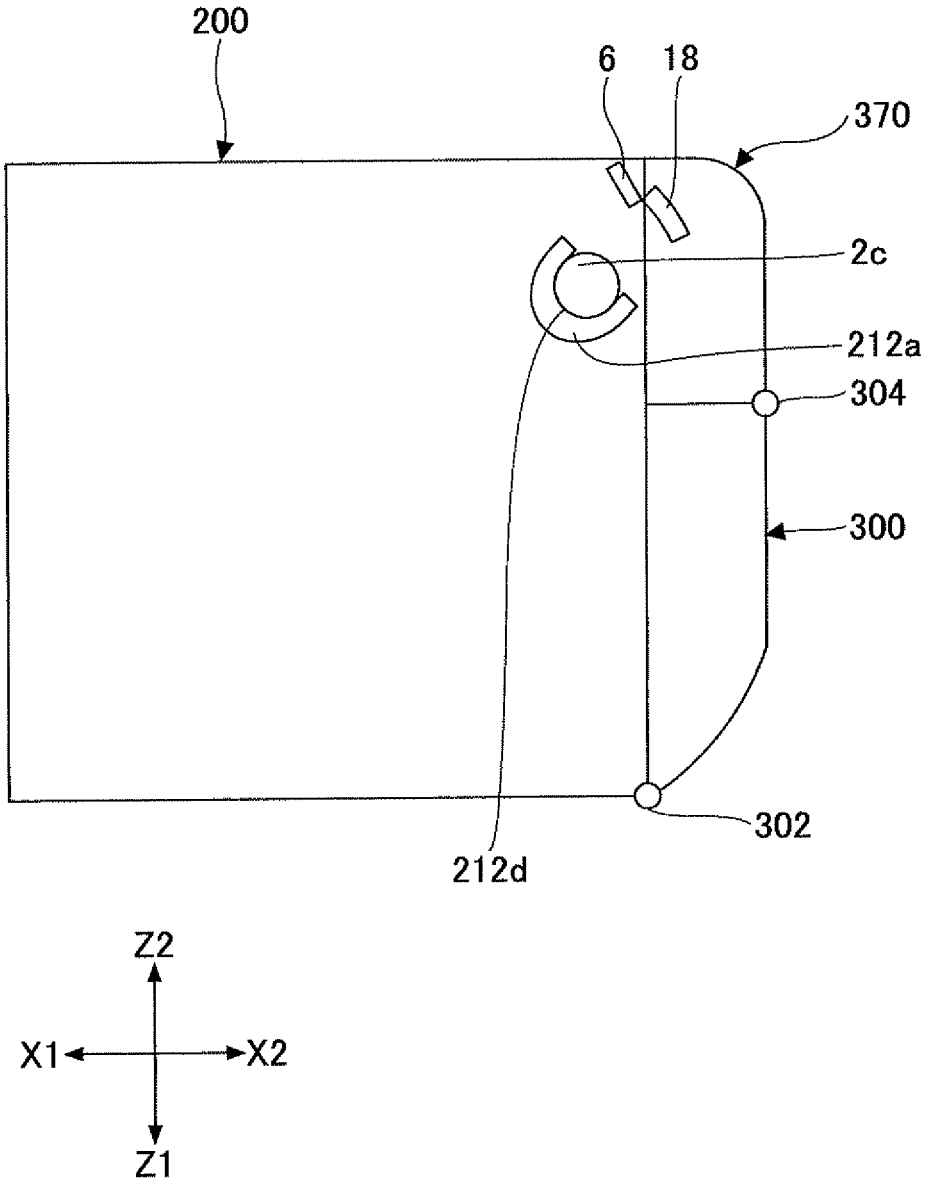
FIG. 7B is a schematic diagram illustrating the recorder where a movable blade block has turned in a direction to approach the first module according to the embodiment of the present invention.
Figure 7C:
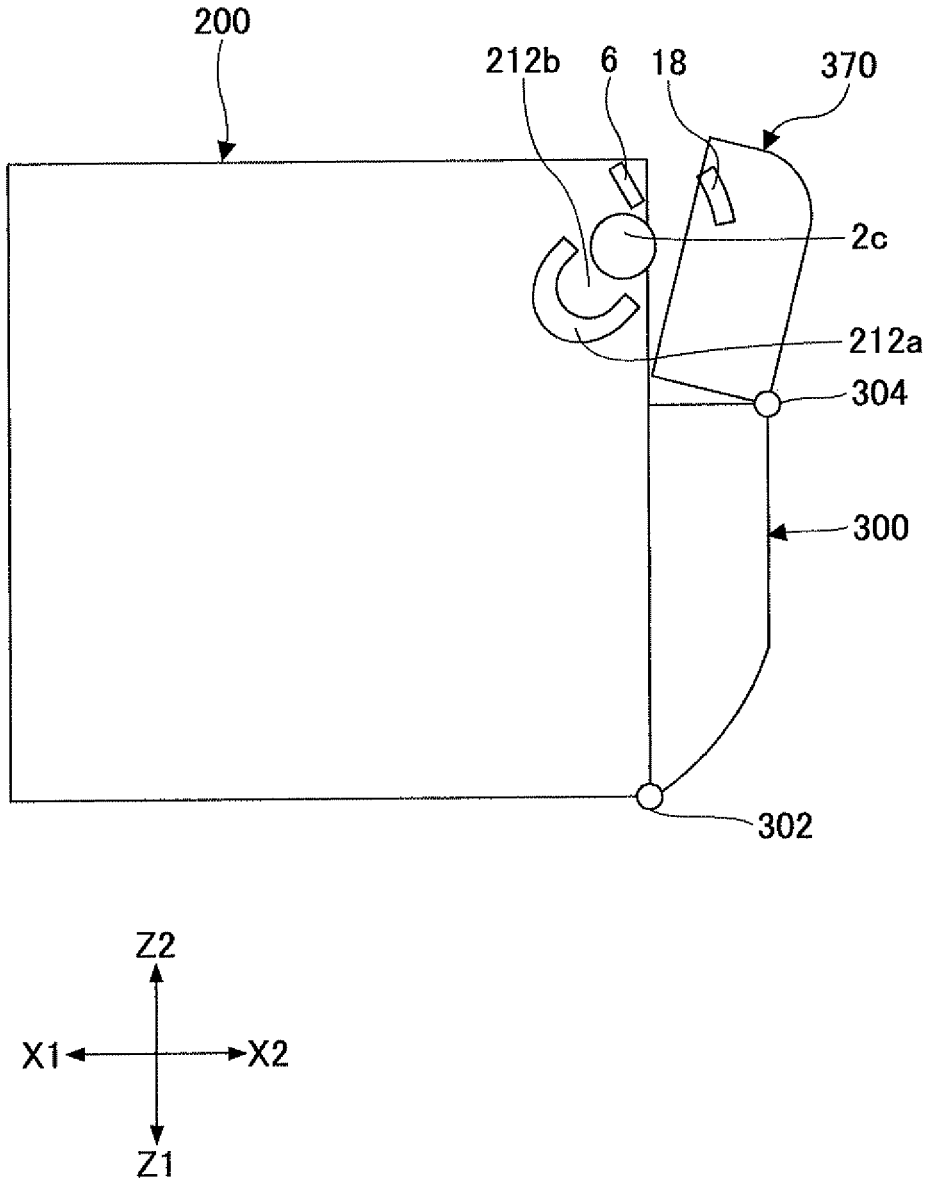
FIG. 7C is a schematic diagram illustrating the recorder where the movable blade block has turned in a direction away from the first module according to the embodiment of the present invention.

FIG. 7B is a simplified version of FIG. 7A. It is preferable that the shaft support member 212 have the air gap 212*b* formed (to be open) in a direction toward the upper right in FIG. 7B. This is for the following reasons. First, when a user integrates the first module 200 and the second module 300, the bearing member 2*c* of the platen roller 2 is caused to fit into the shaft support member 212, pushing up the thermal head 4. Accordingly, it is possible to give a user a feeling of clicking. Further, by directing a bottommost part 212*d* of the air gap 212*b* (the shaft support member 212), which has a substantially U-shaped cross section, toward the lower left in FIG. 7B, the bearing member 2*c* is fixed to the bottommost part 212*d*, thus being stably fit to the shaft support member 212.

As described above, the air gap 212*b* is formed in the direction toward the upper right. Accordingly, the rotation of the first rotation shaft 302 alone does not cause the bearing member 2*c* to properly fit to the shaft support member 212 through the air gap 212*b*. Accordingly, a movable blade block 370 is provided inside the second module 300.

Referring to FIG. 7A, the movable blade block 370 includes the movable blade 18 and the platen roller 2. As illustrated in FIG. 7C, the movable blade block 370 is configured to rotate (pivot) on a second rotation shaft 304 in a direction away from and in a direction toward (to approach) the first module 200. The distance of this rotation is small. By thus providing the movable blade block 370 inside the second module 300, the bearing member 2*c* is stably supported by the shaft support member 212. In FIG. 7A, the movable blade block 370 is the upper portion of the second module 300 defined by a broken line a and a one-dot chain line b.

As described above, when the first module 200 and the second module 300 are integrated, the platen rotary shaft 2*a* (the bearing member 2*c*) is positioned at the bottommost part 212*d* (FIG. 75) through the air gap 212*b* (FIG. 7C), so that the platen rotary shaft 2*a* is supported by the shaft support member 212. Further, when the first module 200 and the second module 300 are separated, the platen rotary shaft 2*a* (the bearing member 2*c*) positioned at the bottommost part 212*d* passes through the air gap 212*b* so that the platen rotary shaft 2*a* is disengaged from and unsupported by the shaft support member 212.

Figure 8:
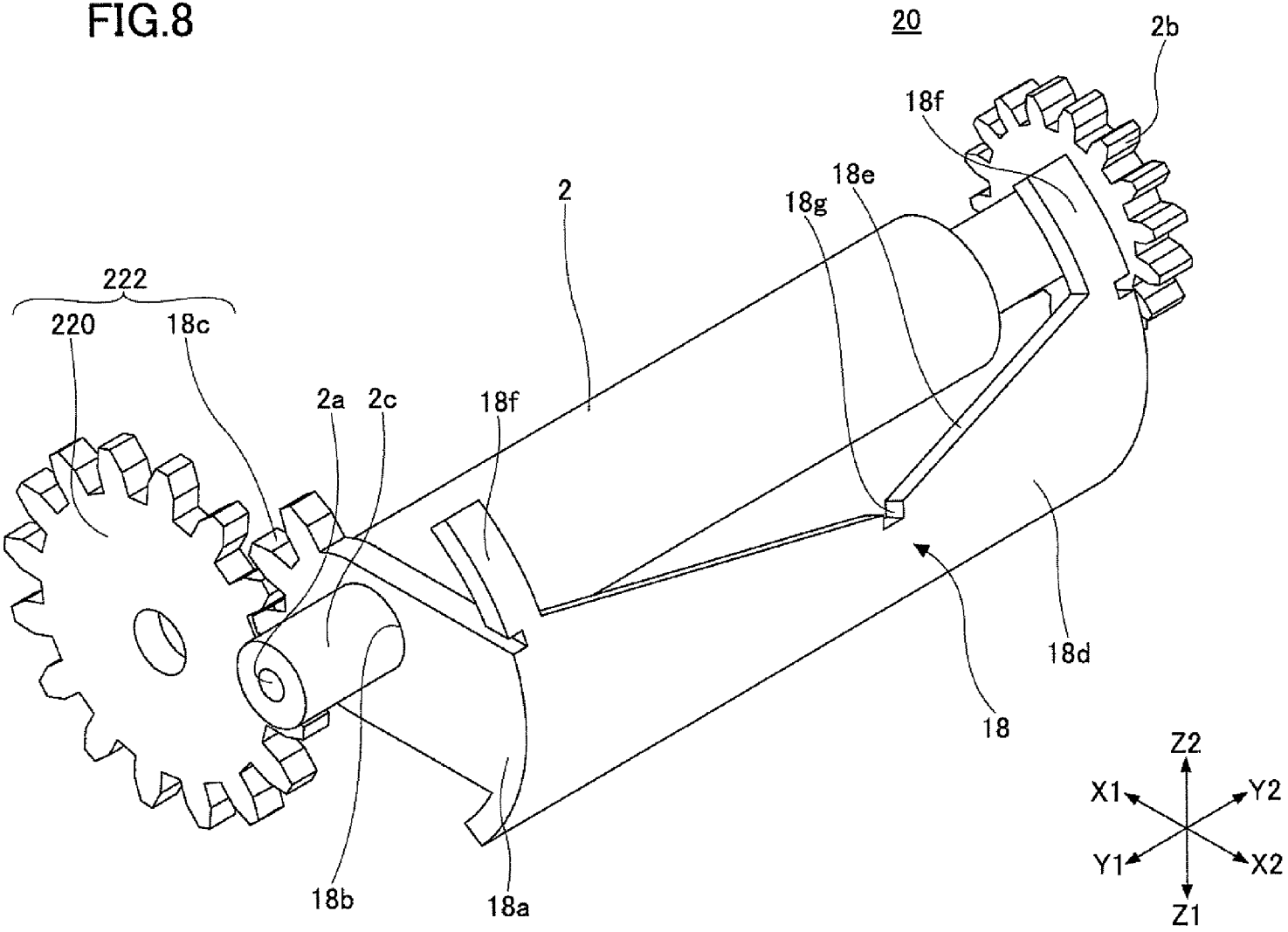
FIG. 8 is a perspective view of a movable blade unit according to the embodiment of the present invention.

A description is given of a movable blade unit 20 according to this embodiment. FIG. 8 is a perspective view of the movable blade unit 20.

The second module 300 includes the movable blade unit 20, which is indicated by a broken-line circle X in FIG. 6. The movable unit 20 includes the movable blade 18 and the platen roller 2. As described above, the movable blade 18 is not graphically illustrated in FIG. 6.

Referring to FIG. 8, the movable blade 18 includes a body part 18*d* and an arm part 18*a* provided at one end of the body part 18*d*. A through hole 18*b* for inserting (penetrating) the bearing member 2*c* of the platen roller 2 is formed in the center portion of the arm part 18*a*. The through hole 18*b* is slightly larger in diameter than the bearing member 2*c*. Accordingly, the platen rotary shaft 2*a* of the platen roller 2 is rotatably supported in the through hole 18*b*. The turning (rotation) of the movable blade 18 does not cause the platen rotary shaft 2*a* to rotate, nor does the rotation of the platen rotary shaft 2*a* cause the movable blade 18 to turn (rotate).

The movable unit 20 further includes a platen gear 2*b*. The platen roller 2 is rotated by the rotation of the platen gear 2*b*. The drive source for the rotation of the platen gear 2*b* is the motor 204 (FIG. 7A).

The movable blade 18 further includes a second gear 18*c* provided at the end of the arm part 18*a*. The second gear 18*c* engages a first gear 220 provided in the first module 200 (FIG. 6).

The first gear 220 is caused to rotate to transmit a drive force to the second gear 18*c*, so that the movable blade 18 is caused to turn along the arc α (for example, FIG. 3). That is, the recorder 100 of this embodiment includes a drive mechanism 222 for the movable blade 18, and the drive mechanism 222 includes the first gear 220 and the second gear 18*c*. In light of reducing the number of components, it is preferable that the drive mechanism 222 be formed of only the first gear 220 and the second gear 18*c*. In the case illustrated in FIG. 8, the drive mechanism 222 is provided on one end side of the movable blade 18. In the illustrated case, the drive mechanism 222 is described as including the first gear 220 and the second gear 18*c*. However, other drive mechanisms may also be employed as long as the other drive mechanisms cause the movable blade 18 to move along the arc α.

The movable blade 18 further includes a blade part 18*e* provided on the body part 18*d*. The blade part 18*e* forms the edge of the movable blade 18. The blade part 18*e* comes into contact with the paper A to cut the paper A. That is, the blade part 18*e* (edge) of the movable blade 18 comes into sliding contact with a blade part 6*a* (edge) of the fixed blade (FIG. 10) to cut the paper A. The blade part 6*a* of the fixed blade 6 and the blade part 18*e* of the movable blade 18 may be referred to as "first blade part" and "second blade part," respectively.

The movable blade 18 further includes a pair of finger parts 18*f*. The finger parts 18*f* are provided one at each end of the blade part 18*e*. In order to stably cut the paper A with the fixed blade 6 and the movable blade 18, the edge (blade part 18*e*) of the movable blade 18 has a V-letter shape. The movable blade 18 further includes a cut part 18*g* formed at the center of the blade part 18*e*, that is, at the bottom of the V-letter shape of the blade part 18*e*. The cut part 18*g* is provided to perform "partial cutting" on the paper A. The "partial cutting" refers to cutting the paper A with part of the paper A left uncut.

Further, it is preferable that the movable blade 18 or the blade part 18*e*, which is the edge of the movable blade 18 in its moving (traveling) direction, have a cross-sectional shape curving along the arc α (for example, FIG. 3). This ensures stable cutting because the movable blade 18 moves along the arc α. As an alternative, although not graphically illustrated in particular, a member curved along the arc α and having a planar blade may be caused to move along the arc α. That is, it is satisfactory if the edge of the movable blade 18 (that is, the blade part 18*e*) is caused to move in an arc.

Figure 9A:
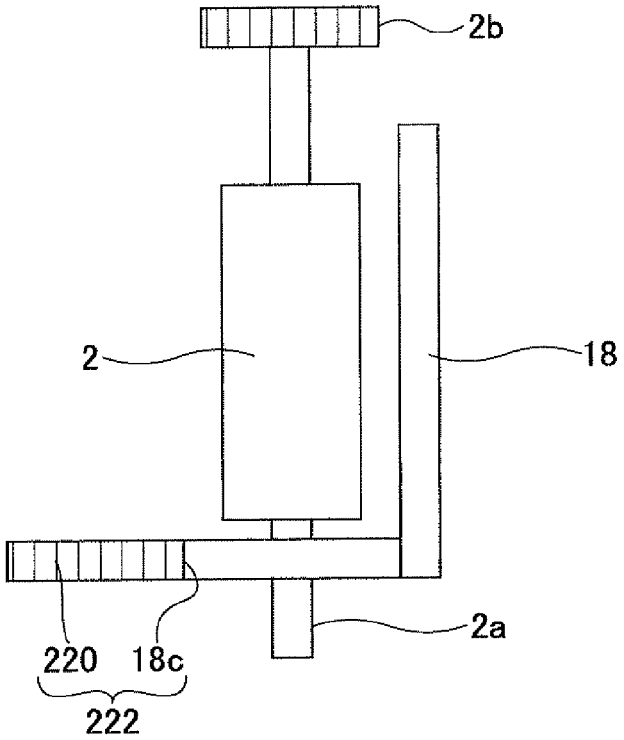
FIG. 9A is a schematic plan view of the movable blade unit of FIG. 8, where a drive mechanism is formed at one end of a movable blade, according to the embodiment of the present invention.

FIG. 9A is a schematic plan view of the configuration of FIG. 8. FIG. 9A illustrates the case where the drive mechanism 222 is formed at one end of the movable blade 18.

Figure 9B:
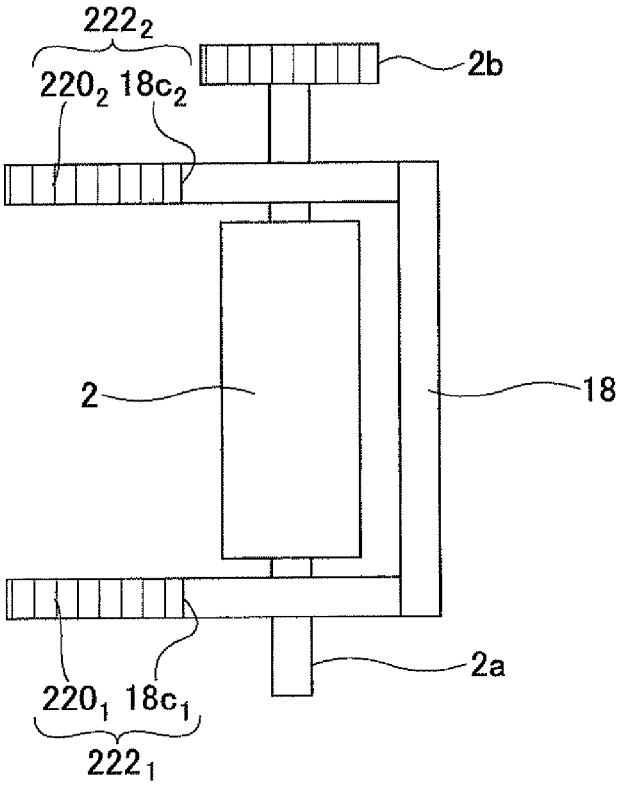
FIG. 9B is a schematic plan view of a variation of the movable blade unit of FIG. 8 where drive mechanisms are provided, one at each end of the movable blade according to the embodiment of the present invention.

FIG. 9B is a schematic plan view of a variation of the configuration of FIG. 8. FIG. 9B illustrates a case where a drive mechanism $\mathbf{222}_1$ and a drive mechanism $\mathbf{222}_2$ are provided at a first end and a second end, respectively, of the movable blade 18. Referring to FIG. 9B, the drive mechanism $\mathbf{222}_1$ includes a first gear $\mathbf{220}_1$ and a second gear $\mathbf{18}c_1$, and the drive mechanism $\mathbf{222}_2$ includes a first gear $\mathbf{220}_2$ and a second gear $\mathbf{18}c_2$. The first gear $\mathbf{220}_1$ and the first gear $\mathbf{220}_2$ are provided in the first module 200 of the recorder 100.

In the case of forming a drive mechanism at one end of the movable blade 18 as illustrated in FIG. 9A, it is possible to reduce the number of components, so that it is possible to reduce the cost of components. On the other hand, in the case of forming a drive mechanism at each end of the movable blade 18 as illustrated in FIG. 9B, it is possible to increase a force for moving the movable blade 18. Accordingly, the configuration of FIG. 9B is effective if the paper A is thick, that is, in the case of cutting thick paper.

Figure 10:
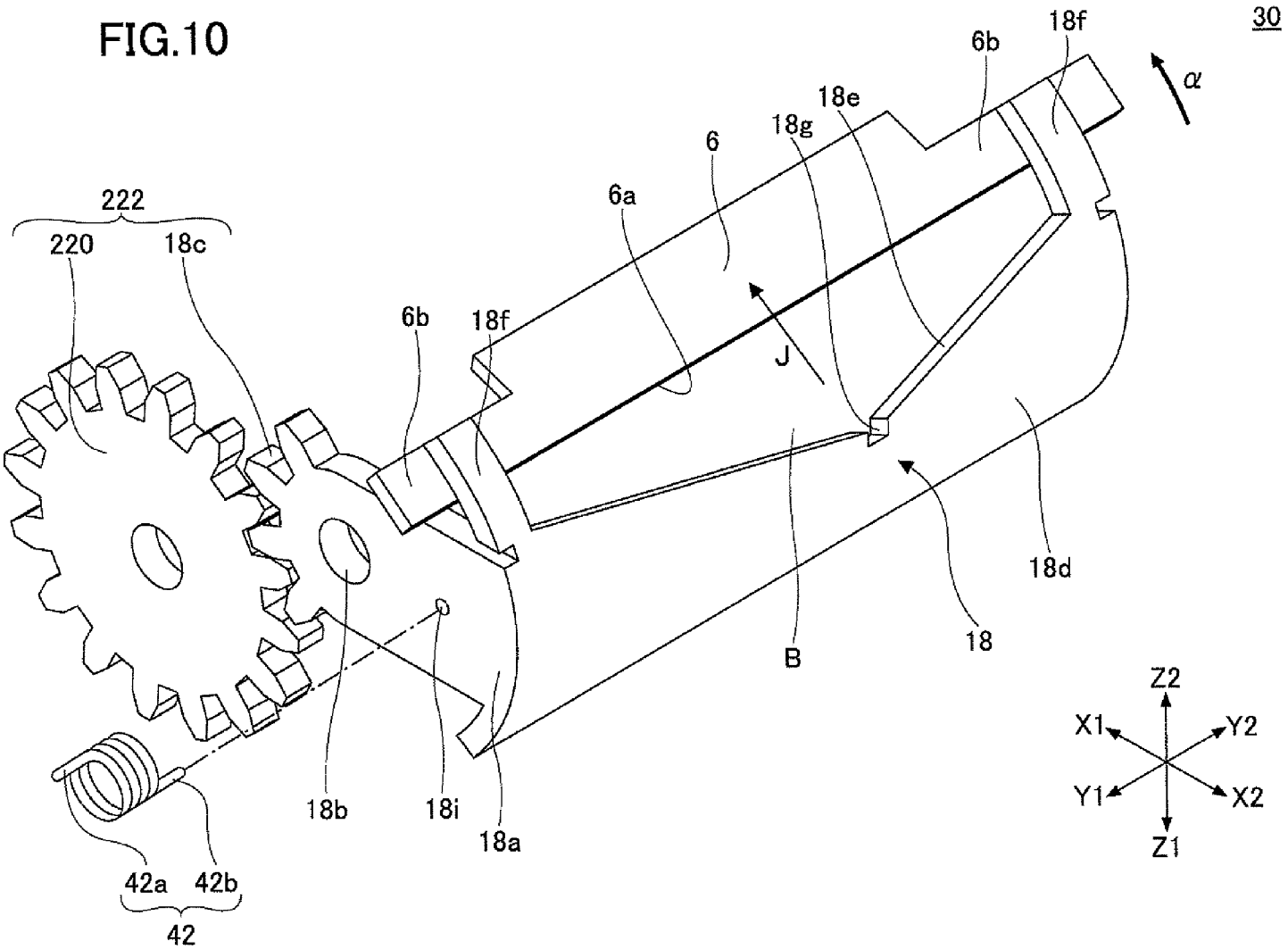
FIG. 10 is a perspective view of a cutting part according to the embodiment of the present invention.

A description is given of a cutter unit 30 according to this embodiment. FIG. 10 is a perspective view of the cutter unit 30.

The cutter of this embodiment may include the cutter unit 30. The cutter unit 30 includes the movable blade and the fixed blade 6. In FIG. 10, graphical illustration of the platen roller 2 is omitted, and the movable blade 18 and the fixed blade 6 are illustrated. In the illustrated case, the fixed blade 6 is a thin plate having a T-letter shape. The fixed blade 6 includes the blade part 6*a* (edge) and a pair of projecting parts 6*b*. In the illustrated case, the blade part 6*a* is linear (straight), and the projecting parts 6*b* are provided one at each end of the blade part 6*a* to project (extend) outward (in the Y1 and the Y2 direction).

With the first module 200 and the second module 300 being integrated, the finger parts 18*f* of the movable blade 18 are placed on the upper surfaces of the corresponding projecting parts 6*b* of the fixed blade 6. This prevents a faulty contact between the movable blade 18 and the fixed blade 6. For example, the movable blade 18 is prevented from sliding under the fixed blade 6. Further, as described above, the blade part 18*e* of the movable blade 18 has a V-letter shape and the blade part 6*a* of the fixed blade 6 is linear. Accordingly, an air gap (space) B is formed between the blade part 6*a* and the blade part 18*e*. An end portion of the paper A subjected to printing by the printing unit 50 (FIGS. 2A and 2B) is caused to project from the air gap B. When the first gear 220 is rotated, the movable blade 18 moves in the arc α, so that the sheet A is cut with the movable blade 18 and the fixed blade 6 (or the cutting part 40 illustrated in FIGS. 2A and 2B). Further, as illustrated in FIG. 10, the edge (blade part 18*e*) of the movable blade 18 comes into sliding contact with the edge (blade part 6*a*) of the fixed blade 6 to move in an arc in a direction J perpendicular to (the longitudinal directions of) the blade part 6*a* of the fixed blade 6. In other words, the blade part 18*e* of the movable blade 18 moves in an arc in the direction J perpendicular to a cross section of the fixed blade 6 taken along a plane parallel to the longitudinal and the thickness directions of the fixed blade 6. That the blade part 18*e* of the movable blade 18 comes into sliding contact with the blade part 6*a* of the fixed blade 6 means that the blade part 18*e* of the movable blade 18 slides on the blade part 6*a* of the fixed blade 6.

Further, according to the configurations of FIGS. 4A and 4C, the blade part 6*a* of the fixed blade 6 is positioned inside the blade part 18*e* of the movable blade 18 when the paper A is cut in the cutting part 40. Further, according to the configurations of FIGS. 4B and 4D, the blade part 6*a* of the fixed blade 6 is positioned outside the blade part 18*e* of the movable blade 18 when the paper A is cut in the cutting part 40.

Further, a blade pressure is caused (generated) between the movable blade 18 and the fixed blade 6. For example, according to the technique of Japanese Laid-Open Patent Application No. 2005-271204, when a blade pressure is generated at the fixed blade in a direction toward the movable blade, it is necessary to hold the movable blade with a holding member so as to prevent the movable blade from being displaced or caused to deviate by the blade pressure. However, by passing the platen rotary shaft 2*a* (the bearing member 2*c*) through the arm part 18*a* of the movable blade 18 as illustrated in FIG. 8, the movable blade 18 is prevented from being displaced or caused to deviate without providing a holding member even in the case of a large blade pressure. Accordingly, it is possible to reduce the cost and the size of the cutter.

Further, by forming the drive mechanism 222 of the first gear 220 and the second gear 18*c* of the arm part 18*a* as described above, it is possible to reduce the number of components and, accordingly, the cost and the size of the cutter, compared with the technique of Japanese Laid-Open Patent Application No. 2005-271204.

Further, it is preferable that the movable blade 18 be moved to a position where the blade part 18*e* of the movable blade 18 is not exposed outside in the second module 300 when the first module 200 and the second module 300 are separated. This is for the following reason. When the first module 200 and the second module 300 are separated, the lid of the recorder 100 is open as described above. If the blade part 18*e* of the movable blade 18 is exposed outside in this state, this is a problem to the safety of users. Accordingly, when the first module 200 and the second module 300 are separated, the movable blade 18 is moved to a position where the blade part 18*e* of the movable blade 18 is not exposed outside. In the following, the position where the blade part 18*e* of the movable blade 18 is not exposed outside is referred to as the initial position of the movable blade 18.

Further, when the first module 200 and the second module 300 are integrated, the cutting part 40 is formed. For example, the formation of the cutting part 40 refers to the placement of the finger parts 18*f* on the upper surfaces of the corresponding projecting parts 6*b* with a blade pressure being generated between the movable blade 18 and the fixed blade 6 as illustrated in FIG. 10. However, forming the cutting part 40 with the movable blade 18 being in the initial position causes the stroke of the movable blade 18 to be longer for the cutting part 40 to enter the post-cutting state (FIG. 2B), thus increasing time for cutting the paper A.

Therefore, the movable blade 18 may be moved a predetermined amount (distance) in the arc α from the initial position while ensuring (securing) the air gap B where the paper A is caused to project. This reduces the stroke of the movable blade 18 against the fixed blade 6, thus making it possible to reduce time for cutting the paper A. In the following, the position to which the movable blade 18 is moved a predetermined amount (distance) (from the initial position) is referred to as "home position." That is, the home position refers to the position of the movable blade 18 that forms the air gap B where the paper A is caused to project between the movable blade 18 and the fixed blade 6 and minimizes the stroke of the movable blade 18 to cause the cutting part 40 to enter the post-cutting state. The state of the cutting part 40 formed with the movable blade 18 in the home position is the above-described pre-cutting state.

Next, a description is given of a return part 42 illustrated in FIG. 10. The return part 42 causes the movable blade 18 to return to the home position or the initial position when the blade pressure between the movable blade 18 and the fixed blade 6 is reduced by a predetermined amount. For example, in the case of the recorder 100, when the first module 200 and the second module 300 are separated, the fixed blade 6 and the movable blade 18 are also separated, so that the blade pressure becomes zero. In this case, the movable blade 18 automatically returns (moves) to the initial position with the return part 42.

Further, a jam (a paper jam at the cutting part 40) may occur in the inseparable recorder (a recorder not divided into the first module 200 and the second module 300) or the recorder 100. In the case of occurrence of a jam, the blade pressure is reduced by a blade pressure reduction part (not graphically illustrated), which is, for example, a member for pressing down the fixed blade.

In the recorder 100, when the blade pressure is reduced by the blade pressure reduction part by a predetermined position, the movable blade 18 may be caused to return to the home position by the return part 42.

Next, a description is given of a configuration of the return part 42.

For example, a coil spring may be used for the return part 42 as illustrated in FIG. 10. The coil spring has one end 42*a* fixed to a predetermined position in the first module 200 (for example, the inner wall of the first module 200) and has another end 42*b* fixed to the arm part 18*a* of the movable blade 18. In the case of FIG. 10, a through hole 18*i* is provided in the arm part 18*a*, and the end 42*b* is passed through and fixed to the through hole 18*i*.

The return part 42 urges the movable blade 18 in a direction to return the movable blade 18 to the home position or the initial position (in a direction away from the fixed blade 6). First, a description is given of the case where the return part 42 urges the movable blade 18 so as to return the movable blade 18 to the home position. In this case, the drive mechanism 222 causes the movable blade 18 to move to cut the paper A against the urging of the return part 42. For example, if a jam occurs when the movable blade 18 is in the middle of cutting the paper A (that is, in the state between the pre-cutting state and the post-cutting state), the blade pressure is reduced by the blade pressure reduction part. As a result of this reduction, the movable blade 18 is caused to return to the home position by the urging of the return part 42, thereby escaping from the jam.

Next, a description is given of the case where the return part 42 urges the movable blade 18 to return the movable blade 18 to the initial position. In this case, the drive mechanism 222 causes the movable blade 18 to move against the urging of the return part 42. When the second module 300 is separated from the first module 200, the blade pressure between the movable blade 18 and the fixed blade 6 becomes zero. Accordingly, the movable blade 18 is caused to return to the initial position by the urging of the return part 42.

Figure 11:
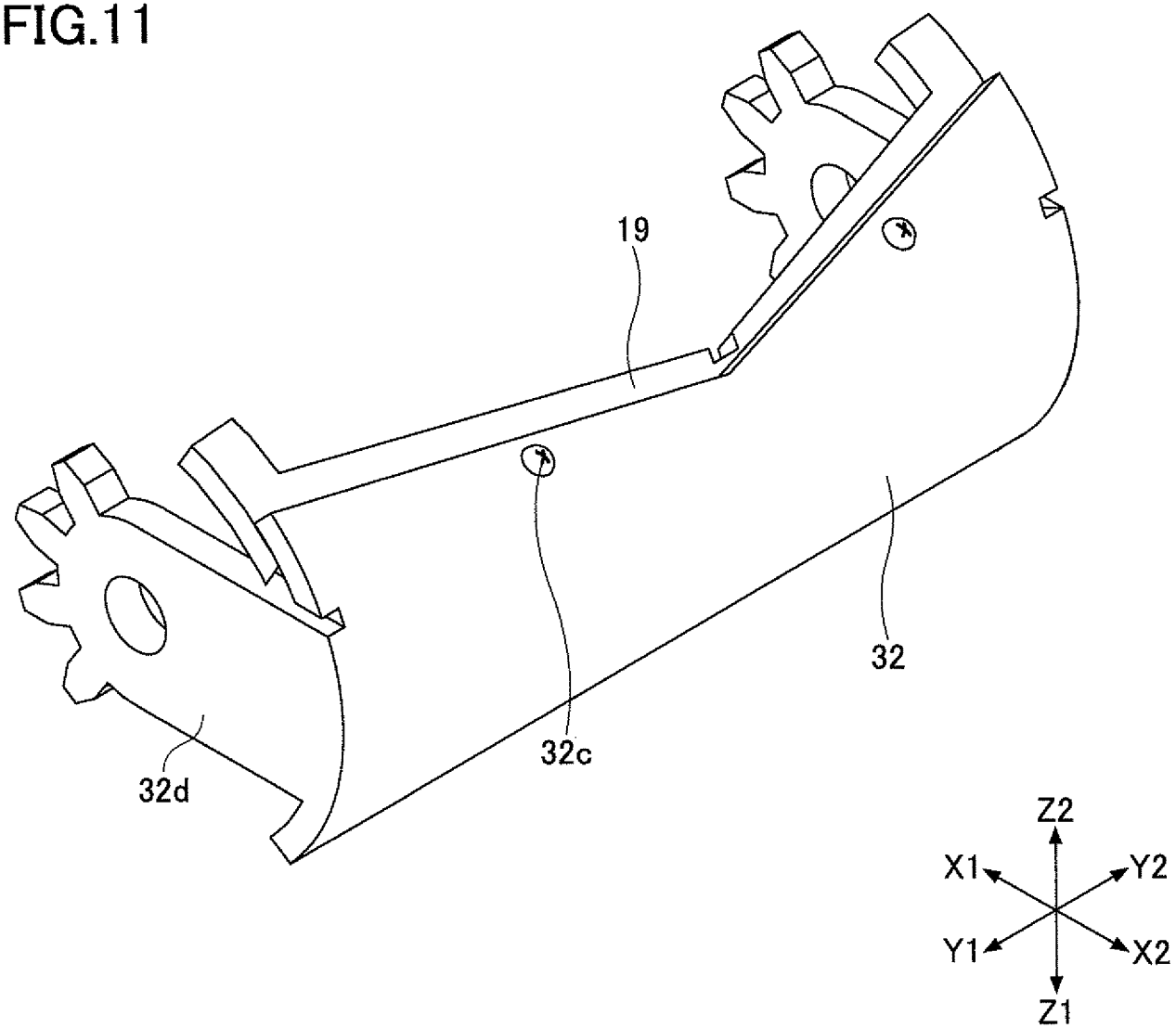
FIG. 11 is a perspective view of a variation of the movable blade according to the embodiment of the present invention.

FIG. 11 illustrates a variation of the movable blade 18.

As illustrated in FIG. 11, a movable blade 19 may be mounted on a mounting base 32. In the case of this variation, it is possible to reduce the moving distance of the movable blade 19 in the direction of the arc α. Accordingly, the movable blade 19 is reduced in cost. Further, it is preferable to detachably attach the movable blade 19 to the mounting base 32. This is because only the movable blade 19 may be replaced when the movable blade 19 has worn out and needs replacing, thus reducing replacement cost. In the case illustrated in FIG. 11, the movable blade 19 is detachably fixed to the mounting base 32 with the screws 32*c*. Further, the mounting base 32 includes a pair of arm parts 32*d* one at each end of the mounting base 32. The arm parts 32*d* are equal in shape to the arm parts 18*a* illustrated in FIG. 8. Accordingly, the mounting base 32 with the movable blade 19 attached has substantially the same shape as the movable blade 18 illustrated in FIG. 8.

Further, the mounting base 32 may have an arc shape along the arc α with the movable blade 19 having either a flat shape or an arc shape along the arc α.

Figure 12:
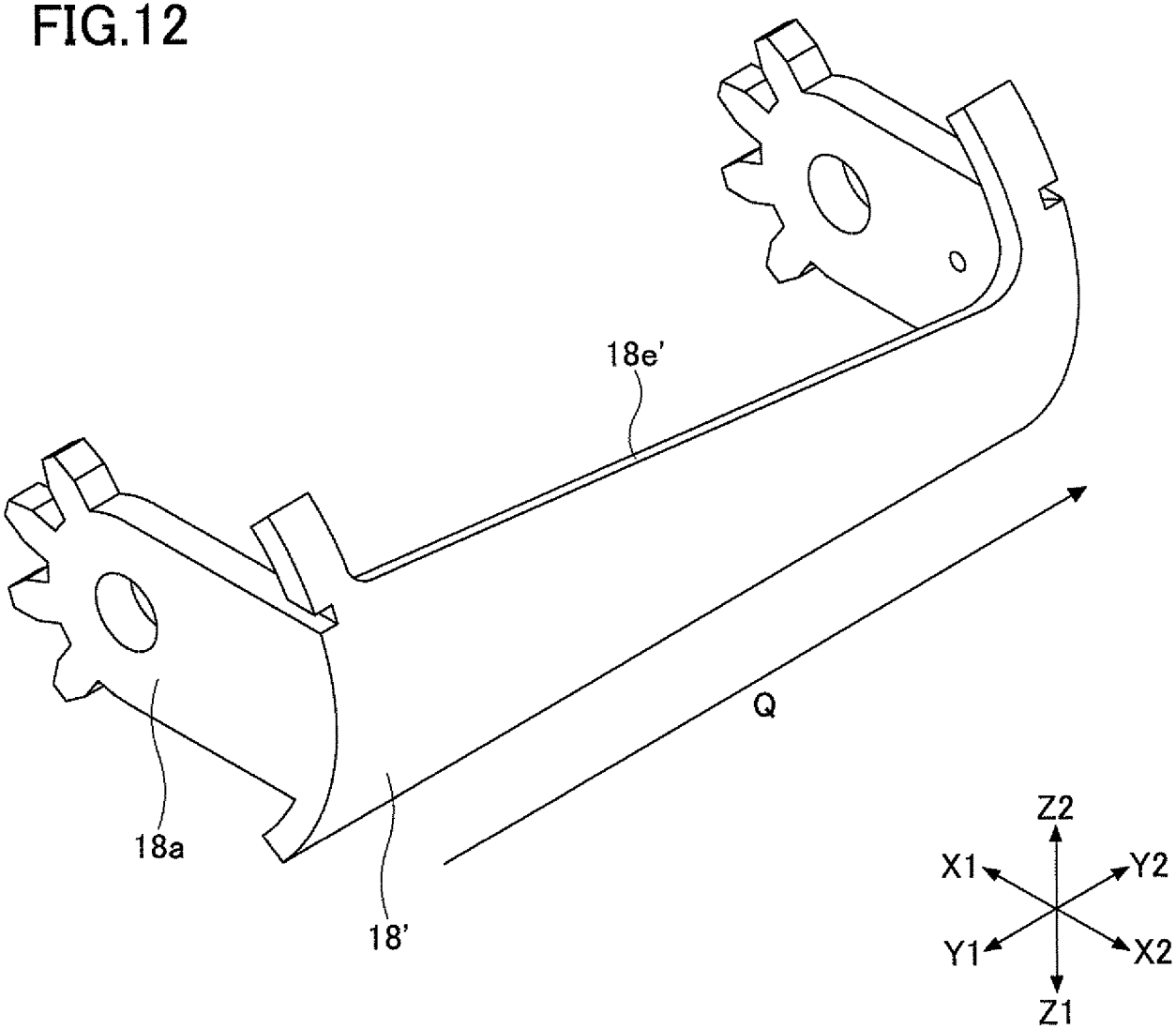
FIG. 12 is a perspective view of another variation of the movable blade according to the embodiment of the present invention.

FIG. 12 is a perspective view of a movable blade 18', which is another variation of the movable blade 18. The movable blade 18 illustrated in FIG. 8 has a V-shaped edge, while a blade part (edge) 18*e'* of the movable blade 18' is inclined in a widthwise direction indicated by arrow Q (in the Y2 direction). An air gap (not graphically illustrated) is also formed between the fixed blade 6 and the movable blade 18'. Accordingly, it is possible to stably cut the paper A with this movable blade 18' as well.

Figure 13:
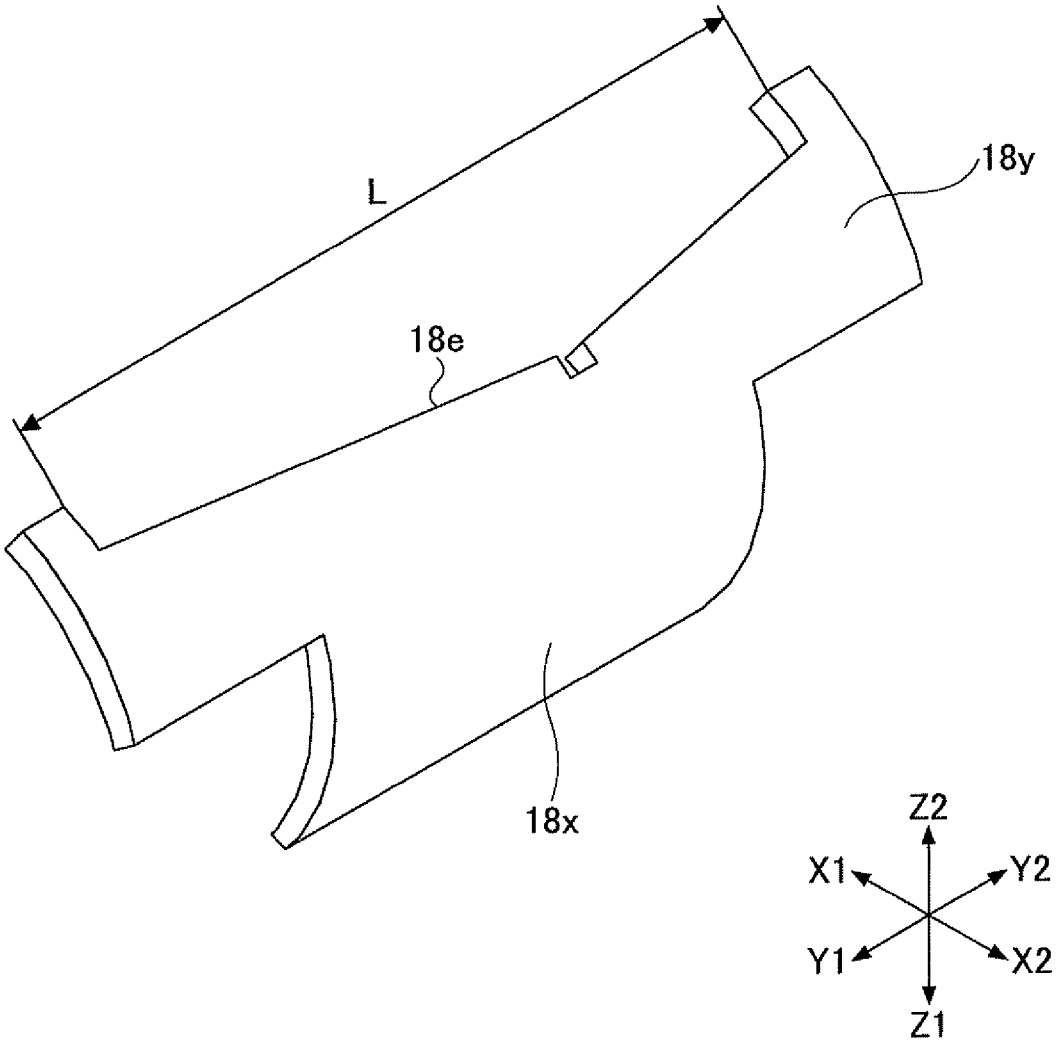
FIG. 13 is a perspective view of yet another variation of the movable blade according to the embodiment of the present invention.

FIG. 13 illustrates another variation of the movable blade 18. Preferably, the blade part (edge) 18*e* of the movable blade 18 has a width indicated by double-headed arrow L greater than the width (or a dimension in the longitudinal directions of the platen rotary shaft 2*a*) of the paper A (FIG. 6). This shape of the movable blade 18 makes it possible to cut the paper A completely to its sides in the widthwise directions (the Y1 and the Y2 direction). For example, the movable blade 18 includes a base part 18*x* and a wide part 18*y* wider than the base part 18*x*. The blade part 18*e* is formed at the end of the wide part 18*y*. The movable blade 18 illustrated in FIG. 13 has a substantial T-letter shape in a plan view.

In the following, it is assumed that a blade pressure generation part generates a blade pressure between the movable blade 18 and the fixed blade 6. The blade pressure generated at the fixed blade 6 in the direction toward the movable blade 18 by the blade pressure generation part is referred to as "fixed-blade blade pressure." The blade pressure generated at the movable blade 18 in the direction toward the fixed blade 6 by the blade pressure generation part is referred to as "movable-blade blade pressure." That is, the blade pressure generation part generates at least one of the movable-blade blade pressure and the fixed-blade blade pressure.

Figure 14:
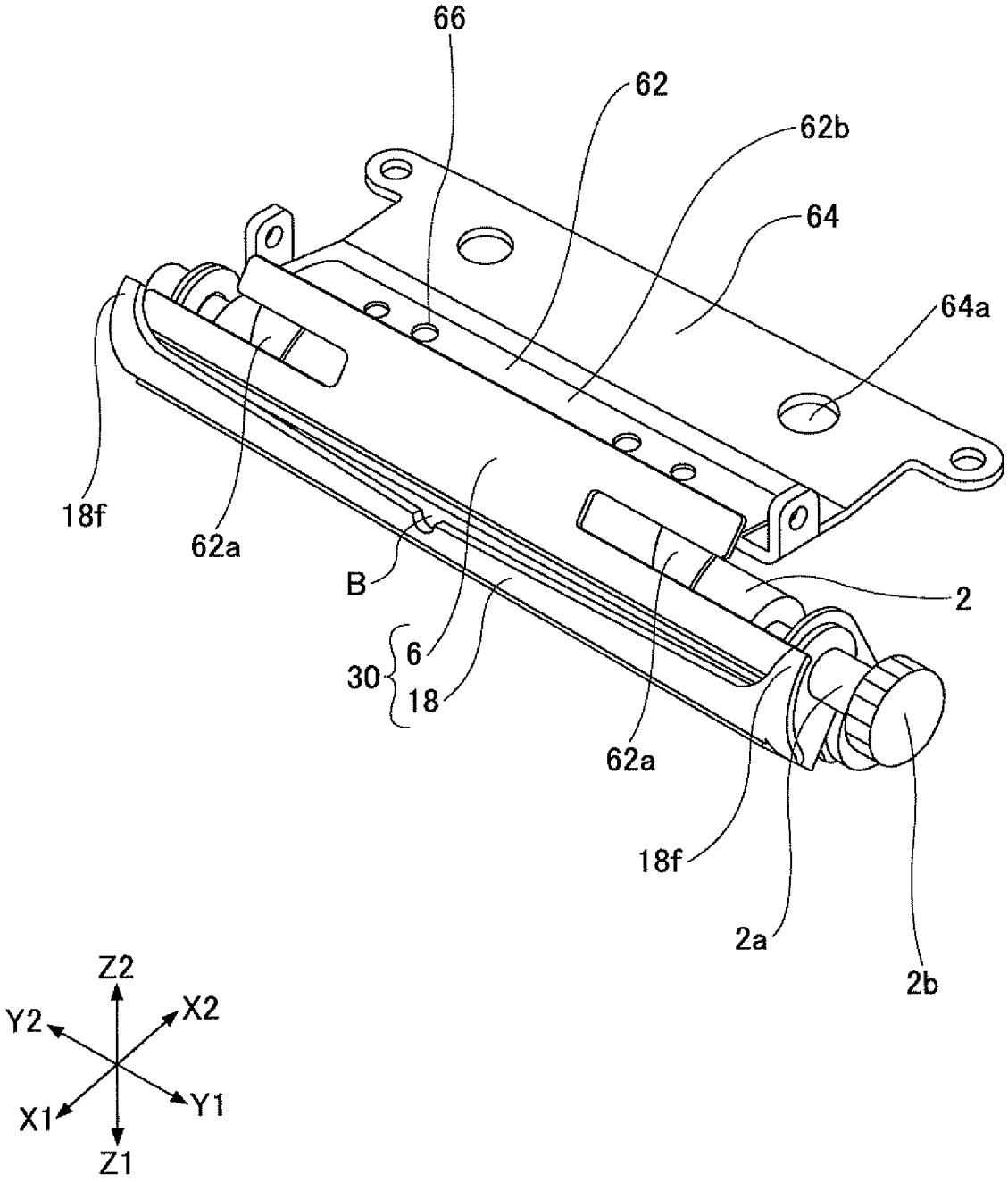
FIG. 14 is a perspective view of a configuration including a cutter unit and the platen roller according to the embodiment of the present invention.

FIG. 14 is a perspective view of a configuration including the cutter unit 30 and the platen roller 2.

In the case illustrated in FIG. 14, a fixed blade spring 62 is provided as the blade pressure generation part. The fixed blade spring 62 includes a pair of finger parts 62*a* and a base part 62*b*. The finger parts 62*b* are provided one at each end of the base part 62*b*. The finger parts 62*a* are in contact with the fixed blade 6 to urge the fixed blade 6 in the direction toward the movable blade 18. A blade pressure is generated between the movable blade 18 and the fixed blade 6 by the fixed blade spring 62 urging the fixed blade 6 toward the movable blade 18. That is, the fixed blade spring (the blade pressure generation part) generates the fixed-blade blade pressure.

The fixed blade spring 62 is held by a spring holding member 64. For example, the base part 62*b* of the fixed blade spring 62 is held by the spring holding member 64. While there are a variety of holding methods, in this case, multiple screw holes 66 may be formed in the base part 62*b* so that the base part 62*b* is held by the spring holding member 64 with screws inserted into the screw holes 66. Further, the spring holding member 64 includes multiple (for example, two) through holes 64*a*. The spring holding member 64 is attached to a support member 70 (FIG. 16) such as the inner wall of the first module 200. Further, the fixed blade spring 62 may be held by, for example, the inner wall of the first module 200 instead of being held by the spring holding member 64.

Figure 15:
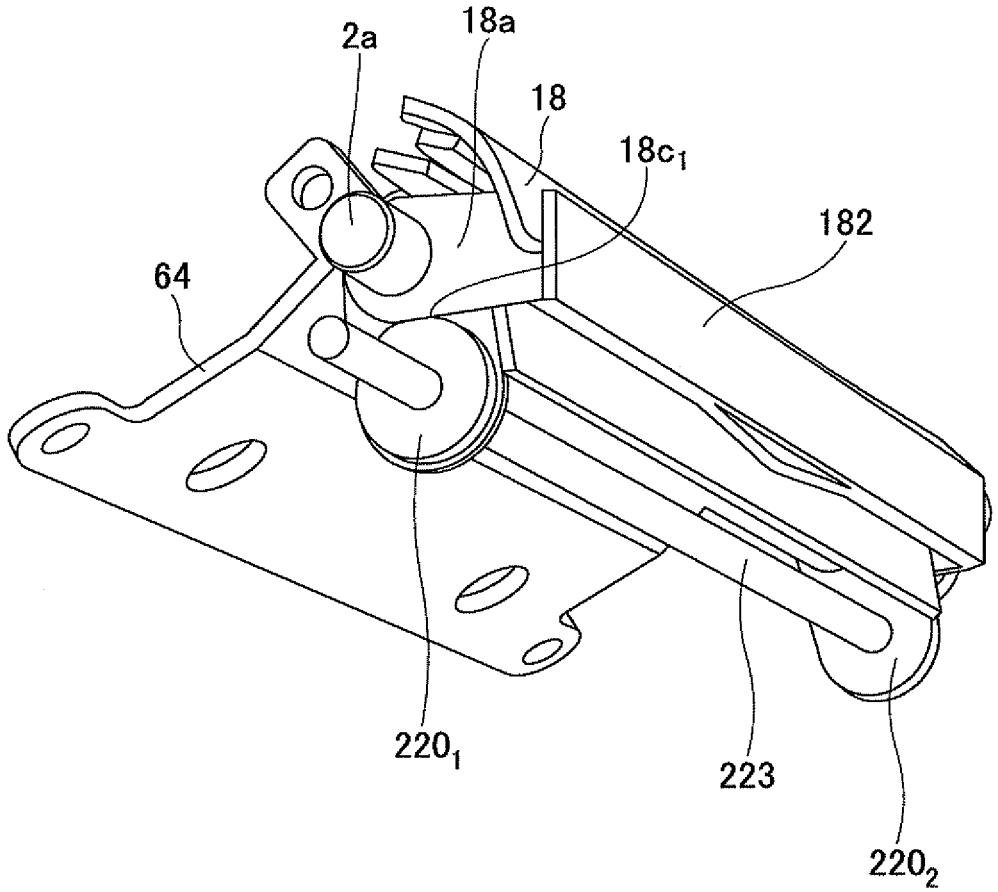
FIG. 15 is a perspective view of the configuration of FIG. 14, taken from a different angle, according to the embodiment of the present invention.

FIG. 15 is a perspective view of the configuration of FIG. 14, taken from a different angle. The movable blade 18 is supported by a movable blade support plate 182 so as to prevent its displacement or deviation. FIG. 15 illustrates a case where the first gears $\mathbf{220}_1$ and $\mathbf{220}_2$ are provided (that is, the drive mechanisms $\mathbf{222}_1$ and $\mathbf{222}_2$ [FIG. 9B] are provided) one at each longitudinal end of the movable blade 18. The first gears $\mathbf{220}_1$ and $\mathbf{220}_2$ are connected by a gear shaft 223. In FIG. 15, a graphical representation of the teeth of the first gears $\mathbf{220}_1$ and $\mathbf{220}_2$ and the second gears $\mathbf{18}c_1$ and $\mathbf{18}c_2$ is omitted.

Figure 16:
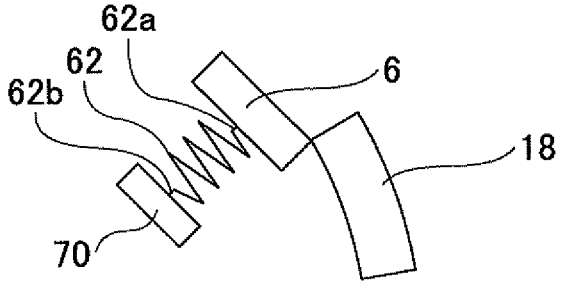
FIG. 16 is a schematic plan view of the configuration illustrated in FIG. 14 and FIG. 15 according to the embodiment of the present invention.

FIG. 16 is a schematic plan view of the configuration illustrated in FIG. 14 and FIG. 15. For simplification, a graphical representation of the spring holding member 64 is omitted in FIG. 16.

Referring to FIG. 16, one end of the fixed blade spring 62 (the finger parts 62*a*) is in press contact with the fixed blade 6. On the other hand, the other end of the fixed blade spring 62 (the base part 62*b*), that is, the spring holding member 64, is attached to the support member 70. In this case, if the fixed-blade blade pressure is to be increased in order to increase the cutting force of the cutting part 40, it is necessary to increase the elastic force of the fixed blade spring 62. For this, it is necessary to increase the thickness of the support member 70, which results in an increase in the size of the cutter.

Accordingly, a description is given of a fixed blade spring 620 that increases the fixed-blade blade pressure without an increase in the thickness of the support member 70. It is preferable to use the fixed blade spring 620 in configurations where the blade part 6*a* of the fixed blade 6 is positioned inside the blade part 18*e* of the movable blade 18 when cutting the paper A in the cutting part 40 (FIGS. 4A and 4C). The fixed blade spring 620 as a whole has elasticity, and is used as the blade pressure generation part that generates the fixed-blade blade pressure.

Figure 17:
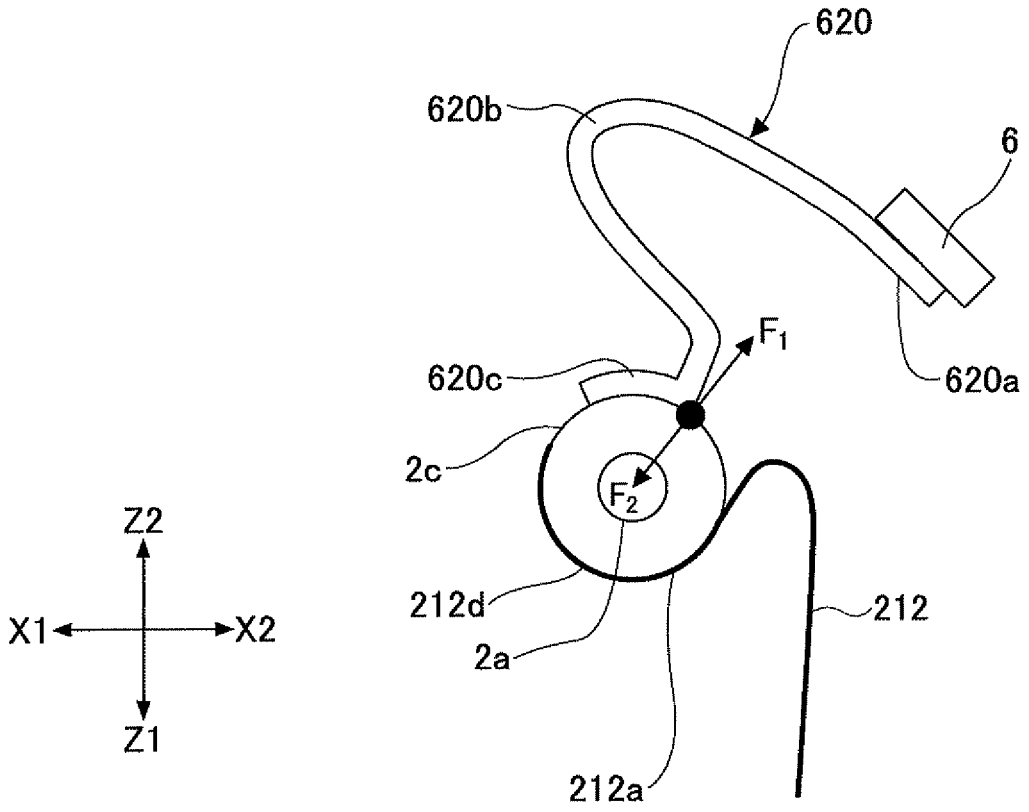
FIG. 17 is a side view of a fixed blade spring according to the embodiment of the present invention.
Figure 18:
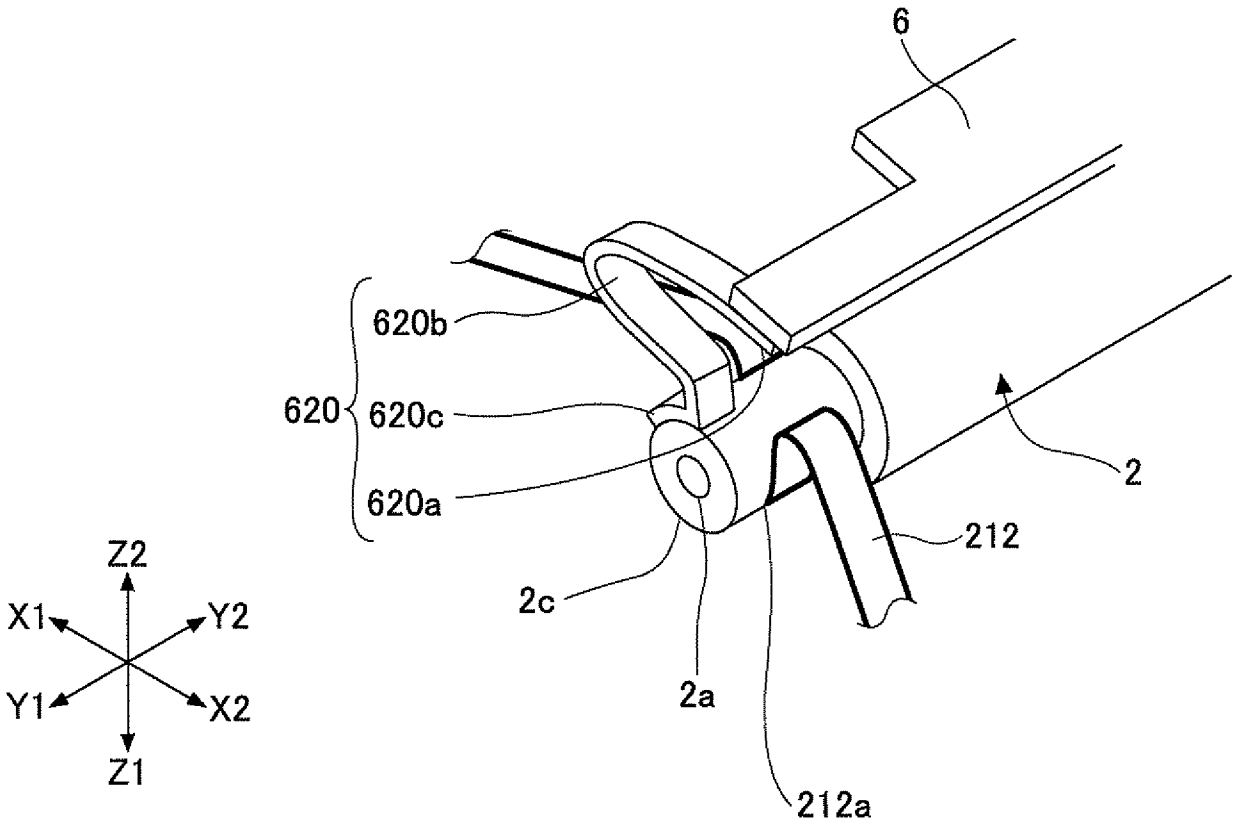
FIG. 18 is a perspective view of the fixed blade spring according to the embodiment of the present invention.

FIG. 17 and FIG. 18 are a side view and a perspective view, respectively, of the fixed blade spring 620. In the illustrated case, it is assumed that a pair of (two) narrow fixed blade springs 620 are attached one to each end of the bearing member 2*c*. In FIG. 17 and FIG. 18, only one end of the bearing member 2*c* is illustrated, but the narrow fixed blade spring 620 is also attached to the other end of the bearing member 2*c*.

Referring to FIG. 17 and FIG. 18, the fixed blade spring 620 has a flat part 620*a* at one end and a curved part 620*c* at the other end. The fixed blade spring 620 includes a bent part 620*b* between the flat part 620*a* and the curved part 620*c*. The fixed blade 6 is placed on the flat part 620*a*. The curved part 620*c* is curved along the bearing member 2*c* so as to be in contact with the bearing member 2*c*, which serves as the support member 70. The fixed blade 6 is placed on the flat parts 620*a* of the two fixed blade springs 620.

Referring to FIG. 18, the U-shaped shaft support member 212 and the fixed blade spring 620 are disposed in this order from the platen roller 2 side. The shaft support member 212 is formed with such rigidity as to sustain a pressure from the thermal head 4. Accordingly, increasing the resilience of the fixed blade spring 620 to increase the fixed-blade blade pressure does not necessitate an increase in the thickness of the shaft support member 212. Accordingly, increasing the fixed-blade blade pressure does not necessitate an increase in the thickness of the support member 70. That is, the bearing member 2*c* and the movable blade 18 mounted on the bearing member 2*c* (FIG. 8) cancel out an urging force $F_1$ (FIG. 17) to urge the fixed blade 6 toward the movable blade 18 side and a pressing force $F_2$ (FIG. 17) (a repulsive force) to press the platen rotary shaft 2*a*.

When the first module 200 and the second module 300 are integrated, the elasticity of the fixed blade spring 620 allows the bearing member 2*c* to push aside the curved part 620*c* to fit into the shaft support member 212.

Further, the fixed blade spring 620 further serves to hold the bearing member 2*c* to the bottommost part 212*d* (FIG. 7B). This pressing by the fixed blade spring 620 prevents the bearing member 2*c* from coming easily off the bottommost part 212*d* of the shaft support member 212.

Further, it is preferable to cause the platen rotary shaft 2*a* to pass through the center O of the arc α (the circle β) (FIG. 3) using the fixed blade spring 620 because this facilitates the positioning of the movable blade 18 and the fixed blade 6.

A description is given above of the case of causing a blade pressure (fixed-blade blade pressure) to be generated at the fixed blade 6 in the direction toward the movable blade 18. Next, a description is given of the case of causing a blade pressure (movable-blade blade pressure) to be generated at the movable blade 18 in the direction toward the fixed blade 6.

Figure 19:
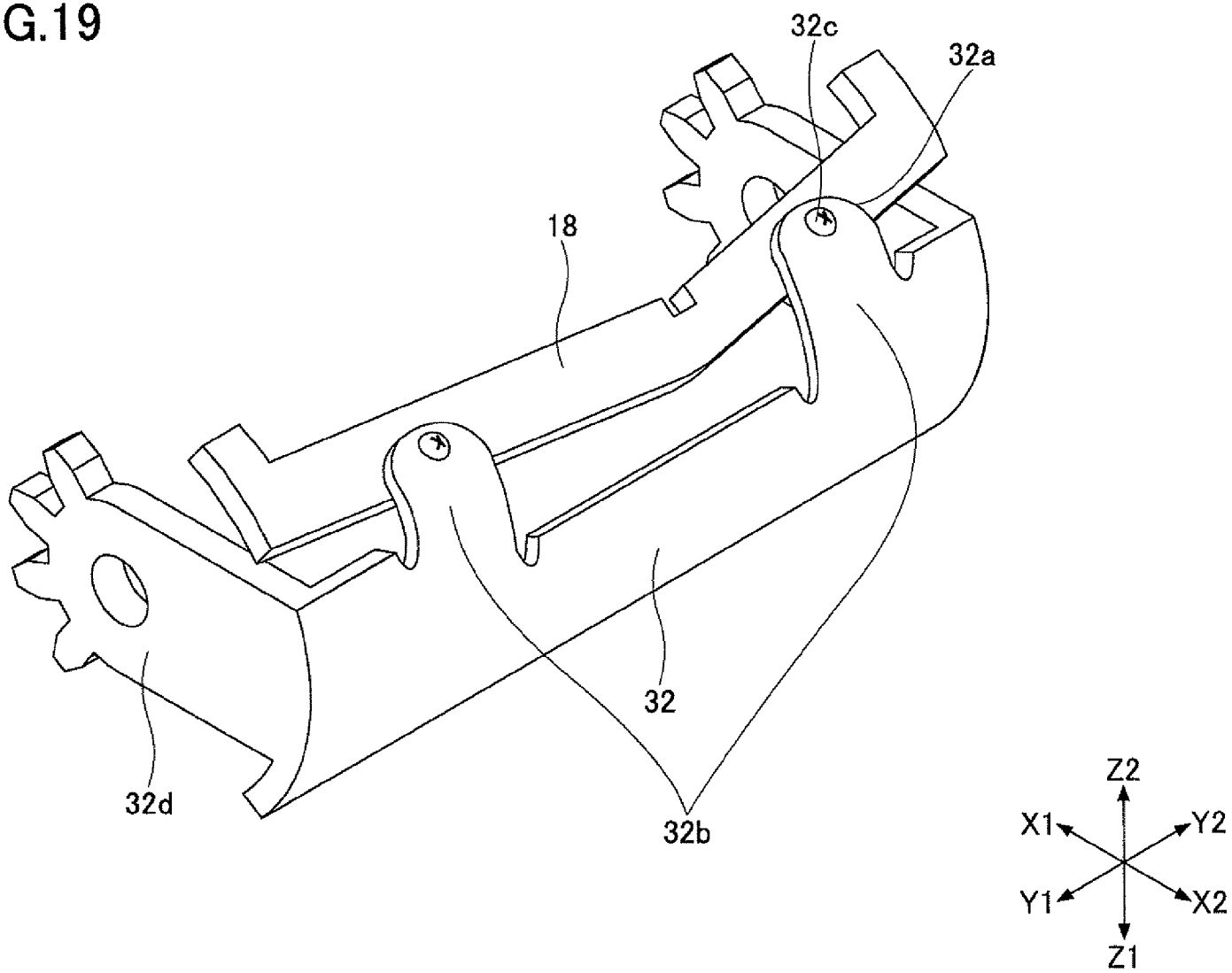
FIG. 19 is a perspective view of yet another variation of the movable blade according to the embodiment of the present invention.

FIG. 19 is a perspective view of an arrangement for causing the movable-blade blade pressure to be generated at the movable blade 18. In this arrangement, the mounting base 32 (FIG. 11) for mounting the movable blade 18 includes a pair of movable blade pressurizing springs 32*b* shaped like tongue pieces as the blade pressure generation part. The movable blade pressurizing springs 32*b* have elasticity. The movable blade 18 is attached and fixed to the end portions of the two movable blade pressurizing springs 32*b*. In the illustrated case, the movable blade 18 is fixed to the two movable blade pressurizing springs 32*b* with the screws 32*c*. The movable blade pressurizing springs 32*b* urge the movable blade 18 in the direction toward the fixed blade 6, so that it is possible to generate the movable-blade blade pressure.

Further, both the movable-blade blade pressure and the fixed-blade blade pressure may be generated. In this case, it is possible to increase the blade pressure, so that it is possible to cut thick paper.

Next, a description is given of the printing unit 50 (FIGS. 2A and 2B).

Figure 20:
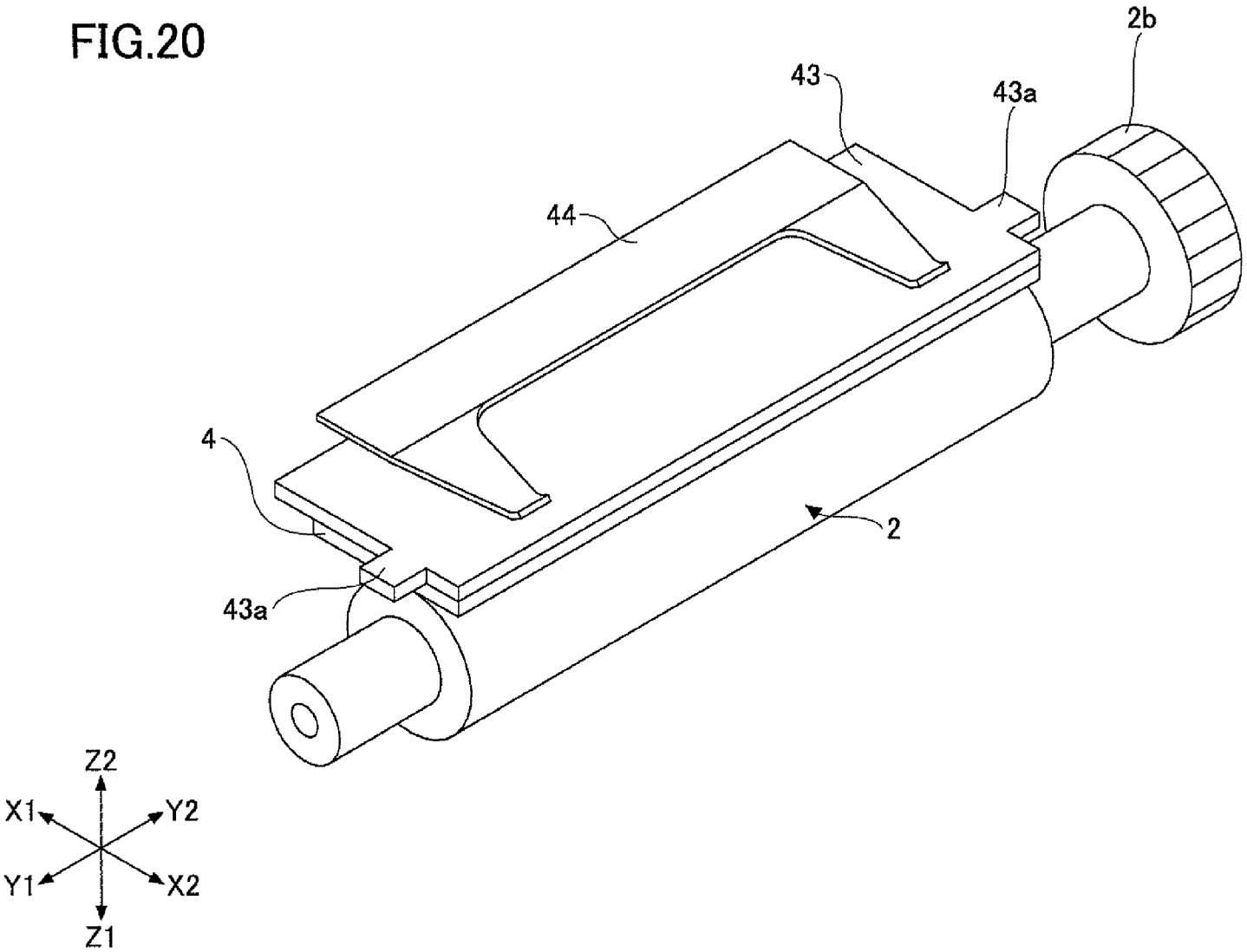
FIG. 20 is a perspective view of a printing unit according to the embodiment of the present invention.
Figure 21:
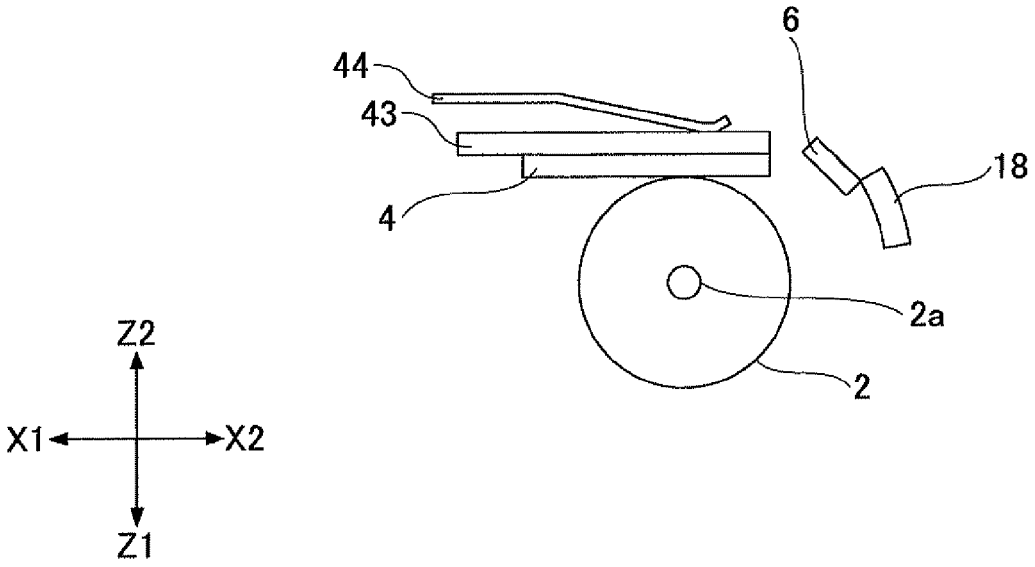
FIG. 21 is a schematic side view of the printing unit of FIG. 20 according to the embodiment of the present invention.

FIG. 20 is a perspective view of the printing unit 50. FIG. 21 is a schematic side view of the printing unit 50.

The printing unit 50 includes the platen roller 2 and the thermal head 4 as schematically illustrated in FIGS. 2A and 2B. In FIG. 20, a graphical representation of the fixed blade 6 and the movable blade 18 is omitted. The thermal head 4 is held by a head holding member 43. In the illustrated case, the head holding member 43 has a flat plate shape, and has projecting parts 43*a* formed one at each of its longitudinal (Y1 and Y2) ends to project (extend) outward. Further, the head holding member 43 also serves as a heat sink (a heat radiation member) to radiate heat from the thermal head 4. Further, the projecting parts 43*a* engage corresponding recesses (not graphically illustrated) in the first module 200 so that the head holding member 43 to which the thermal head 4 is attached is held.

A head pressurizing spring 44 is attached on a side of the head holding member 43 which side is opposite to the side on which the thermal head 4 is attached. The head pressurizing spring 44 urges the thermal head 4 against the platen roller 2 through the head holding member 43, thereby causing the thermal head 4 to be in press contact with the platen roller 2. This press contact force is determined to be such a value as to allow the platen roller 2 to rotate.

Figure 22:
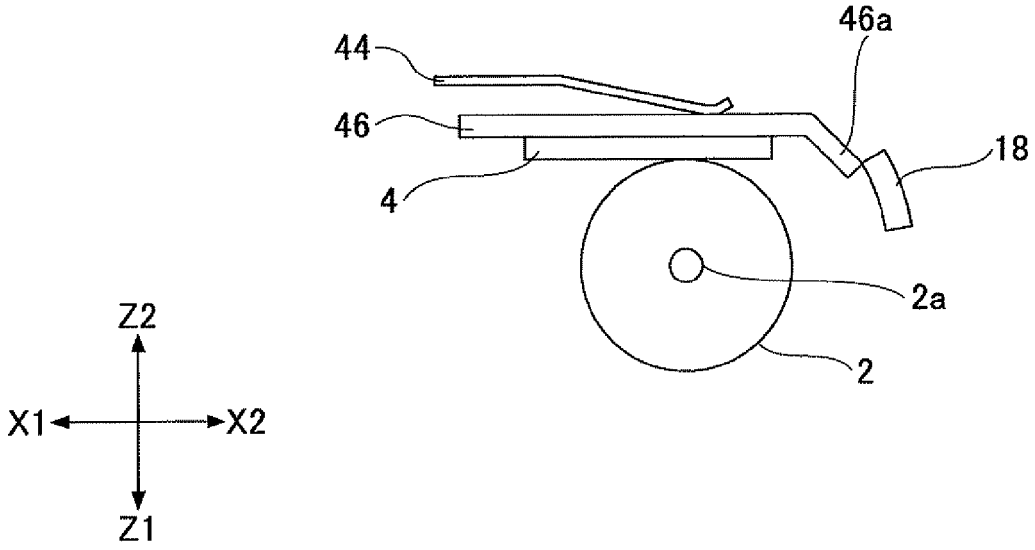
FIG. 22 is a diagram illustrating a variation of an arrangement of FIG. 21 according to the embodiment of the present invention.

FIG. 22 is a diagram illustrating a variation of the arrangement (configuration) illustrated in FIG. 21. In the arrangement of FIG. 22, the number of components is reduced compared with the arrangement of FIG. 21. In the case illustrated in FIG. 21, the fixed blade 6 and the head holding member 43 are provided separately. On the other hand, in the case of FIG. 22, an end portion 46*a* of a head holding member 46 is turned into the fixed blade 6. That is, the head holding member 46 integrates the function of the head holding member 43 and the function of the fixed blade 6. This configuration makes it possible to reduce the number of components compared with the case illustrated in FIG. 21.

Figure 23:
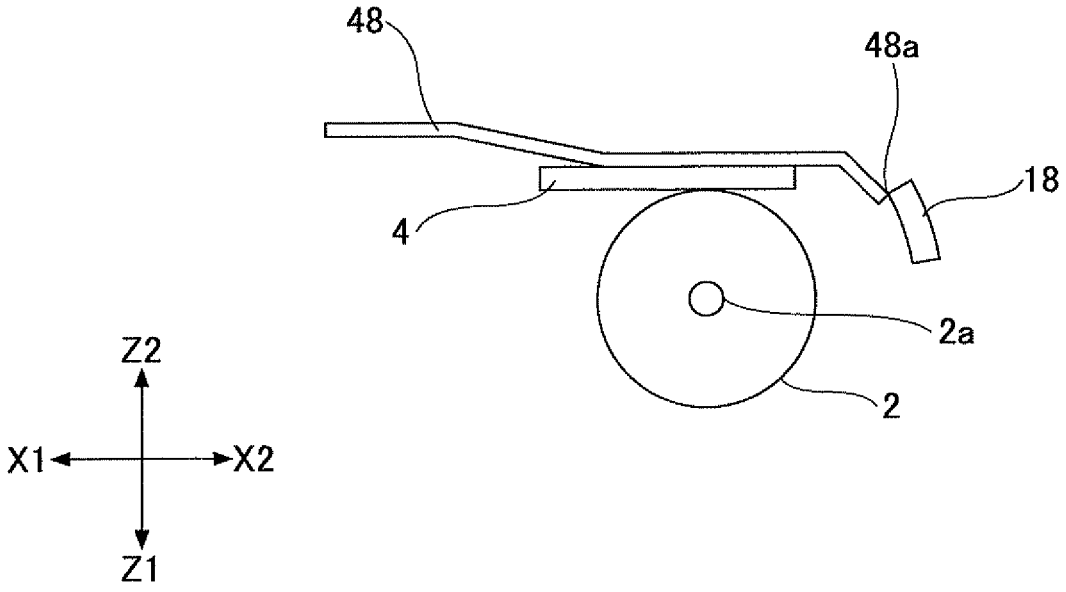
FIG. 23 is a diagram illustrating another variation of the arrangement of FIG. 21 according to the embodiment of the present invention.

FIG. 23 is a diagram illustrating a variation of the arrangement (configuration) illustrated in FIG. 21. In the arrangement of FIG. 23, the number of components is reduced compared with the arrangement of FIG. 22. In the case illustrated in FIG. 23, the thermal head 4 is held by a head holding elastic member 48. The head holding member 48 has elasticity, which causes the thermal head 4 to be in press contact with the platen roller 2. Further, the head holding elastic member 48 has an end portion 48*a* serve as the fixed blade 6. That is, the head holding elastic member 48 integrates the functions of the head pressurizing spring 44, the head holding member 43, and the fixed blade 6 illustrated in FIG. 21. Using this head holding elastic member 48 makes it possible to reduce the number of components compared with the case of FIG. 22.

Figure 24:
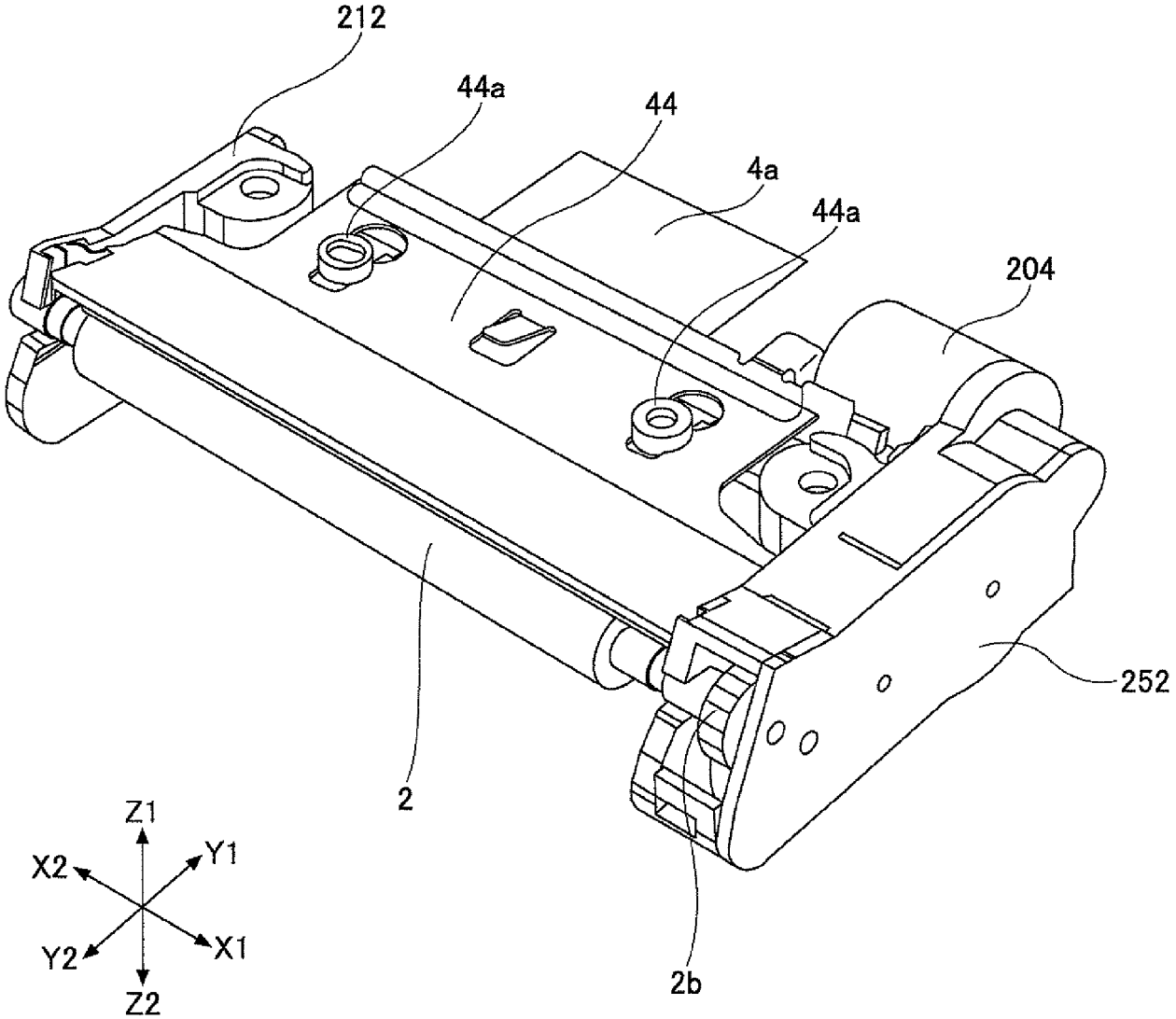
FIG. 24 is a perspective view of an arrangement including the printing unit according to the embodiment of the present invention.

FIG. 24 is a perspective view of an arrangement including the printing unit 50 of FIG. 20. FIG. 25 is a perspective view of the arrangement of FIG. 24 with the paper A in a rolled-up state placed below the platen roller 2, taken from the same angle as FIG. 24.

The head pressurizing spring 44 is fixed to the head holding member 43 or a support member (not graphically illustrated) of the first module 200 with screws 44*a* passed through two screw holes in the head pressurizing spring 44. Further, a flexible plate 4*a* for transmitting printing information to the thermal head 4 (FIG. 20) is attached to the rear of the thermal head 4. Further, the motor 204 (FIG. 7A) is provided on the platen gear 2*b* (X1) side on the rear side of the thermal head 4. Further, a gear housing part 252 is provided on the platen gear 2*b* side of the thermal head 4 in its longitudinal directions (the X1 and the X2 direction). In addition to the platen gear 2*b*, for example, the gears 208 and 210 (FIG. 7A) are provided in the gear housing part 252. The gears 208 and 210 may be replaced with a timing belt.

The shaft support member 212 is provided on the side of the thermal head 4 opposite to the platen gear 2*b* side in its longitudinal directions. As illustrated with reference to FIG. 7A, the platen rotary shaft 2*a* is rotatably supported by the end part 212*a* of the shaft support member 212.

A description is given of a printer unit 400.

Figure 26:
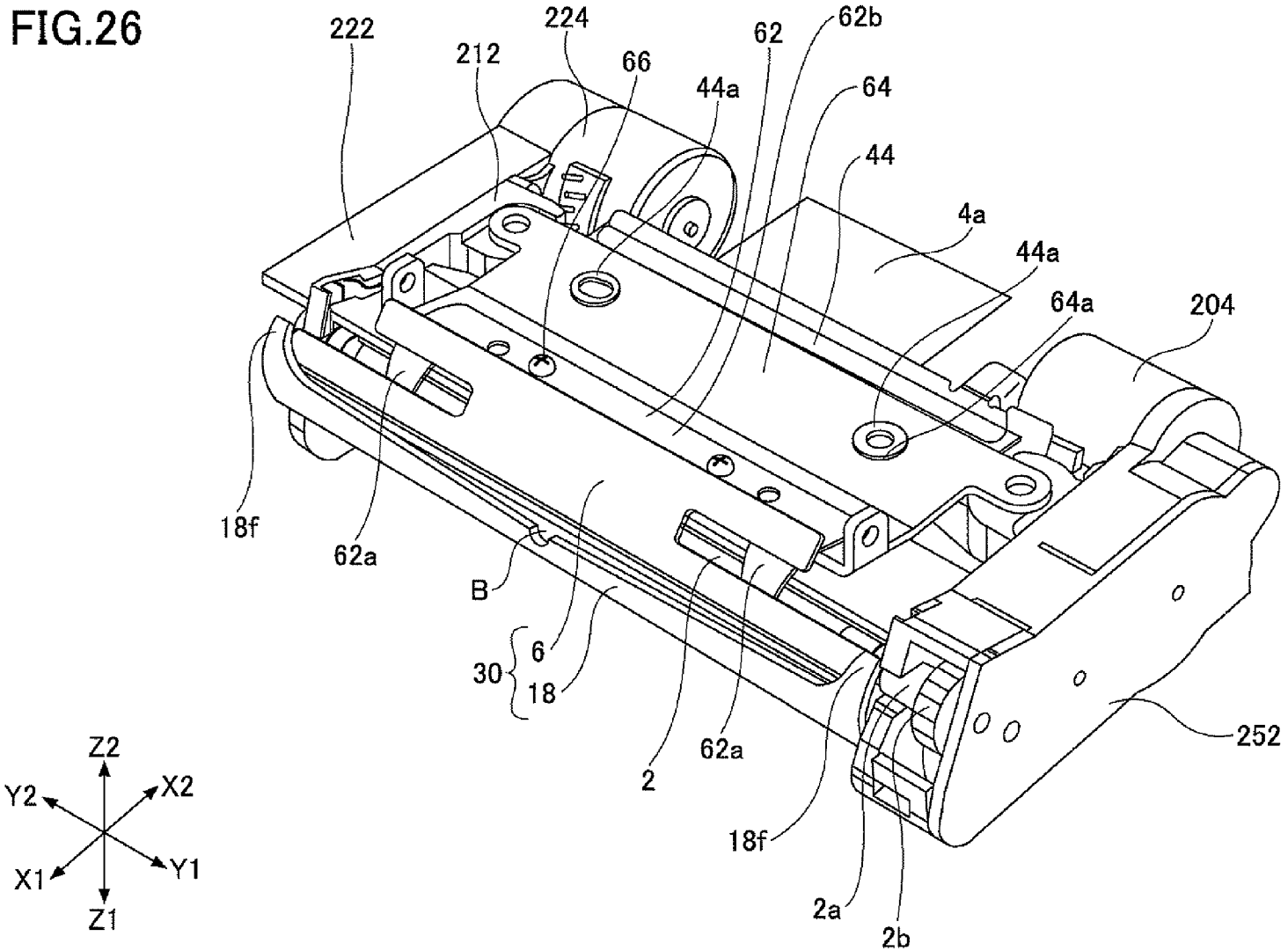
FIG. 26 is a perspective view of a printer unit according to the embodiment of the present invention.

FIG. 26 is a perspective view of the printer unit 400.

The printer unit 400 integrates the printing unit 50 (for example, FIG. 20) and the cutter unit 30 (for example, FIG. 10). The spring holding member 64 of the cutting part 40 is placed so that the lower surface of the spring holding member 64 is in contact with the upper surface of the head pressurizing spring 44 of the printing unit 50. Further, the drive mechanism 222 and a cutter drive motor 224 for driving the drive mechanism are placed on the side of the printer unit 400 opposite to the gear housing part 252 in its longitudinal directions (the X1 and the X2 direction).

Figure 27A:
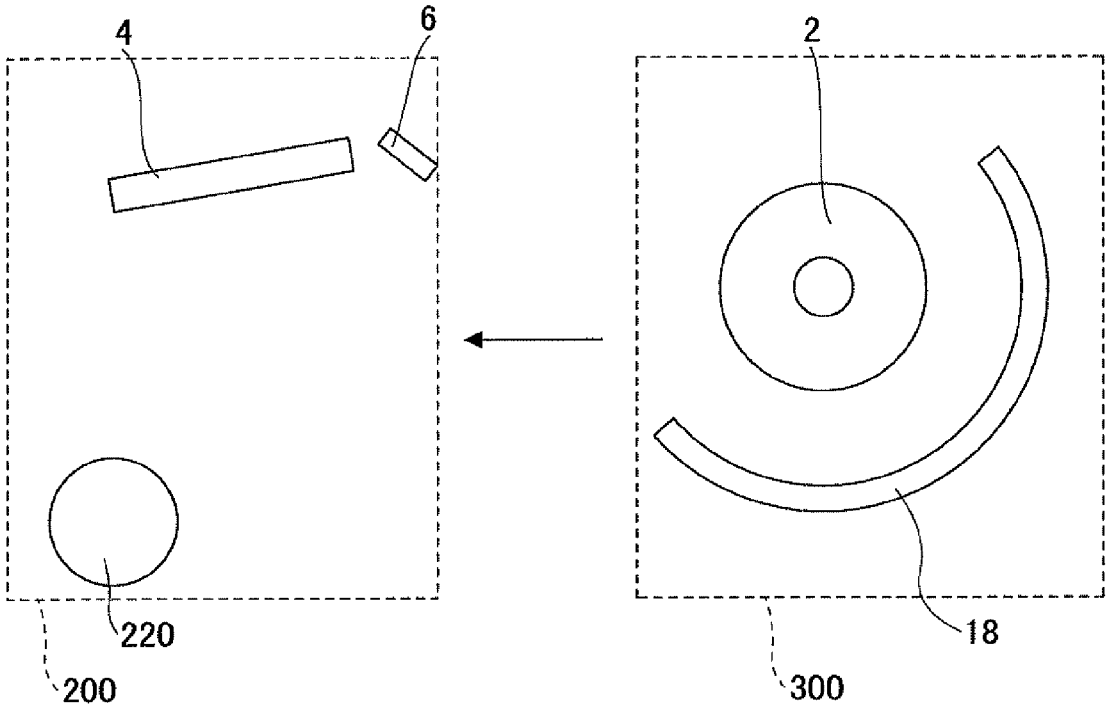
FIGS. 27A and 27B are diagrams illustrating a process of formation of the printer unit according to the embodiment of the present invention.
Figure 27B:
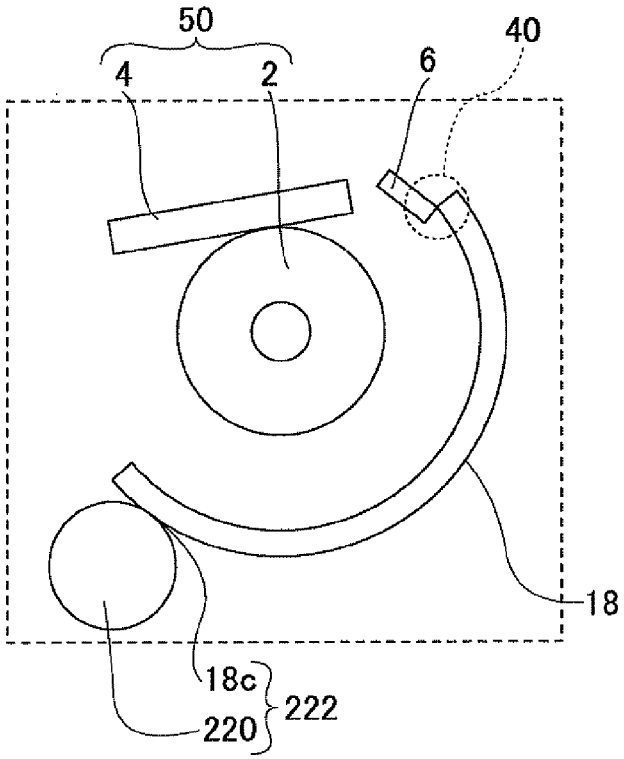

FIGS. 27A and 27B illustrate a process of formation of the printer unit 400 in a simplified manner. In FIGS. 27A and 27B, a graphical representation of the teeth of the first gear 220 and the second gear 18*c* (FIG. 10) is omitted. As illustrated in FIGS. 27A and 27B, the first module 200 and the second module 300 are integrated to form the printing unit 50, the cutting part 40, and the drive mechanism 222.

Next, a description is given of a lock part 60. It is preferable to provide the lock part 60 in configurations where the blade part (edge) 6*a* of the fixed blade 6 is positioned inside the blade part (edge) 18*e* of the movable blade 18 when cutting the paper A in the cutting part 40 (FIGS. 4A and 4C).

The lock part 60 prevents the first module 100 and the second module 200 from being separated unless a user releases the lock set by the lock part 60 when the first module 200 and the second module 300 are integrated.

Figure 28:
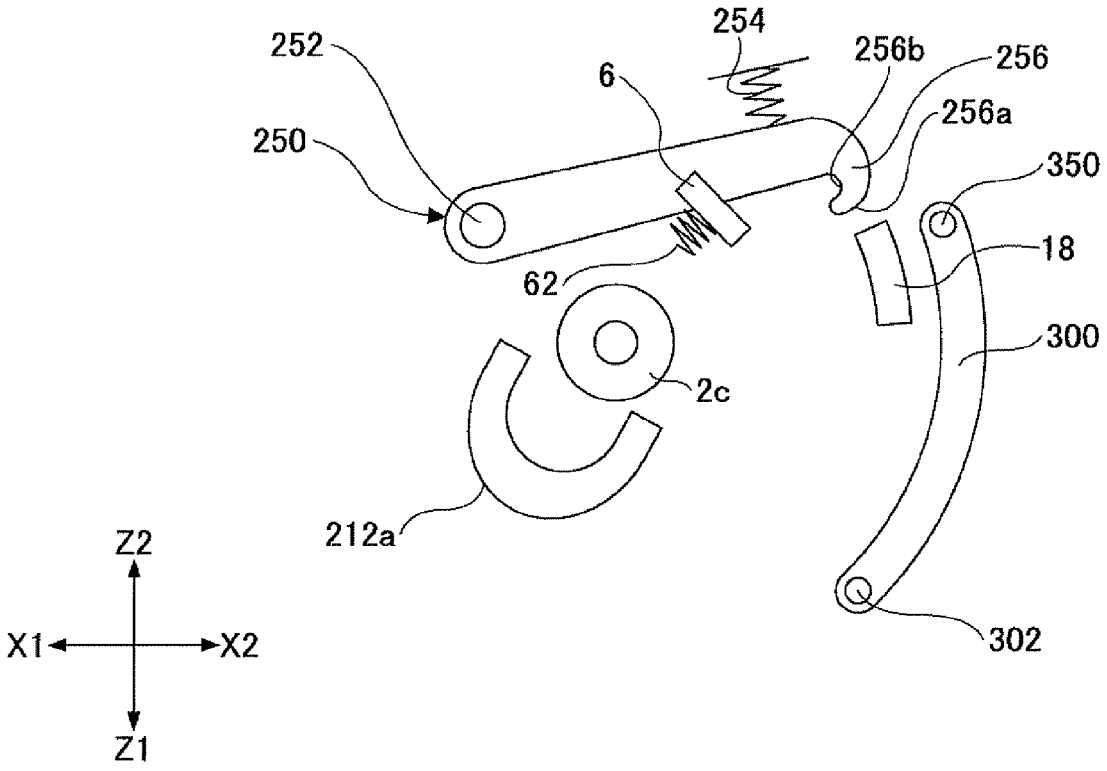
FIG. 28 is a schematic side view of an arrangement including a lock part according to the embodiment of the present invention.
Figure 29:
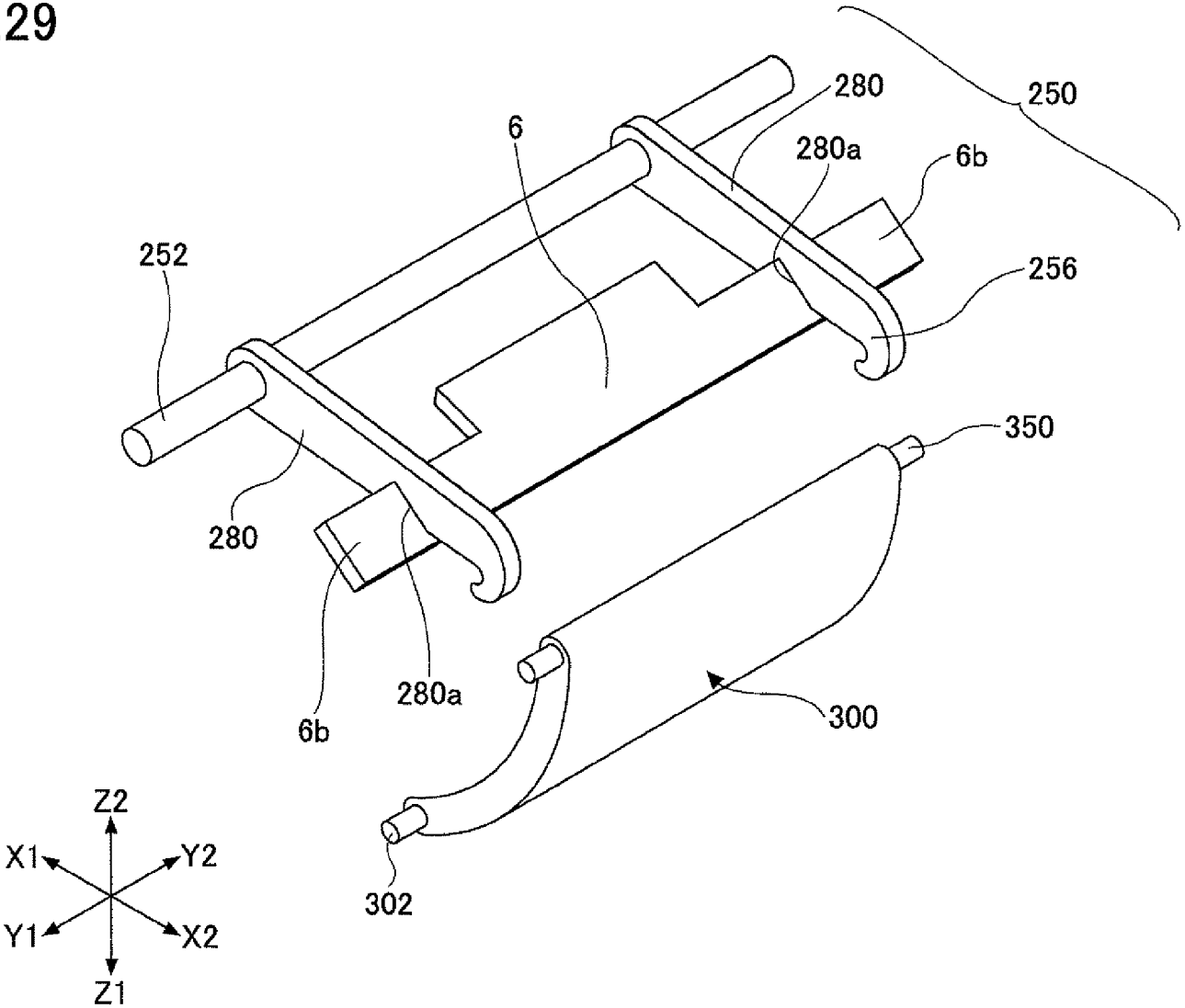
FIG. 29 is a perspective view of the arrangement of FIG. 28 according to the embodiment of the present invention.
Figure 30A:
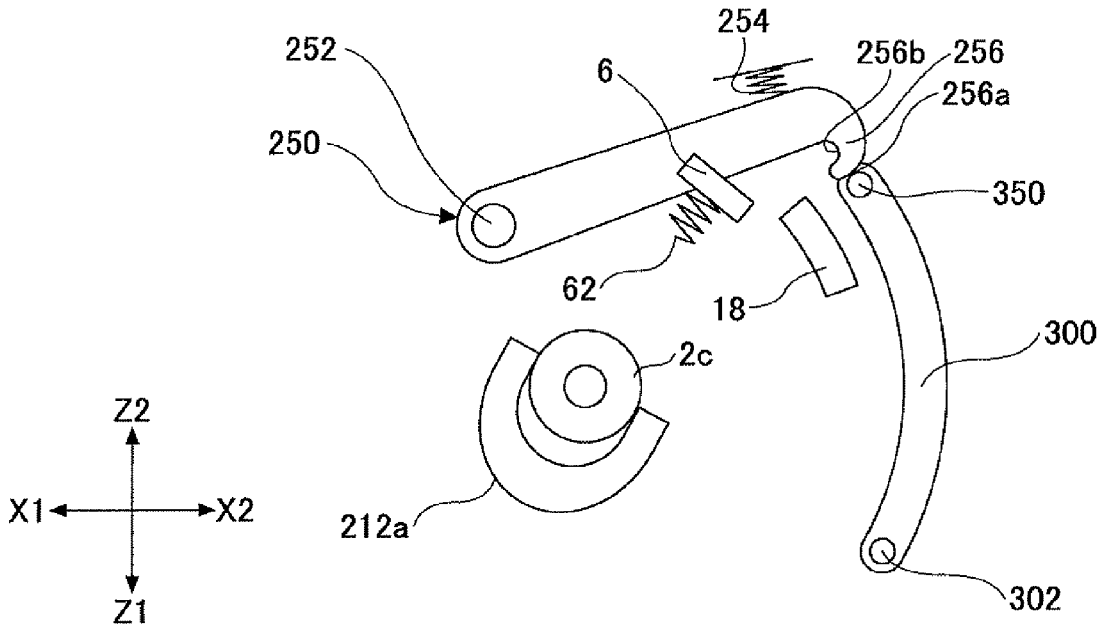
FIGS. 30A and 30B are diagrams illustrating a locking process of the lock part according to the embodiment of the present invention.
Figure 30B:
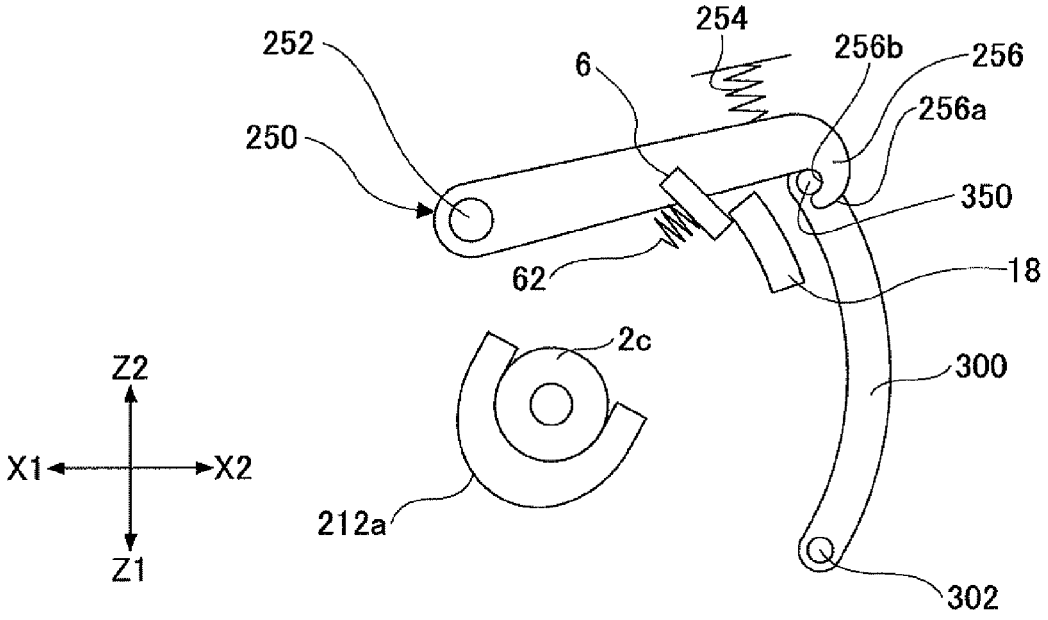

FIG. 28 and FIG. 29 are a schematic side view and a perspective view, respectively, of an arrangement including the lock part 60. Further, FIGS. 30A and 30B illustrate a locking process of the lock part 60. FIG. 28 illustrates a state immediately before the lock part 60 performs locking.

As illustrated in FIG. 28, the first module 200 includes a fixed blade block 250. Referring to FIG. 29, the fixed blade block 250 includes a pair of (two) thin-plate arm members 280, a second rotation shaft 252, and the fixed blade 6. Each of the arm members 280 includes a cut 280*a*. The fixed blade 6 has its projecting parts 6*b* engaging the corresponding cuts 280*a*, so that the fixed blade 6 is placed across the gap between the arm members 280.

In the case illustrated in FIG. 28, the fixed blade spring 62 (FIG. 14) is provided as the blade pressure generation part. Further, the second rotation shaft 252 is provided at first ends of the arm members 280, and lock claws 256 are provided at second ends of the arm members 280. The fixed blade block 250 is rotatable (pivotable) in a direction toward (to approach) the second module 300 and in a direction away from the second module 300 on the second rotation shaft 252. The fixed blade block 250 is urged in the direction toward the second module 300 (in the Z1 direction) by an elastic member 254 such as a spring.

The above-described first rotation shaft 302 (for example, FIG. 7A) is provided at one end of the second module 300, and a lock shaft 350 is provided at the other end of the second module 300. Each of the lock claws 256 includes a curved guide part (surface) 256*a* on the side facing the lock shaft 350 and an engagement part 256*b* to engage the lock shaft 350 on the other side (the side opposite to the guide part 256*a*).

Referring to FIG. 30A, when it is attempted by a user to integrate the second module 300 with the first module 200, that is, to turn (rotate) the second module 300 in the direction toward the first module 200 (in the X1 direction), the lock shaft 350 is guided by the guide parts 256*a* (that is, slides on the curves of the guide parts 256*a*) to push the fixed blade block 250 upward (in the Z2 direction) against the urging of the elastic member 254, so that the elastic member 254 is bent.

Figure 31:
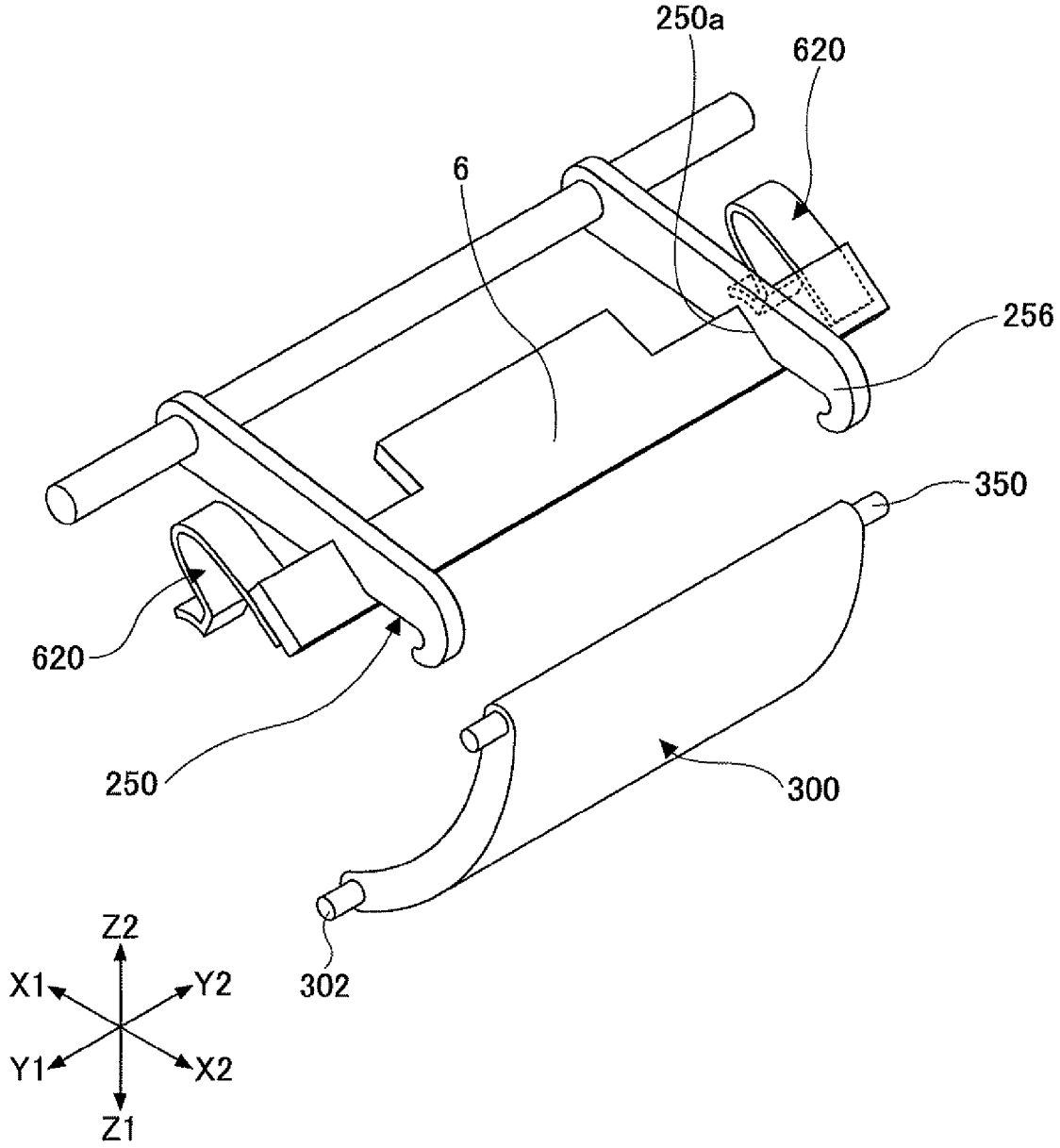
FIG. 31 is a perspective view of a variation of the lock part according to the embodiment of the present invention.

When the second module 300 is further pushed to move in the X1 direction by the user, the lock shaft 350 engages the engagement parts 256*b* so that the fixed blade block 250 is caused to move downward (in the Z1 direction) by the urging of the elastic member 254 as illustrated in FIG. 31. The first module 200 and the second module 300 are integrated and locked by the lock shaft 350 engaging the lock claws 256 (the engagement parts 256*b*). Further, when the first module 200 and the second module 300 are integrated, the platen rotary shaft 2*a* is supported by the shaft support member 212, and a blade pressure is generated between the movable blade 18 and the fixed blade 6 by the blade pressure generation part, which is the fixed blade spring 62 in the illustrated case.

Next, a description is given of the release (undoing) of a lock set by the lock part 60.

When the fixed blade block 250 is turned (rotated) in the direction away from the second module 300 (in the Z2 direction) by a user, the engagement parts 256*b* are disengaged from the lock shaft 350 because of a blade pressure between the fixed blade 6 and the movable blade 18. Then, the lock shaft 350 is caused to move in the direction away from the fixed blade block 250 (in the X2 direction). This movement of the lock shaft 350 releases the lock set by the lock part 60. Further, the blade pressure between the fixed blade 6 and the movable blade 18 causes the platen rotary shaft 2*a* to pass the air gap 212*b* of the shaft support member 212 to be unsupported by the shaft support member 212.

Once the lock shaft 350 is disengaged from the engagement parts 256*b* and the platen roller 2 (the platen rotary shaft 2*a*) becomes unsupported, the blade pressure causes the second module 300 to turn in the direction away from the first module 200, so that the first module 200 and the second module 300 are separated.

For example, a press button may be provided as a lock release (unlocking) part to cause the fixed blade block 250 to turn (rotate) in the direction away from the second module 300. The fixed blade block 250 may be turned in the direction away from the second module 300 by pressing this press button. Further, the fixed blade block 250 may be turned in the direction away from the second module 300 by a user's direct operation (for example, pressing) of a predetermined part of the first module 200.

In the case of this illustrated lock part 60, the first module 200 and the second module 300 are automatically separated (because of a blade pressure between the movable blade 18 and the fixed blade 6) in response to the release of a lock by a user, thus increasing convenience.

FIG. 31 illustrates a variation of the arrangement illustrated in, for example, FIG. 28.

In the arrangement illustrated in FIG. 28, the fixed blade block 250 is urged by the elastic member 254. Alternatively, as illustrated in FIG. 31, the fixed blade springs 620 (FIG. 17) may be employed as the blade pressure generation part. In this case, it is possible to omit the elastic member 254.

Next, a description is given of a configuration where an end returning part 640 is employed. It is preferable to use the end returning part 640 in configurations where the blade part (edge) 6*a* of the fixed blade 6 is positioned outside the blade part (edge) 18*e* of the movable blade 18 when cutting the paper A in the cutting part 40 (FIGS. 4B and 4D).

Figure 32:
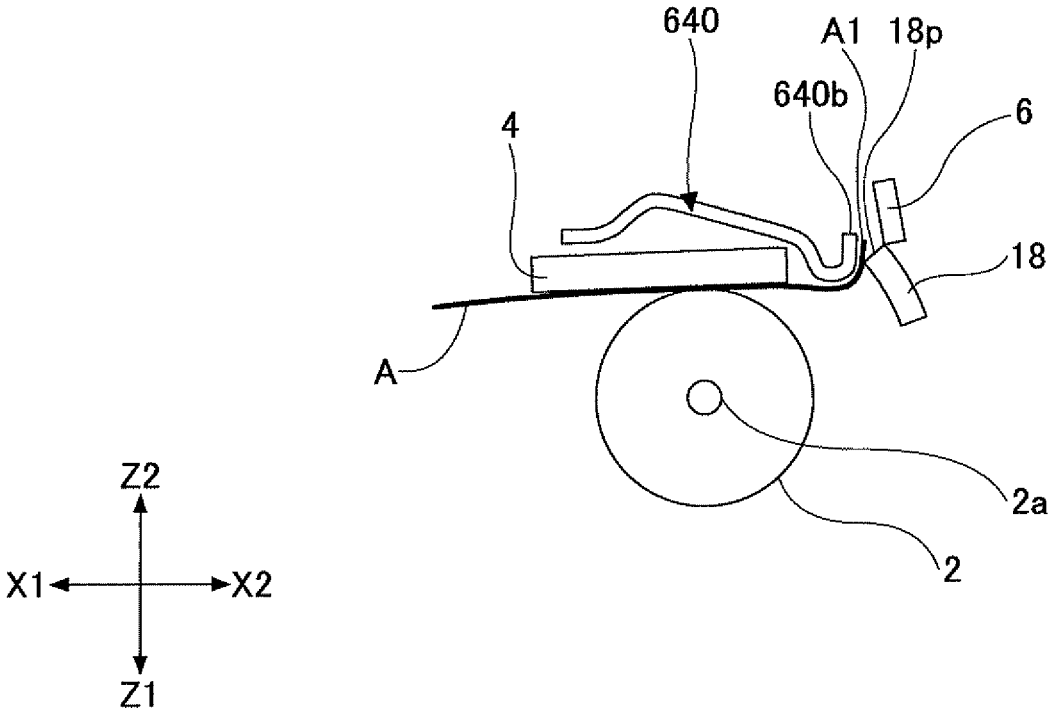
FIG. 32 is a schematic side view of an arrangement including an end returning part according to the embodiment of the present invention.
Figure 33:
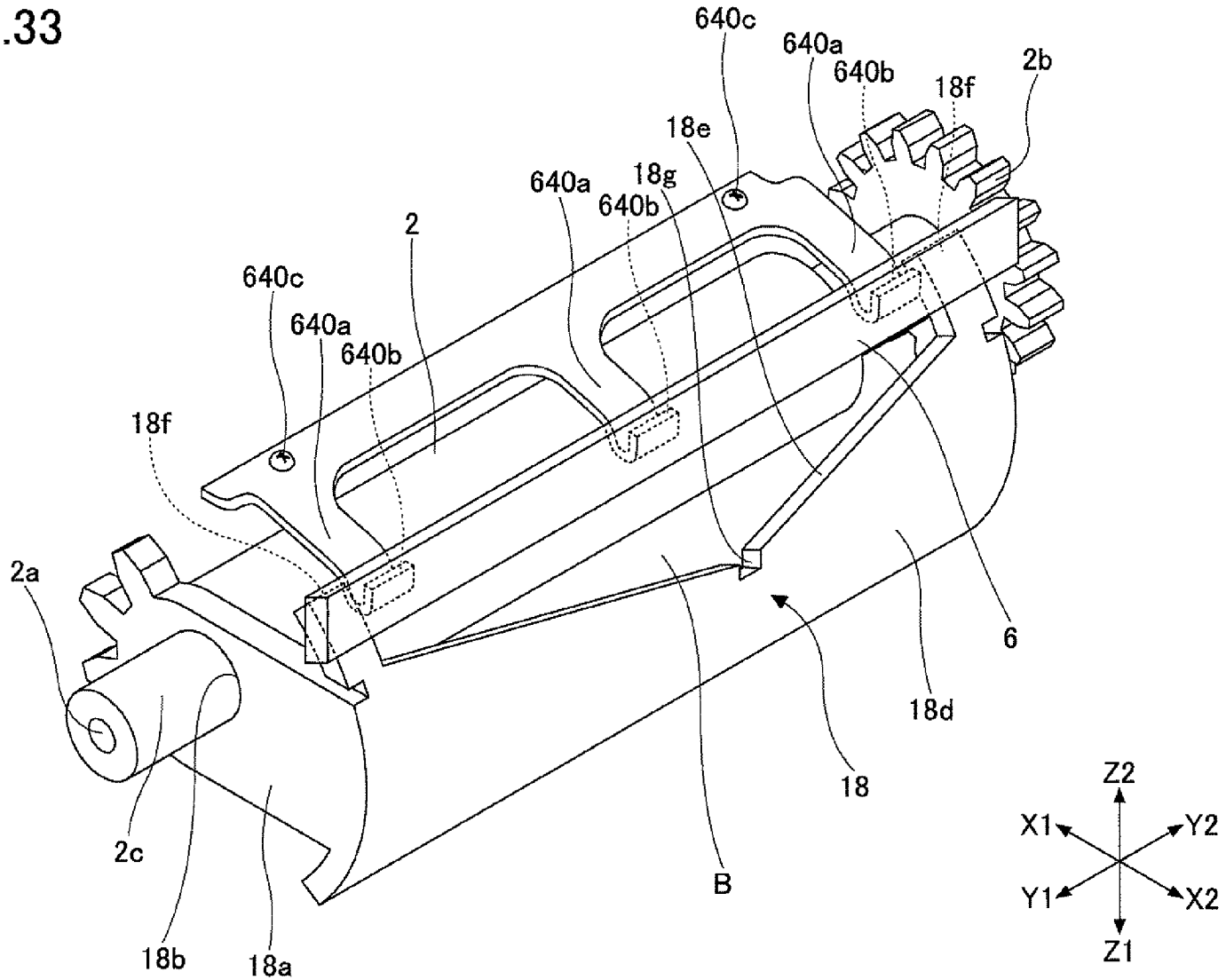
FIG. 33 is a perspective view of the arrangement of FIG. 32 according to the embodiment of the present invention.

FIG. 32 and FIG. 33 are a schematic side view and a perspective view, respectively, of an arrangement including the end returning part 640.

The end returning part 640 returns an end A1 of the paper A conveyed by the movable blade 18 to a position where cutting is performable by the cutting part 40 (a position where the end A1 projects from the air gap B). This position is hereinafter referred to as "cutting performable position."

When the paper A is cut by the cutting part 40, the end A1 of the paper A (the end of the remaining portion of the paper A after a portion of the paper A is cut) is conveyed by an end part 18*p* (the blade part 18*e*) of the movable blade 18, formed by the thickness of the movable blade 18, so that the end A1 is not at the cutting performable position. Then, the end A1 collides with the fixed blade 6, thus resulting in the occurrence of a jam. As a result, the cutting part 40 is prevented from performing cutting properly in the next cutting. By returning the end A1 to the cutting performable position with the end returning part 640, it is possible to perform cutting in the next cutting as well.

In the case illustrated in FIG. 32, the end returning part 640 is formed of an elastic member such as a spring. The end returning part 640 includes multiple (for example, three) tongue piece parts 640*a*. The end returning part 640 further includes upward warping parts 640*b* provided at the respective ends of the tongue piece parts 640*a*. The end returning part 640 may be attached on the fixed blade block 250. In the case illustrated in FIG. 33, the end returning part 640 is fixed to the upper side of the fixed blade block 250 (FIG. 29) with screws 640*c*.

When the cutting part 40 is in the post-cutting state (that is, when the movable blade 18 has moved), the end 18*p* of the movable blade 18 is in contact with or almost in contact with the upward warping parts 640*b*. According to this configuration, when the end 18*p* of the movable blade 18 conveys the end A1 of the paper A, the conveyed end A1 collides with the upward warping parts 640*b*. The movable blade 18 returns to the home position after cutting the paper A. The end A1 that has collided is moved (flipped) in the direction opposite to the conveying direction by the elastic force of the end returning part 640 so as to be at the cutting performable position. Thus, it is possible to return the conveyed end A1 to the cutting performable position with the end returning part 640. Accordingly, it is possible for the cutting part 40 to perform proper cutting in the next cutting as well.

Next, a description is given of the retreating operation part 700 (FIG. 6). It is preferable to provide this retreating operation part 700 in configurations where the blade part (edge) 6*a* of the fixed blade 6 is positioned on the downstream side in the direction in which the paper A is discharged (that is, outside the blade part [edge] 18*e* of the movable blade 18) (FIGS. 4B and 4D).

Figure 34:
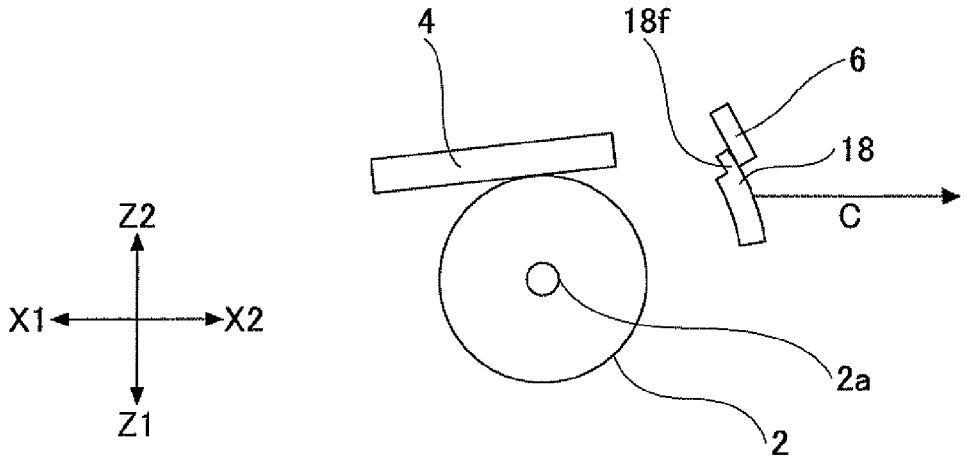
FIG. 34 is a diagram for illustrating a retreating operation part according to the embodiment of the present invention.

FIG. 34 is a diagram for illustrating the retreating operation part 700. FIG. 34 is substantially equal to FIG. 4B, but schematically illustrates one of the finger parts 18*f* (for example, FIG. 8) of the movable blade 18. That is, in FIG. 34, the finger parts 18*f* and the projecting parts 6*b* (for example, FIG. 10) of the fixed blade 6 are in contact.

Further, the path of the movable blade 18 at the time of separating the second module 300 from the first module 200 is indicated by arrow C and is referred to as a separation path C.

In this case, when a user tries to separate the first module 200 and the second module 300, the movable blade 18 is blocked by the fixed blade 6 to prevent the second module 300 from being turned (rotated) because the finger parts 18*f* and the projecting parts 6*b* are in contact.

Therefore, for example, the retreating operation part 700 is provided on an exterior side of the recorder 100 as illustrated in FIG. 5. When the retreating operation part 700 is operated at the time of separating the first module 200 and the second module 300, the fixed blade 6 is retracted to a position where the fixed blade 6 is prevented from contacting the movable blade 18. That is, the fixed blade 6 is retracted outside the separation path C.

As illustrated in FIG. 5, the retreating operation part 700 may be, for example, a push-down lever. The fixed blade 6 may be retracted, for example, in the Z2 direction (the direction away from the movable blade 18, which is the upward direction in the plane of the paper of FIG. 34) in conjunction with a user's pushing down the push-down lever. This retreat (retraction) makes it possible to cause the second module 300 to turn in the direction away from the first module 200 without the fixed blade 6 blocking the movable blade 18. Further, the direction of the retreat is not limited to the Z2 direction, and may be any other direction as long as the fixed blade 6 is retracted outside the separation path C.

Further, the retreating operation part 700 and the above-described lock release part may be integrated into a retreating operation and lock release part, which may be in the form of a push-down lever. In this case, by operating this retreating operation and lock release part, the fixed blade 6 is retracted and a lock is released, so that the first module 200 and the second module 300 are separated, which significantly increase the convenience of users.

Next, a description is given of a detection part 510.

For example, according to the cutter described in Japanese Laid-Open Patent Application No. 2005-271204, a cutting blade sensor that senses (detects) the status of a cutting blade, a platen sensor that senses (detects) the fitting of a platen roller to a shaft (the support of a platen roller by a shaft) (the integration or separation of a first module and a second module), and a paper sensor that senses (detects) the presence or absence of (a sheet of) paper are provided as separate bodies. The sensors may be, for example, switches or photosensors (photodetectors). According to this configuration, three sensors are necessary, which causes an increase in cost and an increase in apparatus size.

Figure 35:
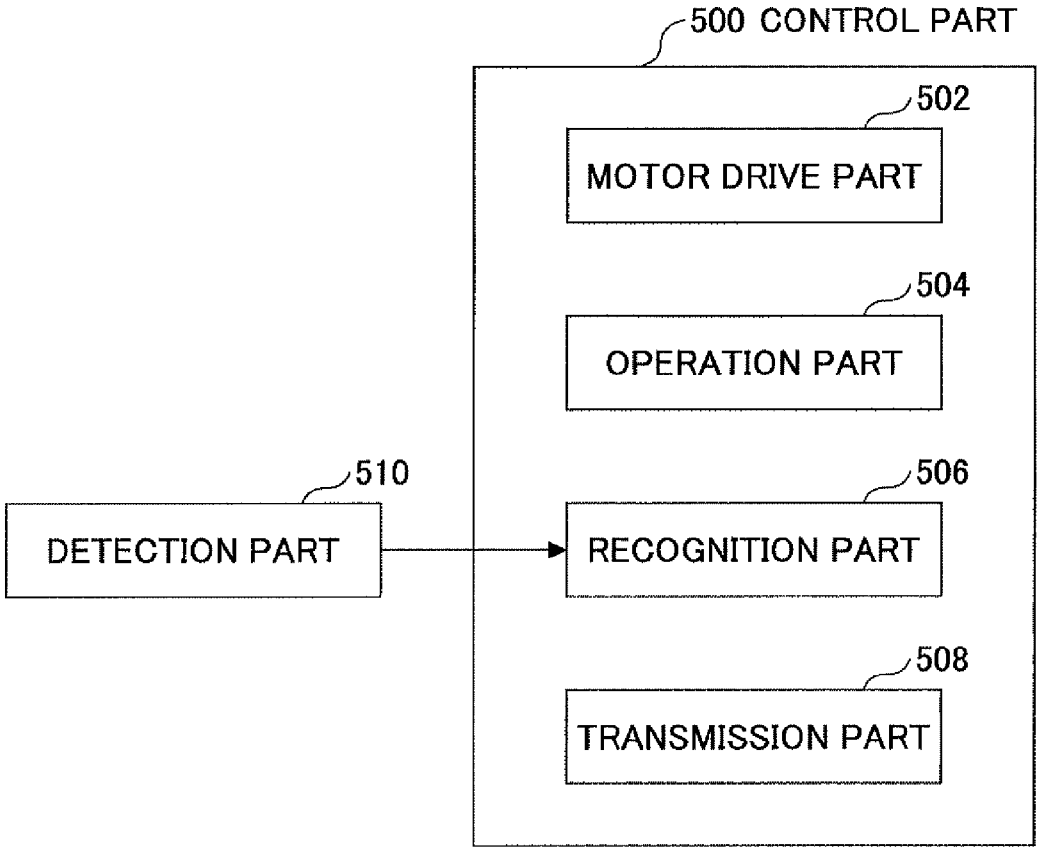
FIG. 35 is a block diagram illustrating a functional configuration of a control part according to the embodiment of the present invention.

The detection part 510 according to this embodiment serves as a cutting blade sensor and a platen sensor. FIG. 35 is a diagram illustrating a functional configuration of a control part 500, to which the detection part 510 is connected.

The control part 500 includes a motor drive part 502, an operation part 504, a recognition part 506, and a transmission part 508.

The recognition part 506 recognizes (determines) the integration or separation of the first module 200 and the second module 300 (the support [fitting] of the platen roller 2 by [to] the shaft support member 212 or the disengagement of the platen roller 2 [the platen rotary shaft 2*a*] from the shaft support member 212), the presence or absence of the movable blade 18 (a movable blade detection process determining the presence or absence of the movable blade 18), and the presence or absence of cutting by the cutting part 40 (a cutting detection process determining the presence or absence of cutting by the cutting part 40).

For example, a photosensor or a switch may be used as the detection part 510. In the following description, it is assumed that the detection part 510 is a photosensor. The motor drive part 502 drives the motor 204 (FIG. 7A), thereby rotating the platen roller 2. The operation part 504 drives the drive mechanism 222, thereby moving the movable blade 18 in the arc α.

Figure 36A:
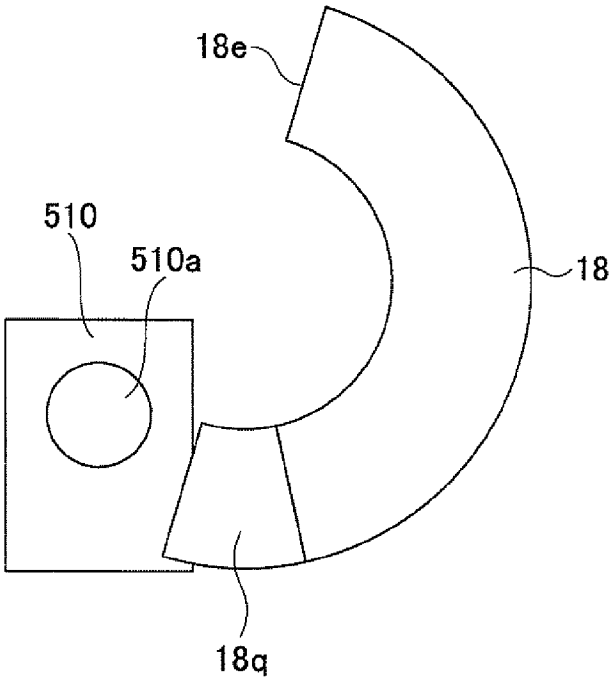
FIG. 36A is a diagram illustrating a case where a detection part indicates an ON state.
Figure 36B:
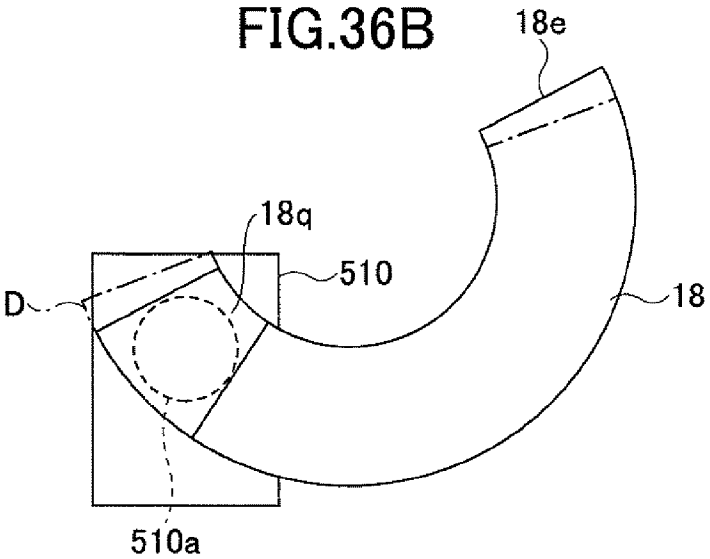
FIG. 36B is a diagram illustrating a case where the detection part indicates an OFF state.
Figure 36C:
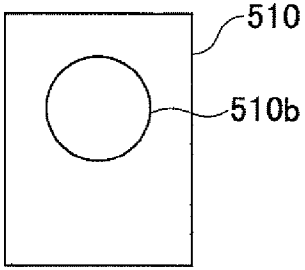
FIG. 36C is a diagram illustrating a light reception part of the detection part according to the embodiment of the present invention.

FIGS. 36A, 36B, and 360 are diagrams for illustrating a detecting operation performed by the detection part 510.

The movable blade 18 includes a block part 18*q*. In FIGS. 36A and 36B, the block part 18*q* is illustrated in a simplified manner. For example, the block part 18*q* may be provided on the rear (the side opposite to the blade part 18*e*) of the body part 18*d* of the movable blade 18. That is, the block part 18*q* may be provided at an end of the movable blade 18 opposite to the end at which the blade part 18*e* is provided. The detection part 510 includes an emission part 510*a* to emit light and an entrance part 510*b* (FIG. 360) which the emitted light enters (a reception part to receive the emitted light). The entrance part 510*b* may be provided across a space (into which the block part 18*q* is allowed) from the emission part 510*a*.

In the following description, the region between the initial position (indicated by a one-dot chain line in FIG. 36B) and the home position (indicated by a solid line in FIG. 365) of the movable blade 18 may be referred to as "a detection region D." When the movable blade 18 is in the detection region D, the block part 18*q* blocks light as illustrated in FIG. 36B. The detection region D also includes the initial position and the home position of the movable blade 18.

In the state of FIG. 36A, the light block part 18*q* does not block light emitted from the emission part 510*a*. Accordingly, the entrance part 510*b* receives the emitted light, so that the detection part 510 detects the absence of the movable blade 18 in the detection region and determines that the movable blade 18 is not in the detection region.

In the state of FIG. 36B, the block part 18*q* blocks light emitted from the emission part 510*a*. Accordingly, the detection part 510 detects the presence of the movable blade 18 in the detection region D and determines that the movable blade 18 is in the detection region D.

The detection part 510 transmits information indicating the presence (detected state) or absence (undetected state) of the movable blade 18 to the recognition part 506. The recognition part 506 recognizes (determines) various states from the transmitted detection information. In the following, the detected state of the movable blade 18 is referred to as "an OFF state" and the undetected state of the movable blade 18 is referred to as "an ON state."

Figure 37A:
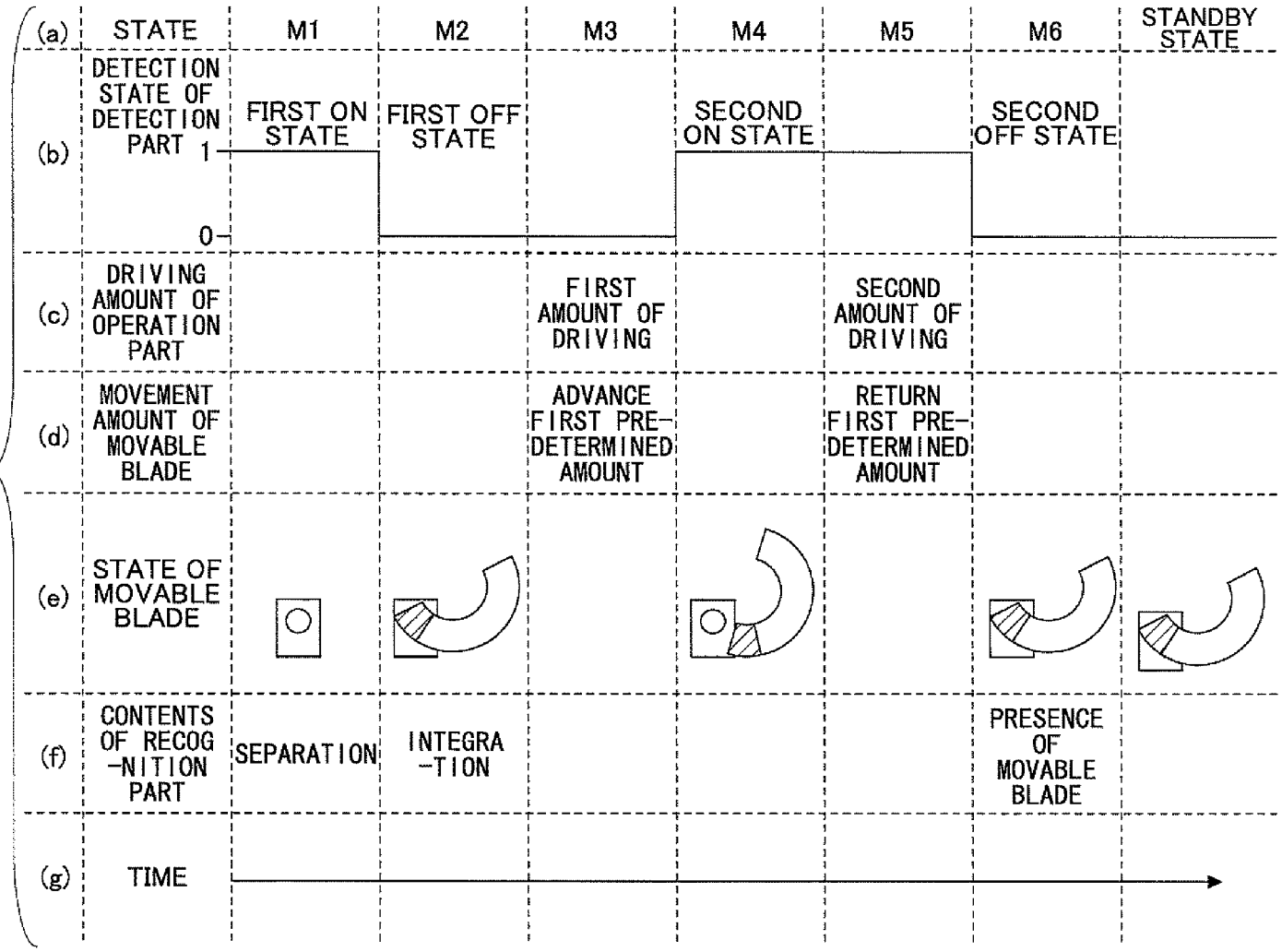
FIGS. 37A and 37B are timing charts of an operation performed by the detection part, etc., according to the embodiment of the present invention.
Figure 37B:
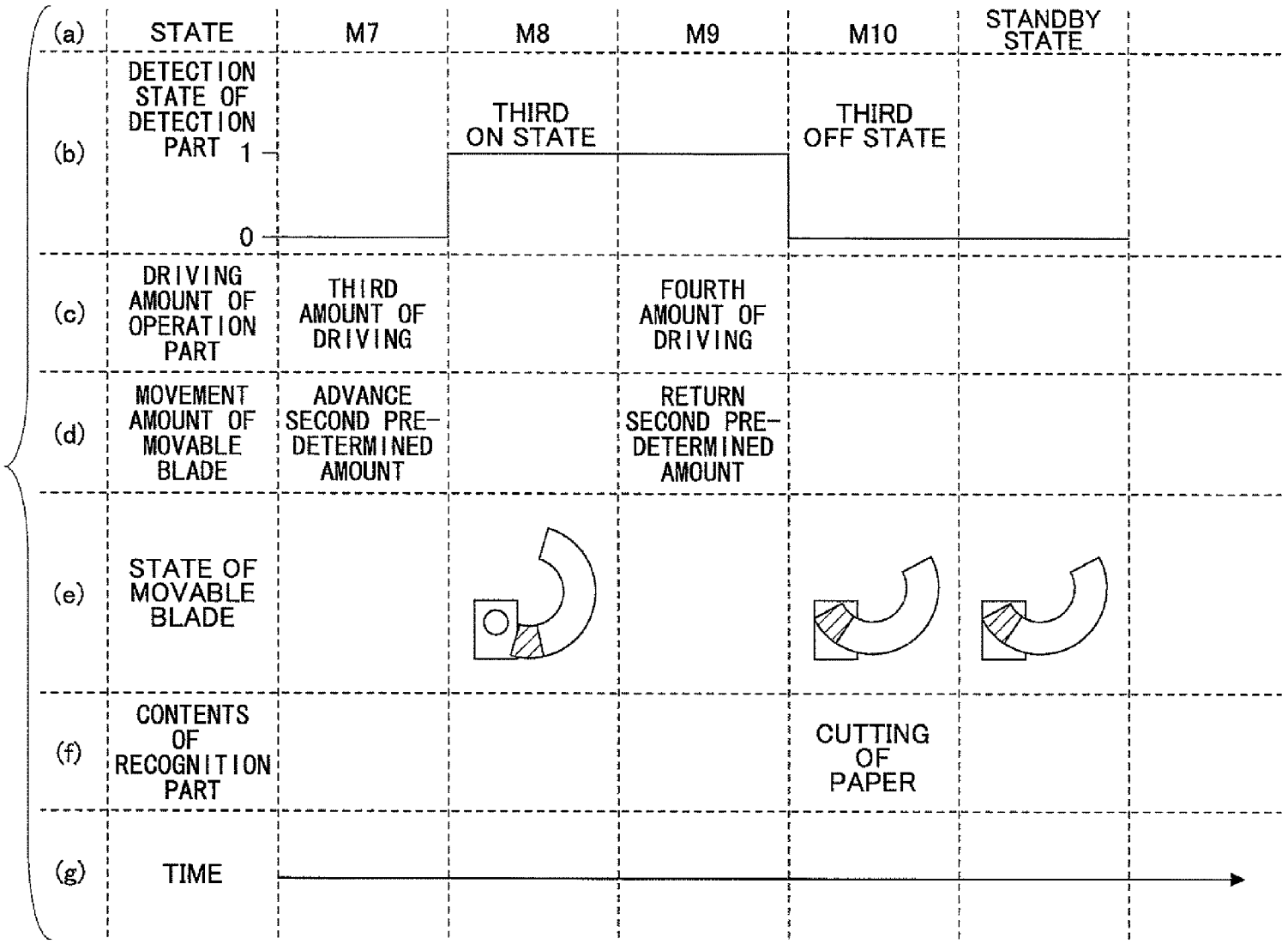
Figure 38A:
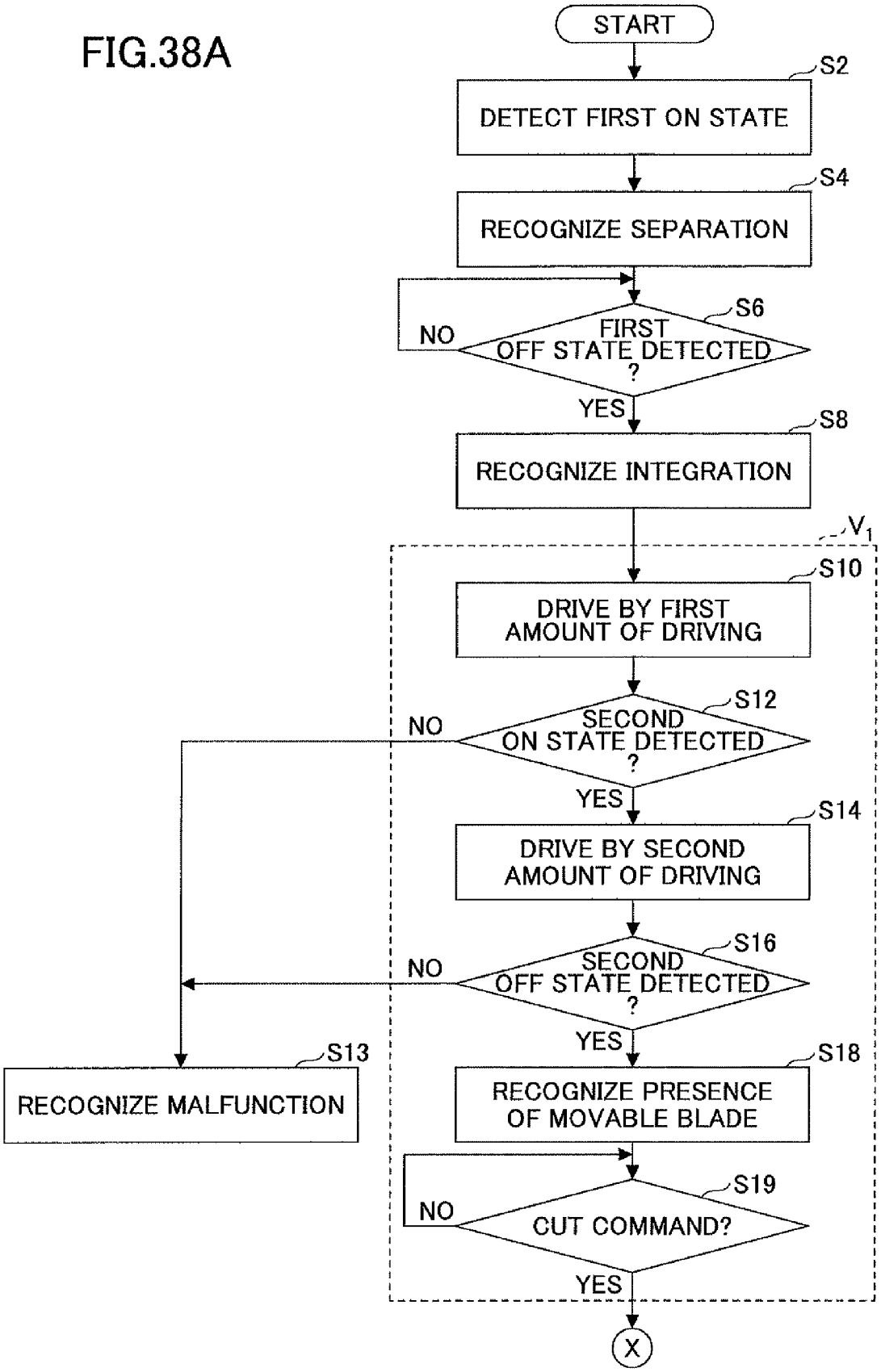
FIGS. 38A and 38B are flowcharts of the control part according to the embodiment of the present invention.
Figure 38B:
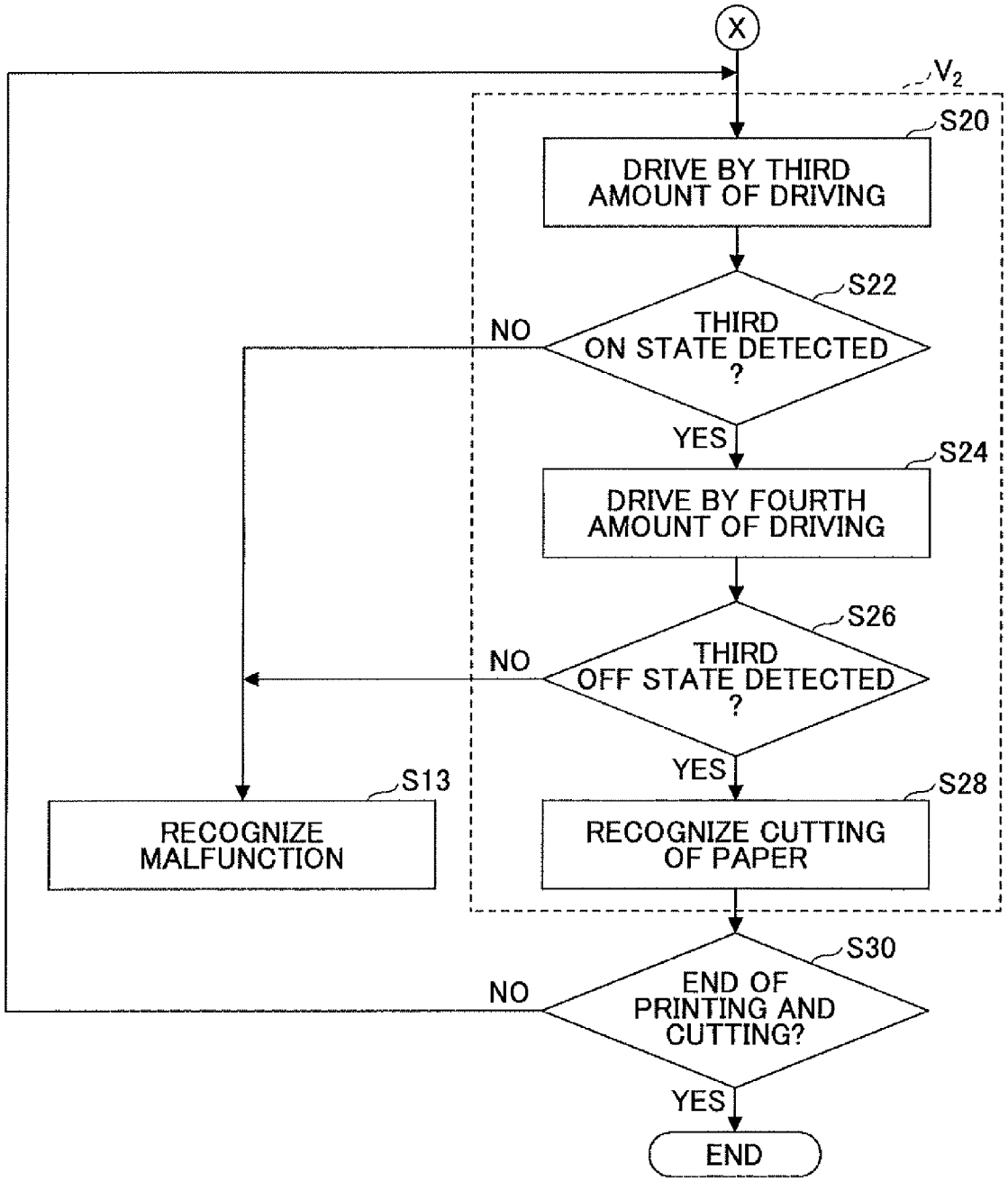

FIGS. 37A and 37B are timing charts of an operation according to this embodiment. FIGS. 38A and 38B are flowcharts for illustrating the operation according to this embodiment.

In FIGS. 37A and 37B, (a) indicates States M1 through M11, (b) indicates the detection state (ON state or OFF state) of the detection part 510, and (c) indicates the amount of driving the drive mechanism 222 by the operation part 504. In the following, the amount of driving includes a first amount of driving, a second amount of driving, a third amount of driving, and a fourth amount of driving. The amount of driving refers to the amount of rotation (the rotation [turning] angle) of the first gear 220 if the drive mechanism 222 is formed of the first gear 220 and the second gear 18*c*.

In FIGS. 37A and 37B, (d) indicates the amount of movement (traveling) of the movable blade 18, which includes a first predetermined amount and a second predetermined amount in this case), (e) indicates the positional relationship between the movable blade 18 and the detection part 510 with miniature versions of FIGS. 36A and 36B (in which the block part 18*q* is indicated by hatching), (f) indicates the state recognized by the recognition part 506, and (g) indicates a time axis.

First, a description is given of State M1. In State M1, the first module 200 and the second module 300 are separated, so that the movable blade 18 is not in the detection region D (FIG. 36B). Therefore, in step S2 of FIG. 38A, the detection part 510 detects an ON state (hereinafter, a first ON state). Then, in step S4 of FIG. 38A, the recognition part 506 recognizes (determines) the separation (separated state) of the first module 200 and the second module 300.

Next, a description is given of State M2. In State M2, the first module 200 and the second module 300 are integrated. When the first module 200 and the second module 300 are integrated, the movable blade 18 is in the detection region D, being first positioned at the initial position and then moved to the home position. Accordingly, the detection part 510 detects an OFF state (hereinafter, a first OFF state) (YES in step S6 of FIG. 38A). Then, in step S8, the recognition part 506 recognizes (determines) the integration of the first module 200 and the second module 300.

In States M1 and M2, the operation part 504 does not cause the drive mechanism 222 to be driven. That is, when the operation part 504 does not cause the drive mechanism 222 to be driven, the detection part 510 detects the absence of the movable blade 18 in the detection region D (step S4, State M1), and thereafter, the detection part 510 detects the presence of the movable blade 18 in the detection region D (YES in step S6, State M2), the recognition part 506 recognizes the integration of the first module 200 and the second module 300 (step S8). If the detection part 510 does not detect the first OFF state (NO in step S6), the operation returns to step S6.

Next, the control part 500 performs a movable blade detection process $V_1$ (steps S10 through S18 of FIG. 38A and States M3 through M6 of FIG. 37A), where the presence or absence of the movable blade 18 is detected and it is determined whether the movable blade 18 moves normally.

In step S10 of FIG. 38A, the operation part 504 causes the drive mechanism 222 to be driven by the first amount of driving (State M3). In State M3, the operations part 504 is in the middle of causing the drive mechanism 222 to be driven by the first amount of driving (to move the movable blade 18). Then, the movable blade 18 moves in the arc α from the home position by the first predetermined amount (State M4). In State M4, the movable blade 18 has moved the first predetermined amount (the movable blade 18 has finished moving the first predetermined amount). Since the movable blade 18 is not positioned in the detection region, basically, the detection part 510 detects an ON state (hereinafter, a second ON state) (YES in step S12, State M4), and the operation proceeds to step S14. A description is given separately of the case of NO in step S12.

In step S14, the operation part 504 causes the drive mechanism 222 to be driven by the second amount of driving (State M5). In State M5, the operation part 504 is in the middle of causing the drive mechanism 222 to be driven by the second amount of driving. Then, the movable blade 18 returns the first predetermined amount from its position after the (previous) movement of the first predetermined amount to move (return) to the home position (State M6). In State M6, the movable blade 18 has moved the first predetermined amount (the movable blade 18 has returned to the home position). Driving by the second amount of driving means causing the first gear 220 to rotate in the reverse direction compared with driving by the first amount of driving.

Since the movable blade 18 is positioned in the detection region D, basically, the detection part 510 detects an OFF state (hereinafter, a second OFF state) (YES in step S16, State M6), and the operation proceeds to step S18. A description is given separately of the case of NO in step S16. Then, in step S18, the recognition part 506 recognizes (determines) the presence of the movable blade 18 in the detection region D.

That is, when the recognition part 506 recognizes the integration of the first module 200 and the second module 300 (step S8, State M2), the operation part 504 causes the drive mechanism 222 to be driven by the first amount of driving so that the detection part 510 detects the absence of the movable blade 18 in the detection region D (steps S10 and S12, States M3 and M4), and the operation part 504 causes the drive mechanism 222 to be driven by the second amount of driving after driving by the first amount of driving so that the detection part 510 detects the presence of the movable blade 18 in the detection region D (steps S14 and S16, States M5 and M6), the recognition part 506 recognizes (determines) the presence of the movable blade 18 in the detection region D and that the movable blade 18 moves normally.

After completion of the movable blade detection process $V_1$, the cutter is in a standby state until the printing unit 50 finishes printing on the paper A and a CUT command is transmitted from the control part 500 to the cutter (State M7, step S19). In response to transmission of a CUT command from the control part 500 to the cutter (YES in step S19), the operation proceeds to the subsequent cutting detection process $V_2$.

Next, a description is given of the cutting detection process $V_2$ (steps S20 through S28 of FIG. 38B and States M7 through M10 of FIG. 37B), where it is determined whether a cutting process is completed (completion of the cutting process is detected).

The cutting process is a process for performing an operation necessary for the paper A to be cut by the cutting part 40. That is, the cutting process is a process where the movable blade 18 moves from its position (home position) in the pre-cutting state of the cutting part 40 to its position (post-movable-blade-cutting position) in the post-cutting state of the cutting part 40, and than returns to the home position. If the cutting process ends properly when the paper A is in the cutting performable position, the paper A is cut.

First, in step S20 of FIG. 38B, the operation part 504 causes the drive mechanism 222 to be driven by the third amount of driving (State M7). In state M7, the operation part 504 is in the middle of causing the drive mechanism 222 to be driven by the third amount of driving.

Then, the movable blade 18 moves the second predetermined amount from the home position along the arc α to the post-movable-blade-cutting position (State M8). In State M8, the movable blade 18 has moved the second predetermined amount along the arc α (the movable blade 18 is at the post-movable-blade-cutting position). When the movable blade 18 has moved (has finished moving) the second predetermined amount is when the cutting part 40 enters the post-cutting state, that is, when the cutting part 40 cuts the paper A if the paper A is in the cutting performable position.

When the movable blade 18 has moved the second predetermined amount, the movable blade 18 is not positioned in the detection region D. Therefore, basically, the detection part 510 detects an ON state (hereinafter, a third ON state) (YES in step S22), and the operation proceeds to step S24. A description is given separately of the case of NO in step S22.

In step S24, the operation part 504 causes the drive mechanism 222 to be driven by the fourth amount of driving (State M9). In State M9, the operation part 504 is in the middle of causing the drive mechanism 222 to be driven by the fourth amount of driving. Then, the movable blade 18 returns the second predetermined amount from its position after the (previous) movement of the second predetermined amount to move (return) to the home position (State M10). In State M10, the movable blade 18 has moved (returned) to the home position. Driving by the fourth amount of driving means causing the first gear 220 to rotate in the reverse direction compared with driving by the third amount of driving.

Since the movable blade 18 is positioned in the detection region D, basically, the detection part 510 detects an OFF state (hereinafter, a third OFF state) (YES in step S26), and the operation proceeds to step S28. A description is given separately of the case of NO in step S26.

The cutting process refers to a process where the operation part 504 causes driving by the third amount of driving to move the movable blade 18 by the second predetermined amount (to move the movable blade 18 to the post-movable-blade-cutting position), and thereafter, causes driving by the fourth amount of driving to return the movable blade 18 by the second predetermined mount (to place the movable blade 18 at the home position).

In step S28, the recognition part 506 recognizes the completion of the cutting process of the cutting part 40. That is, when the recognition part 506 recognizes the presence of the movable blade 18 (step S18, State M8), the operation part 504 causes the drive mechanism 222 to be driven by the third amount of driving so that the detection part 510 detects the absence of the movable blade 18 in the detection region D (YES in step S22, State M8), and the operation part 504 causes the drive mechanism 222 to be driven by the fourth amount of driving after driving by the third amount of driving so that the detection part 510 detects the presence of the movable blade 18 in the detection region D (YES in step 326, State M10), in step S28, the recognition part 506 recognizes the completion of the cutting process of the cutting part 40.

Further, after the completion of step S28, the cutter enters a standby state. In step S30, if it is determined in step S30 that there is another printing and cutting operation to follow (NO in step S30), the operation returns to step S20. If there is no subsequent printing or cutting (YES in step S30), the operation ends.

Next, a description is given of separation detection process for detecting the separation of the first module 200 and the second module 300 after the cutting detection process $V_2$. The separation detection process may be a process for determining whether the platen roller 2 has moved.

If the detection part 510 detects the absence of the movable blade 18 in the detection region D (detects an ON state) when the operation part 504 is not driving the drive mechanism 222 (when there is no movement of the movable blade 18), the recognition part 506 recognizes (determines) the separation of the first module 200 and the second module 300. Here, it is when the movable blade 28 is in State M2, the standby state after State M6, and the standby state after State M10 (FIGS. 37A and 37B) that the operation part 504 is not driving the drive mechanism 222. That is, "when the operation part 504 is not driving the drive mechanism 222" refers to the states other than the state of performing the movable blade detection process $V_1$ (States M3 through M6) and the state of performing the cutting detection process $V_2$.

Thus, basically, the detection part 510 is in a standby state, detecting the presence (positioning) of the movable blade 18 in the detection region D unless the movable blade detection process $V_1$ or the cutting detection process $V_2$ is performed. (See (e) of State M2 and Standby State in FIGS. 37A and 37B.) However, if the detection part 510 detects the absence of the movable blade 18 in the detection region D in this state (that is, when the operation part 504 is not driving the drive mechanism 222), this means that the first module 200 and the second module 300 are separated so that the movable blade 18 is not positioned in the detection region D.

Accordingly, if the detection part 510 detects the absence of the movable blade 18 in the detection region D when the operation part 504 is not driving the drive mechanism 222, the recognition part 506 recognizes (determines) the separation of the first module 200 and the second module 300.

Next, a description is given of detection of a malfunction.

If the detection part 510 asynchronously detects or cannot detect a state (ON state or OFF state) in response to the driving of a predetermined amount of driving (each of the first through fourth amount of driving) by the operation part 504, the recognition part 506 recognizes a malfunction of the movable blade 18.

That is, if the detection part 510 does not detect a state (ON state or OFF state) illustrated in FIGS. 37A and 37B that the detection part 510 is supposed to detect in spite of the operation part 504 having caused the drive mechanism 222 to be driven, the recognition part 506 recognizes a malfunction of the movable blade 18. Here, examples of the malfunction of the movable blade 18 include the inability of the movable blade 18 to move properly due to improper formation of the drive mechanism 222.

For example, if the detection part 510 does not detect an ON state (the second ON state) (that is, if the detection part 510 detects an OFF state) in response to the driving of the drive mechanism 222 by the first amount of driving by the operation part 504 (NO in step S12 of FIG. 38A), in step S13, the recognition part 506 recognizes a malfunction of the movable blade 18. This is because the movable blade 18 is not supposed to be positioned in the detection region D and the detection part 510 is supposed to detect an ON state after the operation part 504 causes the drive mechanism 222 to be driven by the first amount of driving.

For the same reason, if the detection part 510 does not detect an OFF state (the second OFF state) (that is, if the detection part 510 detects an ON state) in response to the driving of the drive mechanism 222 by the second amount of driving by the operation part 504 (NO in step S16 of FIG. 38A), if the detection part 510 does not detect an ON state (the third ON state) (that is, if the detection part 510 detects an OFF state) in response to the driving of the drive mechanism 222 by the third amount of driving by the operation part 504 (NO in step S22 of FIG. 38B), or if the detection part 510 does not detect an OFF state (the third OFF state) (that is, if the detection part 510 detects an ON state) in response to the driving of the drive mechanism 222 by the fourth amount of driving by the operation part 504 (NO in step S26 of FIG. 38B), the transmission part 508 (FIG. 35) transmits error information.

That is, if the operation part 504 causes the drive mechanism 222 to be driven by the first amount of driving or the third amount of driving and the detection part 510 detects the presence (positioning) of the movable blade 18 in the detection region D or if the operation part 504 causes the drive mechanism 222 to be driven by the second amount of driving or the fourth amount of driving and the detection part 510 detects the absence of the movable blade 18 in the detection region D, the recognition part 506 recognizes a malfunction of the movable blade 18.

The transmission part 508 may be configured to transmit error information in response to the recognition part 506 recognizing a malfunction of the movable blade 18. For example, a display part may be provided on the exterior of the recorder 100 (FIG. 5), and the transmitted error information may be displayed on the display part. For example, assuming the display part is an error lamp, the error lamp may be turned on. Thus, providing the transmission part 508 that transmits error information allows a user to recognize the inability of the movable blade 18 to move properly.

Further, the first amount of driving and the third amount of driving may be equalized, and the second amount of driving and the fourth amount of driving may be equalized. This makes it possible to simplify the configuration of the operation part 504. In this case, the first predetermined amount and the second predetermined amount are equal.

Thus, providing the detection part 510 and the recognition part 506 makes it possible to recognize (determine) the state of a cutting blade (the movable blade 18) and the state of the fitting (the shaft-supported state) of the platen roller 2 (the integration or separation of the first module 200 and the second module 300). Accordingly, it is possible to recognize (determine) the remaining amount of the paper A, the state of a cutting blade, and the state of the fitting (the shaft-supported state) of the platen roller 2 (the integration or separation of the first module 200 and the second module 300) with two sensors, that is, a paper sensor and the detection part 510. Accordingly, it is possible to reduce the cost and the size of the cutter and the recorder.

Further, the recognition part 506 and the detection part 510 may recognize (determine) the completion of the cutting process and a malfunction of the movable blade 18.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

What is claimed is:

1. A recorder, comprising:

a printing unit, wherein the printing unit includes a print head configured to perform printing on a recording medium; and a platen roller configured to rotate on a platen rotary shaft to draw and press the recording medium against the print head;

a shaft support member that rotatably supports the platen rotary shaft;

a cutter; and a drive mechanism for driving the cutter, wherein the cutter includes a movable blade that is coaxially rotatable with the platen rotary shaft, the movable blade including a body part on which a blade edge is formed; and an arm part that extends from a longitudinal end of the body part, that is rotatably attached to the platen rotary shaft, and that is connected to the drive mechanism to be driven to rotate on the platen rotary shaft so as to move the blade edge in an arc of a circle concentric with the platen rotary shaft;

a fixed blade configured to form a cutting part by coming into sliding contact with the movable blade that has moved in the arc; and a blade pressure generation part configured to generate a blade pressure between the movable blade and the fixed blade by urging at least one of the movable blade and the fixed blade toward the other of the movable blade and the fixed blade in the cutting part, and wherein the body part of the movable blade is curved along the arc.

2. The recorder as claimed in claim 1, further comprising:

a first module including the fixed blade; and a second module including the movable blade, the second module being configured to rotate on a first rotation shaft to be integrated with and separated from the first module, wherein the first module and the second module are configured to be integrated to form the cutting part.

3. The recorder as claimed in claim 2, further comprising:

a lock part configured to lock the integrated first and second modules so as to prevent a separation of the first module and the second module, wherein the first module includes a fixed blade block including the fixed blade, the fixed blade block is configured to rotate on a second rotation shaft in a direction toward the second module and in a direction away from the second module, and a rotation of the fixed blade block causes the lock part to lock the integrated first and second modules.

4. The recorder as claimed in claim 3, wherein the rotation of the fixed blade block in the direction away from the second module unlocks and separates the locked first and second modules.

5. The recorder as claimed in claim 2, further comprising:

a retreating operation part configured to, in response to an operation thereof, retract the fixed blade to a position where the fixed blade is prevented from contacting the movable blade when the first module and the second module are separated.

6. The recorder as claimed in claim 5, further comprising:

an end returning part configured to return an end of an object of cutting cut by the movable blade to a position where cutting is performable by the cutting part.

7. The recorder as claimed in claim 1, wherein the blade pressure generation part is an elastic member having a first end attached to the platen rotary shaft and having a second end attached to the fixed blade.

8. The recorder as claimed in claim 1, further comprising:

an end returning part configured to return an end of an object of cutting cut by the movable blade to a position where cutting is performable by the cutting part.

9. The recorder as claimed in claim 1, wherein the blade edge of the movable blade has one of a flat shape and an arc shape along the arc.

10. The recorder as claimed in claim 2, further comprising:

a detection part configured to detect a presence or absence of the movable blade in a detection region; and a recognition part configured to recognize an integration of the first module and the second module if there is an absence of a driving of the drive mechanism and the detection part detects the presence of the movable blade in the detection region after detecting the absence of the movable blade in the detection region.

11. The recorder as claimed in claim 10, wherein the recognition part is configured to recognize a presence of the movable blade when:

the recognition part recognizes the integration of the first module and the second module;

the detection part detects the absence of the movable blade in the detection region after the drive mechanism is driven to move the movable blade from a first position, where the movable blade is detected by the detection part, to a second position, where the movable blade is not detected by the detection part; and the detection part detects the presence of the movable blade in the detection region after the drive mechanism is driven to move the movable blade back from the second position to the first position.

12. The recorder as claimed in claim 11, wherein the recognition part is configured to recognize a completion of a cutting process of the cutting part when:

the recognition part recognizes the presence of the movable blade;

the detection part detects the absence of the movable blade in the detection region after the drive mechanism is driven to move the movable blade from the first position to a third position, where the movable blade is not detected by the detection part; and the detection part detects the presence of the movable blade in the detection region after the drive mechanism is driven to move the movable blade back from the third position to the first position.

13. The recorder as claimed in claim 12, wherein the recognition part is configured to recognize a malfunction of the movable blade if the detection part detects the presence of the movable blade in the detection region in response to the drive mechanism being driven to move the movable blade from the first position to the second position or the third position; or the detection part detects the absence of the movable blade in the detection region in response to the drive mechanism being driven to move the movable blade back from the second position or the third position to the first position.

14. The recorder as claimed in claim 10, wherein the recognition part is configured to recognize a separation of the first module and the second module if the detection part detects the absence of the movable blade in the detection region when there is no driving of the drive mechanism by the operation part.

15. The recorder as claimed in claim 1, wherein the arm part is driven to rotate on the platen rotary shaft independent of a rotation of the platen rotary shaft.

* * * * *